US007251889B2

(12) United States Patent
Kroliczek et al.

(10) Patent No.: US 7,251,889 B2
(45) Date of Patent: Aug. 7, 2007

(54) MANUFACTURE OF A HEAT TRANSFER SYSTEM

(75) Inventors: Edward J. Kroliczek, Davidsonville, MD (US); James Seokgeun Yun, Silver Spring, MD (US); Michael Nikitkin, Ellicott City, MD (US); David A. Wolf, Sr., Baltimore, MD (US)

(73) Assignee: Swales & Associates, Inc., Beltsville, MA (US)

( * ) Notice: Subject to any disclaimer, the term of this patent is extended or adjusted under 35 U.S.C. 154(b) by 141 days.

(21) Appl. No.: 10/974,968

(22) Filed: Oct. 28, 2004

(65) Prior Publication Data

US 2005/0166399 A1 Aug. 4, 2005

Related U.S. Application Data

(63) Continuation-in-part of application No. 10/676,265, filed on Oct. 2, 2003, and a continuation-in-part of application No. 10/694,387, filed on Oct. 28, 2003, and a continuation-in-part of application No. 10/602,022, filed on Jun. 24, 2003, now Pat. No. 7,004,240, and a continuation-in-part of application No. 09/896,561, filed on Jun. 29, 2003, now Pat. No. 6,889,754.

(60) Provisional application No. 60/514,424, filed on Oct. 28, 2003, provisional application No. 60/421,737, filed on Oct. 28, 2002, provisional application No. 60/415,424, filed on Oct. 2, 2002, provisional application No. 60/391,006, filed on Jun. 24, 2002, provisional application No. 60/215,588, filed on Jun. 30, 2000.

(51) Int. Cl.
*B21D 53/02* (2006.01)
*B23P 15/26* (2006.01)

(52) U.S. Cl. ..... 29/890.07; 29/890.032; 165/104.26; 165/272; 165/DIG. 531

(58) Field of Classification Search ..... 29/890.032, 29/447, 890.07; 165/104.21, 104.26, 272, 165/DIG. 531
See application file for complete search history.

(56) References Cited

U.S. PATENT DOCUMENTS 3,490,718 A 1/1970 Vary (Continued)

FOREIGN PATENT DOCUMENTS

EP 0 210 337 2/1987

(Continued)

OTHER PUBLICATIONS

Jentung Ku, "Operational Characteristics of Loop Heat Pipes", NASA Goddard Space Flight Center; SAE Paper 99-01-2007, 29th International Conference on Environmental Systems, Denver, Colorado, Jul. 12-15, 1999; Society of Automotive Engineers, Inc.

(Continued)

*Primary Examiner*—Eric Compton
(74) *Attorney, Agent, or Firm*—Fish & Richardson P.C.

(57) ABSTRACT

A method of making an evaporator includes orienting a vapor barrier wall, orienting a liquid barrier wall, and positioning a wick between the vapor barrier wall and the liquid barrier wall. The vapor barrier wall is oriented such that a heat-absorbing surface of the vapor barrier wall defines at least a portion of an exterior surface of the evaporator. The exterior surface is configured to receive heat. The liquid barrier wall is oriented adjacent the vapor barrier wall. The liquid barrier wall has a surface configured to confine liquid. A vapor removal channel is defined at an interface between the wick and the vapor barrier wall. A liquid flow channel is defined between the liquid barrier wall and the primary wick.

43 Claims, 70 Drawing Sheets

U.S. PATENT DOCUMENTS

| | | | | |
|---|---|---|---|---|
| 3,613,778 | A | 10/1971 | Feldman, Jr. | |
| 3,734,173 | A * | 5/1973 | Moritz | 165/104.26 |
| 3,792,318 | A * | 2/1974 | Fries et al. | 257/715 |
| 3,803,688 | A * | 4/1974 | Peck | 29/890.032 |
| 3,884,293 | A * | 5/1975 | Pessolano et al. | 165/51 |
| 4,005,297 | A * | 1/1977 | Cleaveland | 218/118 |
| 4,046,190 | A | 9/1977 | Marcus et al. | |
| 4,087,893 | A | 5/1978 | Sata et al. | |
| 4,116,266 | A | 9/1978 | Sawata et al. | |
| 4,170,262 | A | 10/1979 | Marcus et al. | |
| 4,503,483 | A | 3/1985 | Basiulis | |
| 4,685,512 | A | 8/1987 | Edelstein et al. | |
| 4,770,238 | A | 9/1988 | Owen | |
| 4,819,719 | A * | 4/1989 | Grote et al. | 165/104.26 |
| 4,830,718 | A | 5/1989 | Stauffer | |
| 4,862,708 | A | 9/1989 | Basiulis | |
| 4,883,116 | A | 11/1989 | Seidenberg et al. | |
| 5,002,122 | A | 3/1991 | Sarraf et al. | |
| 5,103,897 | A | 4/1992 | Cullimore et al. | |
| 5,303,768 | A | 4/1994 | Alario et al. | |
| 5,335,720 | A | 8/1994 | Ogushi et al. | |
| 5,642,776 | A | 7/1997 | Meyer, IV et al. | |
| 5,725,049 | A | 3/1998 | Swanson et al. | |
| 5,761,037 | A | 6/1998 | Anderson et al. | |
| 5,771,967 | A | 6/1998 | Hyman | |
| 5,816,313 | A | 10/1998 | Baker | |
| 5,842,513 | A | 12/1998 | Maciaszek et al. | |
| 5,899,265 | A | 5/1999 | Schneider et al. | |
| 5,944,092 | A | 8/1999 | Van Oost | |
| 5,950,710 | A | 9/1999 | Liu | |
| 5,966,957 | A | 10/1999 | Malhammar et al. | |
| 6,058,711 | A | 5/2000 | Maciaszek et al. | |
| 6,330,907 | B1 * | 12/2001 | Ogushi et al. | 165/104.26 |
| 6,381,135 | B1 | 4/2002 | Prasher et al. | |
| 6,382,309 | B1 | 5/2002 | Kroliczek et al. | |
| 6,450,162 | B1 | 9/2002 | Wang et al. | |
| 6,615,912 | B2 | 9/2003 | Garner | |
| 6,810,946 | B2 | 11/2004 | Hoang | |
| 2002/0007937 | A1 | 1/2002 | Kroliczek et al. | |
| 2003/0051857 | A1 | 3/2003 | Cluzet et al. | |
| 2004/0182550 | A1 | 9/2004 | Kroliczek et al. | |
| 2004/0206479 | A1 | 10/2004 | Kroliczek et al. | |

FOREIGN PATENT DOCUMENTS

| | | |
|---|---|---|
| EP | 0 987 509 A1 | 3/2000 |
| JP | 2000-055577 | 2/2000 |
| RU | 2 098 733 | 3/1995 |
| SU | 1 467 354 | 1/1987 |
| WO | 02/10661 A1 | 2/2002 |

OTHER PUBLICATIONS

Jane Baumann et al., "A methodology for enveloping reliable start-up of LHPs", AIAA Paper 2000-2285 (AIAA Accession No. 33681), AIAA Thermophysics Conference, 34th, Denver, CO, Jun. 19-22, 2000.

W. B. Bienert et al., "The Proof-Of-Feasibility of Multiple Evaporator Loop Heat Pipes", 6th European Symposium on Environmental Systems, May 1997, 6 pages.

S. Yun et al., "Design and Test Results of Multi-Evaporator Loop Heat Pipes", SAE Paper No. 1999-01-2051, 29th International Conference on Environmental Systems, Jul. 1999, 7 pages.

Stephane Van Oost et al., "Test Results of Reliable and Very High Capillary Multi-Evaporators/Condenser Loop", 25th International Conference on Environmental Systems, Jul. 10-13, 1995, 12 pages.

E. Yu Kotlyarov et al., "Methods of Increase of the Evaporators Reliability for Loop Heat Pipes and Capillary Pumped Loops", 24th International Conference on Environmental Systems, Jun. 20-23, 1994, 15 pages.

Hoang, "Advanced Capillary Pumped Loop (A-CPL) Project Summary" Contract No. NAS5-98103, Mar. 1994, pp. 1-37.

Martin Janssen et al., "Measurement and application of performance characteristics of a Free Piston Stirling Cooler", 9th International Refrigeration and Air Conditioning Conference, Jul. 16-19, 2002, 8 pages.

Yong-Rak Kwon et al., "Operational Characteristics of Stirling Machinery", International Congress of Refrigeration, Aug. 17-22, 2003, 8 pages.

David M. Berchowitz et al., "Design and Testing of a 40 W Free-Piston Stirling Cycle Cooling Unit", 20th International Conference of Refrigerations, IIR/IIF, Sydney, 1999, 7 pages.

D.M. Berchowitz Ph. D., "Maximized Performance of Stirling Cycle Refrigerators", Natural working fluids '98 IIR—Gustav Lorentzen Conference: Oslo, Norway, Jun. 2-5, 1998, Fluides actifs naturels conference IIF—Gustav Lorentzen, Journal: Science et technique du froid, 1998 (4) 422-429.

David M. Berchowitz, "Free-Piston Rankine Compression and Stirling Cycle Machines for Domestic Refrigeration", Presented at the Greenpeace Ozon Safe Conference, Washington, DC, Oct. 18-19, 1993.

Stephen C. Wetty and Fernando Cueva, "Energy Efficient Freezer Installation Using Natural Working Fluids and a Free Piston Stirling Cooler" VI Congreso Iberoamericano De Aire Acondicionado Y Refrigeracion, CIAR 2001, Trabajo No. 96, pp. 199-208, Aug. 15-17, 2001.

Emre Oguz et al., "Experimental Investigation Of a Stirling Cycle Cooled Domestic Refrigerator", 9th Proceedings of the International Refrigeration and Air Conditioning Conference at Purdue, 2002; 9th; vol. 2, pp. 777-784.

Seon-Young Kim et al., "The Application of Stirling Cooler to Refrigeration", IECEC-97-Intersociety Energy Conversion Engineering Conference, 1997, Conference 32, vol. 2, pp. 1023-1026.

D.M. Berchowitz et al. "Recent Advances in Stirling Cycle Refrigeration", 1995, 19th International Conference of Refrigeration, The Hague, The Netherlands, 8 pages.

"Across-Gimbal and Miniaturized Cryogenic Loop Heat Pipes," Bugby, D. et al., CP654, Space Technology and Applications International Forum—STAIF 2003, edited by M.S. El-Genk, American Institute of Physics, 2003, pp. 218-226.

"Advanced Components for Cryogenic Integration," Bugby, D. et al, Cryocoolers 12, edited by R.G. Ross, Jr., Kluwer Academic/Plenum Publishers, 2003, pp. 693-708.

"Advanced Components for Cryogenic Integration," Bugby, D. et al, Proceedings of the 12th International Cryocooler Conference, held Jun. 18-20, 2002, in Cambridge MA., 15 pages.

"Advanced Components and Techniques for Cryogenic Integration," D. Bugby et al., Environmental systems—International conference; 31st, Society of Automotive Engineers New York, 2001-01-2378, Orlando, FL 2001; Jul. (200107), 9 pages.

"Advanced Components and Techniques for Cryogenic Integration," D. Bugby et al., presented at 2002 Spacecraft Thermal Control Symposium by Swales Aerospace, El Segundo, CA, Mar. 2002, 14 pages.

"An Improved High Power Hybrid Capillary Pumped Loop," J. Ku et al., paper submitted to SAE 19th Intersociety Conference on Environment Systems, SAE 891566, San Diego, CA, Jul. 24-27, 1989, 10 pages.

"Design and Experimental Results of the HPCPL," Van Oost et al., ESTEC CPL-96 Workshop, Noordwijk, Netherlands, 1996, 29 pages.

"Design and Test of a Proof-of-Concept Advanced Capillary Pumped Loop," Triem T. Hoang, Society of Automotive Engineers, presented at the 27th Environmental systems International conference, New York, 1997, Paper 972326, 6 pages.

"Design and Testing of a High Power Spacecraft Thermal Management System," McCabe, Jr., Michael E. et al., National Aeronautics and Space Administration (NASA), NASA Technical Memorandum 4051, Scientific and Technical Information Division, 1988, 107 pages.

"Development and Testing of a Gimbal Thermal Transport System," D. Bugby et al., Proceedings of the 11th International Cryocooler Conference, held Jun. 20-22, 2000, in Keystone, Colorado, 11 pages.

"Development of a Cryogenic Loop Heat Pipe (CLHP) for Passive Optical Bench Cooling Applications," James Yun, et al., 32nd International Conference on Environmental Systems (ICES-2002), Society of Automotive Engineers Paper No. 2002-01-2507, San Antonio, Texas, 2002, 9 pages.

"Development of an Advanced Capillary Pumped Loop," Triem T. Hoang et al., Society of Automotive Engineers, presented at the 27th Environmental systems International conference, New York, 1997, Paper 972325, 6 pages.

"Development of Advanced Cyrogenic Integration Solutions," D. Bugby et al., presented at the 10th International Cryocoolers Conference on May 26-28, 1998 in Monterey, CA and published in "Cryocoolers 10," by Ron Ross, Jr., Kluwer Academic/Plenum Publishers, NY 1999, 17 pages.

"Hydrogen Loop Pipe Design & Test Results," O'Connell et al., presented at 2002 Spacecraft Thermal Control Symposium by TTH Research, El Segundo, CA, Mar. 2002, 14 pages.

"Multiple Evaporator Loop Heat Pipe," James Yun, et al., Society of Automotive Engineers, 2000-01-2410, 30th International Conference on Environmental Systems, Jul. 10-13, 2000, 10 pages.

"Recent Advances in Capillary Pumped Loop Technology," J. Ku, 1997 National Heat Transfer Conference, Baltimore, MD, Aug. 10-12, 1997, AIAA 97-3870, 22 pages.

"Testing of a Capillary Pumped Loop with Multiple parallel starter pumps," J. Ku et al, SAE Paper No. 972329, 1997.

"The Hybrid Capillary Pumped Loop," J. Ku et al., paper submitted to SAE 18th Intersociety Conference on Environmental Systems, SAE 881083, San Francisco, CA, Jul. 11-13, 1988, 11 pages.

International Search Report issued in PCT International Application No. PCT/US04/3548, mailed Oct. 11, 2005.

"A high power spacecraft thermal management system," J. Ku, et al., AIAA-1988-2702, Thermophysics, Plasmadynamics and Lasers Conference, San Antonio, TX, Jun. 27-29, 1988, 12 pages.

* cited by examiner

5425

MANUFACTURE OF A HEAT TRANSFER SYSTEM

CROSS REFERENCE TO RELATED APPLICATIONS

This application claims the benefit of U.S. Provisional Application No. 60/514,670, filed Oct. 28, 2003. This application is a continuation-in-part of U.S. application Ser. No. 10/676,265, filed Oct. 2, 2003, which claimed priority to U.S. application Ser. No. 60/415,424, filed Oct. 2, 2002. This application is also a continuation-in-part of U.S. application Ser. No. 10/694,387, filed Oct. 28, 2003, which claimed priority to U.S. Provisional Application No. 60/421,737, filed Oct. 28, 2002. This application is also a continuation-in-part of U.S. application Ser. No. 10/602,022, filed Jun. 24, 2003 now U.S. Pat. No. 7,004,240, which claims the benefit of U.S. Provisional Application No. 60/391,006, filed Jun. 24, 2002 and is a continuation-in-part of U.S. application Ser. No. 09/896,561, filed Jun. 29, 2001 now U.S. Pat. No. 6,889,754, which claims the benefit of U.S. Provisional Application No. 60/215,588, filed Jun. 30, 2000. All of these applications are incorporated herein by reference.

TECHNICAL FIELD

This description relates to heat transfer systems and methods of manufacturing the heat transfer systems.

BACKGROUND

Heat transfer systems are used to transport heat from one location (the heat source) to another location (the heat sink). Heat transfer systems can be used in terrestrial or extraterrestrial applications. For example, heat transfer systems may be integrated by satellite equipment that operates within zero or low-gravity environments. As another example, heat transfer systems can be used in electronic equipment, which often requires cooling during operation.

Loop Heat Pipes (LHPs) and Capillary Pumped Loops (CPLs) are passive two-phase heat transfer systems. Each includes an evaporator thermally coupled to the heat source, a condenser thermally coupled to the heat sink, fluid that flows between the evaporator and the condenser, and a fluid reservoir for expansion of the fluid. The fluid within the heat transfer system can be referred to as the working fluid. The evaporator includes a primary wick and a core that includes a fluid flow passage. Heat acquired by the evaporator is transported to and discharged by the condenser. These systems utilize capillary pressure developed in a fine-pored wick within the evaporator to promote circulation of working fluid from the evaporator to the condenser and back to the evaporator. The primary distinguishing characteristic between an LHP and a CPL is the location of the loop's reservoir, which is used to store excess fluid displaced from the loop during operation. In general, the reservoir of a CPL is located remotely from the evaporator, while the reservoir of an LHP is co-located with the evaporator.

SUMMARY

In one general aspect, a method of making an evaporator includes orienting a vapor barrier wall, orienting a liquid barrier wall, and positioning a wick between the vapor barrier wall and the liquid barrier wall. The vapor barrier wall is oriented such that a heat-absorbing surface of the vapor barrier wall defines at least a portion of an exterior surface of the evaporator. The exterior surface is configured to receive heat. The liquid barrier wall is oriented adjacent the vapor barrier wall. The liquid barrier wall has a surface configured to confine liquid. At least one of the orienting a vapor barrier wall, orienting a liquid barrier wall, and positioning the wick includes defining a vapor removal channel at an interface between the wick and the vapor barrier wall. At least one of the orienting a vapor barrier wall, orienting a liquid barrier wall, and positioning the wick includes defining a liquid flow channel between the liquid barrier wall and the primary wick.

Implementations may include one or more of the following aspects. For example, the method may also include forming the vapor barrier wall and forming the liquid barrier wall. Forming the vapor barrier wall may include forming the vapor barrier wall into a planar shape and forming the liquid barrier wall may include forming the liquid barrier wall into a planar shape. Forming the vapor barrier wall may include forming the vapor barrier wall into an annular shape and forming the liquid barrier wall may include forming the liquid barrier wall into an annular shape.

Positioning the wick may include heat shrinking the wick on the vapor barrier wall. Positioning the wick may include heat shrinking the liquid barrier wall on the wick.

Positioning may include positioning the wick between the vapor barrier wall and the liquid confining surface of the liquid barrier wall.

The method may also include orienting a subcooler adjacent the liquid barrier wall. Orienting the subcooler may include heat shrinking the subcooler onto the liquid barrier wall.

The method may include electroetching, machining, or photoetching the vapor removal channel into the vapor barrier wall. The method may include embedding the vapor removal channel within the wick.

The method may also include forming the vapor barrier wall by rolling a vapor barrier material into a cylindrical shape and sealing mating edges of the vapor barrier material. The method may include forming the liquid barrier wall by rolling a liquid barrier material into a cylindrical shape and sealing mating edges of the liquid barrier material.

Orienting the liquid barrier wall may include heat shrinking the liquid barrier wall.

The method may include forming the liquid barrier wall, and photoetching the liquid flow channel into the liquid barrier wall.

In another general aspect, a method of making an evaporator includes orienting a liquid barrier wall having an annular shape, orienting a vapor barrier wall having an annular shape coaxially with the liquid barrier wall, and positioning a wick between the liquid barrier wall and the vapor barrier wall, the wick being coaxial with the liquid barrier wall.

Implementations may include one or more of the following aspects. For example, the method may include forming the vapor barrier wall and forming the liquid barrier wall.

Positioning the wick may include heat shrinking the wick on the vapor barrier wall. Positioning the wick may include heat shrinking the liquid barrier wall on the wick. Positioning may include positioning the wick between the vapor barrier wall and a liquid confining surface of the liquid barrier wall.

The method may include orienting a subcooler adjacent the liquid barrier wall. Orienting the subcooler may include heat shrinking the subcooler onto the liquid barrier wall.

The method may include electroetching, machining, or photoetching the vapor removal channel into the vapor barrier wall. The method may include embedding the vapor removal channel within the wick.

The method may include forming the vapor barrier wall by rolling a vapor barrier material into a cylindrical shape and sealing mating edges of the vapor barrier material. The method may further include forming the liquid barrier wall by rolling a liquid barrier material into a cylindrical shape and sealing mating edges of the liquid barrier material.

Orienting the liquid barrier wall may include heat shrinking the liquid barrier wall.

Other features and advantages will be apparent from the description, the drawings, and the claims.

DESCRIPTION OF DRAWINGS

Like reference symbols in the various drawings indicate like elements.

DETAILED DESCRIPTION

As discussed above, in a loop heat pipe (LHP), the reservoir is co-located with the evaporator, thus, the reservoir is thermally and hydraulically connected with the reservoir through a heat-pipe-like conduit. In this way, liquid from the reservoir can be pumped to the evaporator, thus ensuring that the primary wick of the evaporator is sufficiently wetted or "primed" during start-up. Additionally, the design of the LHP also reduces depletion of liquid from the primary wick of the evaporator during steady-state or transient operation of the evaporator within a heat transport system. Moreover, vapor and/or bubbles of non-condensable gas (NCG bubbles) vent from a core of the evaporator through the heat-pipe-like conduit into the reservoir.

Conventional LHPs require that liquid be present in the reservoir prior to start-up, that is, application of power to the evaporator of the LHP. However, if the working fluid in the LHP is in a supercritical state prior to start-up of the LHP, liquid will not be present in the reservoir prior to start-up. A supercritical state is a state in which a temperature of the LHP is above the critical temperature of the working fluid. The critical temperature of a fluid is the highest temperature at which the fluid can exhibit a liquid-vapor equilibrium. For example, the LHP may be in a supercritical state if the working fluid is a cryogenic fluid, that is, a fluid having a boiling point below −150° C., or if the working fluid is a sub-ambient fluid, that is, a fluid having a boiling point below the temperature of the environment in which the LHP is operating.

Conventional LHPs also require that liquid returning to the evaporator be subcooled, that is, cooled to a temperature that is lower than the boiling point of the working fluid. Such a constraint makes it impractical to operate LHPs at a sub-ambient temperature. For example, if the working fluid is a cryogenic fluid, the LHP is likely operating in an environment having a temperature greater than the boiling point of the fluid.

Figure 1:
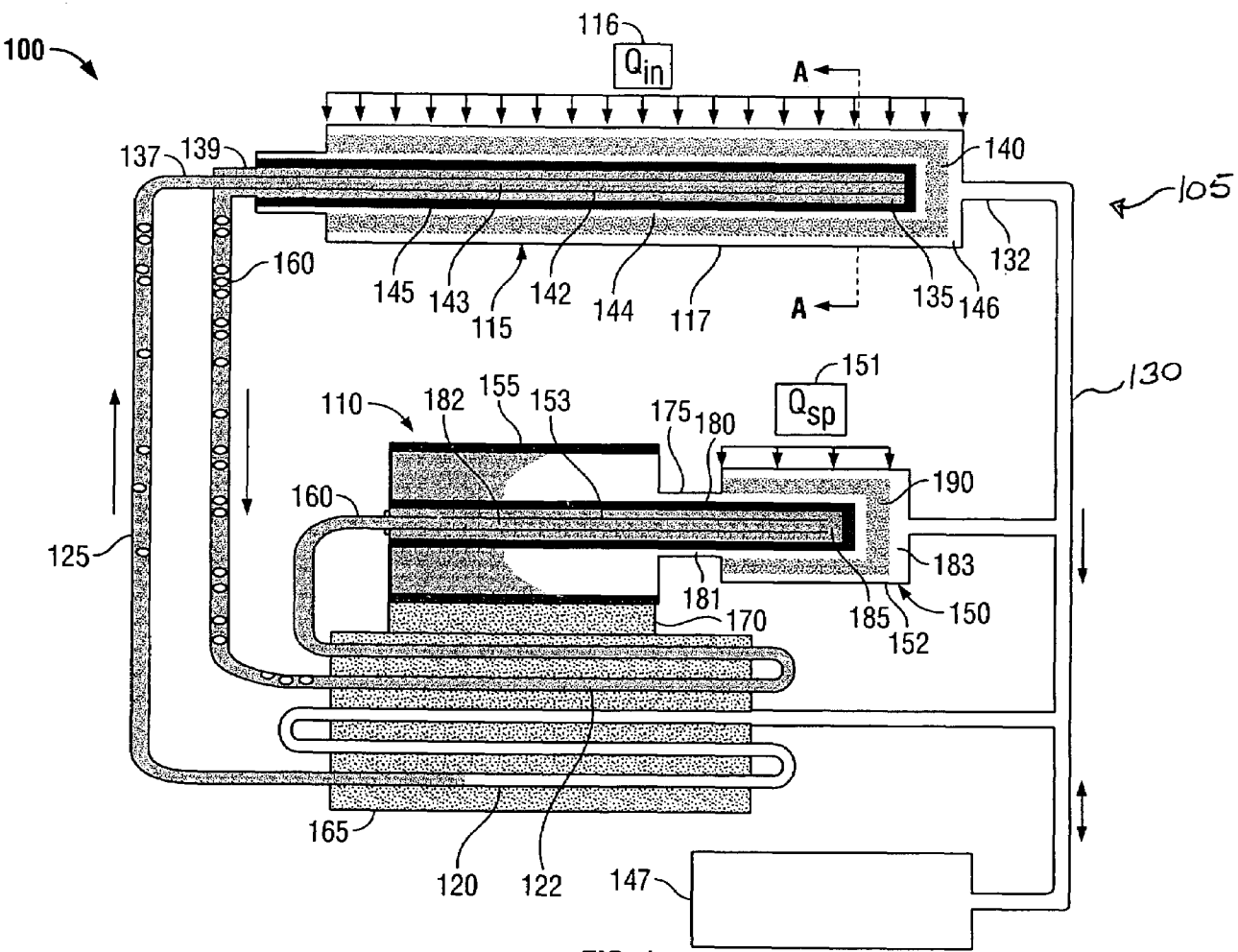
FIG. 1 is a schematic diagram of a heat transport system.

Referring to FIG. 1, a heat transport system 100 is designed to overcome limitations of conventional LHPs. The heat transport system 100 includes a heat transfer system 105 and a priming system 110. The priming system 110 is configured to convert fluid within the heat transfer system 105 into a liquid, thus priming the heat transfer system 105. As used in this description, the term "fluid" is a generic term that refers to a substance that is both a liquid and a vapor in saturated equilibrium.

The heat transfer system 105 includes a main evaporator 115, and a condenser 120 coupled to the main evaporator 115 by a liquid line 125 and a vapor line 130. The condenser 120 is in thermal communication with a heat sink 165, and the main evaporator 115 is in thermal communication with a heat source Qin 116. The system 105 may also include a hot reservoir 147 coupled to the vapor line 130 for additional pressure containment, as needed. In particular, the hot reservoir 147 increases the volume of the system 100. If the working fluid is at a temperature above its critical temperature, that is, the highest temperature at which the working fluid can exhibit liquid-vapor equilibrium, its pressure is proportional to the mass in the system 100 (the charge) and inversely proportional to the volume of the system. Increasing the volume with the hot reservoir 147 lowers the fill pressure.

The main evaporator 115 includes a container 117 that houses a primary wick 140 within which a core 135 is defined. The main evaporator 115 includes a bayonet tube 142 and a secondary wick 145 within the core 135. The bayonet tube 142, the primary wick 140, and the secondary wick 145 define a liquid passage 143, a first vapor passage 144, and a second vapor passage 146. The secondary wick 145 provides phase control, that is, liquid/vapor separation in the core 135, as discussed in U.S. application Ser. No. 09/896,561, filed Jun. 29, 2001, which is incorporated herein by reference in its entirety. As shown, the main evaporator 115 has three ports, a liquid inlet 137 into the liquid passage 143, a vapor outlet 132 into the vapor line 130 from the second vapor passage 146, and a fluid outlet 139 from the liquid passage 143 (and possibly the first vapor passage 144, as discussed below). Further details on the structure of a three-port evaporator are discussed below with respect to FIGS. 5A and 5B.

The priming system 110 includes a secondary or priming evaporator 150 coupled to the vapor line 130 and a reservoir 155 co-located with the secondary evaporator 150. The reservoir 155 is coupled to the core 135 of the main evaporator 115 by a secondary fluid line 160 and a secondary condenser 122. The secondary fluid line 160 couples to the fluid outlet 139 of the main evaporator 115. The priming system 110 also includes a controlled heat source Qsp 151 in thermal communication with the secondary evaporator 150.

The secondary evaporator 150 includes a container 152 that houses a primary wick 190 within which a core 185 is defined. The secondary evaporator 150 includes a bayonet tube 153 and a secondary wick 180 that extend from the core 185, through a conduit 175, and into the reservoir 155. The secondary wick 180 provides a capillary link between the reservoir 155 and the secondary evaporator 150. The bayonet tube 153, the primary wick 190, and the secondary wick 180 define a liquid passage 182 coupled to the fluid line 160, a first vapor passage 181 coupled to the reservoir 155, and a second vapor passage 183 coupled to the vapor line 130. The reservoir 155 is thermally and hydraulically coupled to the core 185 of the secondary evaporator 150 through the liquid passage 182, the secondary wick 180, and the first vapor passage 181. Vapor and/or NCG bubbles from the core 185 of the secondary evaporator 150 are swept through the first vapor passage 181 to the reservoir 155 and condensable liquid is returned to the secondary evaporator 150 through the secondary wick 180 from the reservoir 155. The primary wick 190 hydraulically links liquid within the core 185 to the heat source Qsp 151, permitting liquid at an outer surface of the primary wick 190 to evaporate and form vapor within the second vapor passage 183 when heat is applied to the secondary evaporator 150.

The reservoir 155 is cold-biased, and thus, it is cooled by a cooling source that will allow it to operate, if unheated, at a temperature that is lower than the temperature at which the heat transfer system 105 operates. In one implementation, the reservoir 155 and the secondary condenser 122 are in thermal communication with the heat sink 165 that is thermally coupled to the condenser 120. For example, the reservoir 155 can be mounted to the heat sink 165 using a shunt 170, which may be made of aluminum or any heat conductive material. In this way, the temperature of the reservoir 155 tracks the temperature of the condenser 120.

Figure 2:
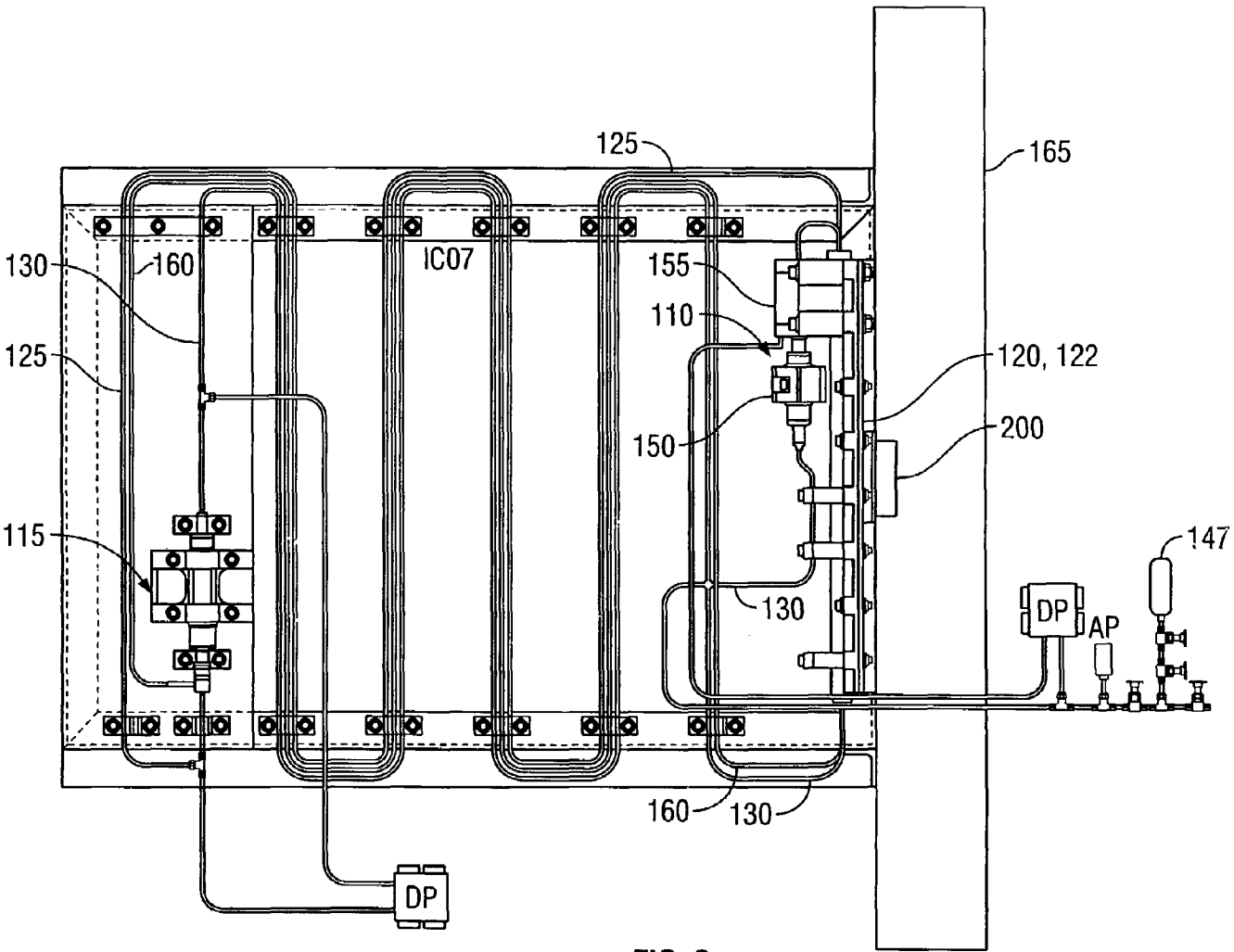
FIG. 2 is a diagram of an implementation of the heat transport system schematically shown by FIG. 1.

FIG. 2 shows an example of an implementation of the heat transport system 100. In this implementation, the condensers 120 and 122 are mounted to a cryocooler 200, which acts as a refrigerator, transferring heat from the condensers 120, 122 to the heat sink 165. Additionally, in the implementation of FIG. 2, the lines 125, 130, 160 are wound to reduce space requirements for the heat transport system 100.

Though not shown in FIGS. 1 and 2, elements such as, for example, the reservoir 155 and the main evaporator 115, may be equipped with temperature sensors that can be used for diagnostic or testing purposes.

Figure 3:
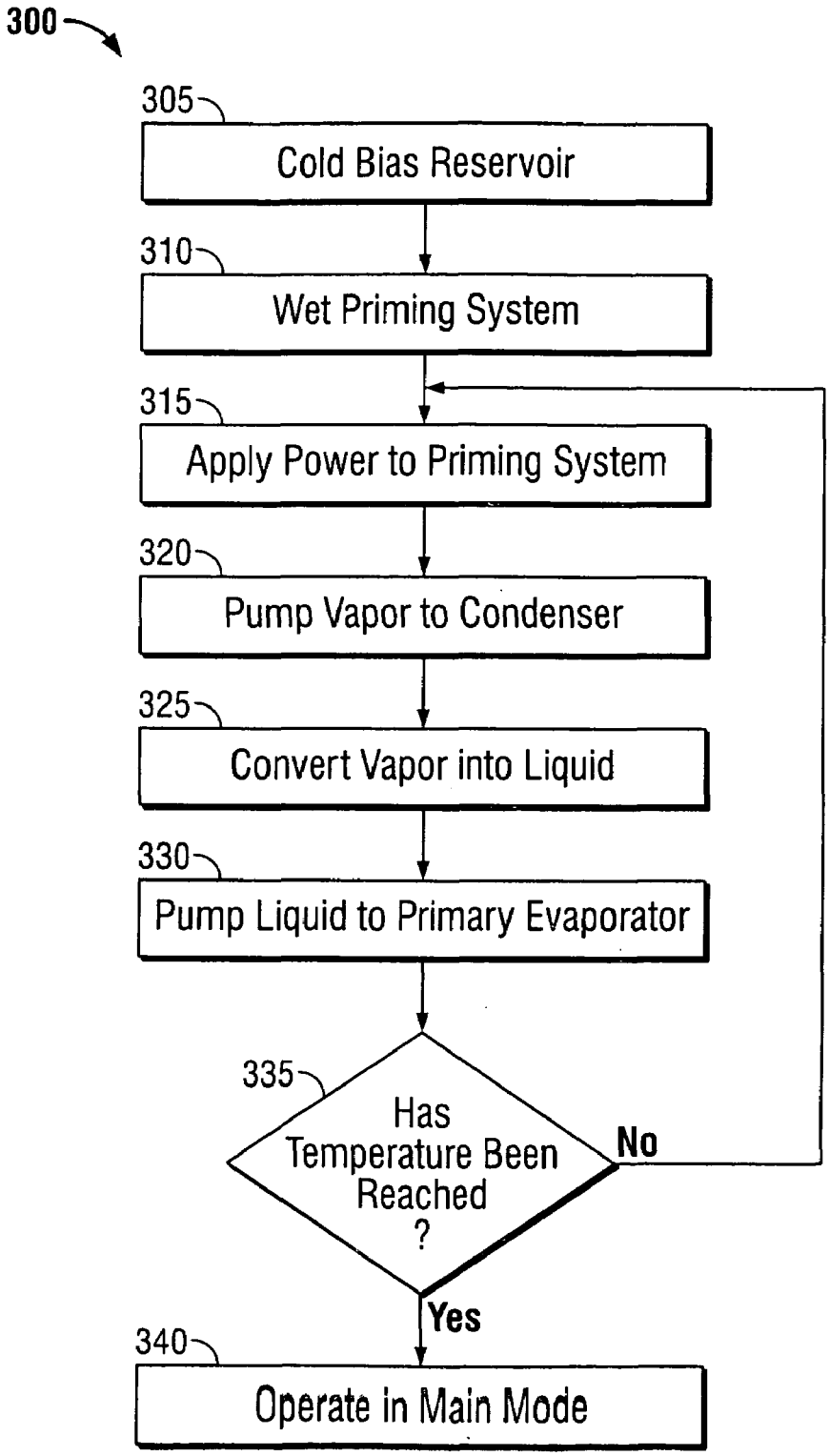
FIG. 3 is a flow chart of a procedure for transporting heat using a heat transport system.

Referring also to FIG. 3, the system 100 performs a procedure 300 for transporting heat from the heat source Qin 116 and for ensuring that the main evaporator 115 is wetted with liquid prior to startup. The procedure 300 is particularly useful when the heat transfer system 105 is at a supercritical state. Prior to initiation of the procedure 300, the system 100 is filled with a working fluid at a particular pressure, referred to as a "fill pressure."

Initially, the reservoir 155 is cold-biased by, for example, mounting the reservoir 155 to the heat sink 165 (step 305). The reservoir 155 may be cold-biased to a temperature below the critical temperature of the working fluid, which, as discussed, is the highest temperature at which the working fluid can exhibit liquid-vapor equilibrium. For example, if the fluid is ethane, which has a critical temperature of 33° C., the reservoir 155 is cooled to below 33° C. As the temperature of the reservoir 155 drops below the critical temperature of the working fluid, the reservoir 155 partially fills with a liquid condensate formed by the working fluid. The formation of liquid within the reservoir 155 wets the secondary wick 180 and the primary wick 190 of the secondary evaporator 150 (step 310).

Meanwhile, power is applied to the priming system 110 by applying heat from the heat source Qsp 151 to the secondary evaporator 150 (step 315) to enhance or initiate circulation of fluid within the heat transfer system 105. Vapor output by the secondary evaporator 150 is pumped through the vapor line 130 and through the condenser 120 (step 320) due to capillary pressure at the interface between the primary wick 190 and the second vapor passage 183. As vapor reaches the condenser 120, it is converted to liquid (step 325). The liquid formed in the condenser 120 is pumped to the main evaporator 115 of the heat transfer system 105 (step 330). When the main evaporator 115 is at a higher temperature than the critical temperature of the fluid, the liquid entering the main evaporator 115 evaporates and cools the main evaporator 115. This process (steps 315–330) continues, causing the main evaporator 115 to reach a set point temperature (step 335), at which point the main evaporator is able to retain liquid and be wetted and to operate as a capillary pump. In one implementation, the set point temperature is the temperature to which the reservoir 155 has been cooled. In another implementation, the set point temperature is a temperature below the critical temperature of the working fluid. In a further implementation, the set point temperature is a temperature above the temperature to which the reservoir 155 has been cooled.

If the set point temperature has been reached (step 335), the system 100 operates in a main mode (step 340) in which heat from the heat source Qin 116 that is applied to the main evaporator 115 is transferred by the heat transfer system 105. Specifically, in the main mode, the main evaporator 115 develops capillary pumping to promote circulation of the working fluid through the heat transfer system 105. Also, in the main mode, the set point temperature of the reservoir 155 is reduced. The rate at which the heat transfer system 105 cools down during the main mode depends on the cold biasing of the reservoir 155 because the temperature of the main evaporator 115 closely follows the temperature of the reservoir 155. Additionally, though not required, a heater can be used to further control or regulate the temperature of the reservoir 155 during the main mode. Furthermore, in main mode, the power applied to the secondary evaporator 150 by the heat source Qsp 151 is reduced, thus bringing the heat transfer system 105 down to a normal operating temperature for the fluid. For example, in the main mode, the heat load from the heat source Qsp 151 to the secondary evaporator 150 is kept at a value equal to or in excess of heat conditions, as defined below. In one implementation, the heat load from the heat source Qsp is kept to about 5 to 10% of the heat load applied to the main evaporator 115 from the heat source Qin 116.

In this particular implementation, the main mode is triggered by the determination that the set point temperature has been reached (step 335). In other implementations, the main mode may begin at other times or due to other triggers. For example, the main mode may begin after the priming system is wet (step 310) or after the reservoir has been cold biased (step 305).

At any time during operation, the heat transfer system 105 can experience heat conditions such as those resulting from heat conduction across the primary wick 140 and parasitic heat applied to the liquid line 125. Both conditions cause formation of vapor on the liquid side of the evaporator. Specifically, heat conduction across the primary wick 140 can cause liquid in the core 135 to form vapor bubbles, which, if left within the core 135, would grow and block off liquid supply to the primary wick 140, thus causing the main evaporator 115 to fail. Parasitic heat input into the liquid line 125 (referred to as "parasitic heat gains") can cause liquid within the liquid line 125 to form vapor.

To reduce the adverse impact of heat conditions discussed above, the priming system 110 operates at a power level Qsp 151 greater than or equal to the sum of the head conduction and the parasitic heat gains. As mentioned above, for example, the priming system can operate at 5–10% of the power to the heat transfer system 105. In particular, fluid that includes a combination of vapor bubbles and liquid is swept out of the core 135 for discharge into the secondary fluid line 160 leading to the secondary condenser 122. In particular, vapor that forms within the core 135 travels around the bayonet tube 143 directly into the fluid outlet port 139. Vapor that forms within the first vapor passage 144 makes it way into the fluid outlet port 139 by either traveling through the secondary wick 145 (if the pore size of the secondary wick 145 is large enough to accommodate vapor bubbles) or through an opening at an end of the secondary wick 145 near the outlet port 139 that provides a clear passage from the first vapor passages 144 to the outlet port 139. The secondary condenser 122 condenses the bubbles in the fluid and pushes the fluid to the reservoir 155 for reintroduction into the heat transfer system 105.

Figure 8A:
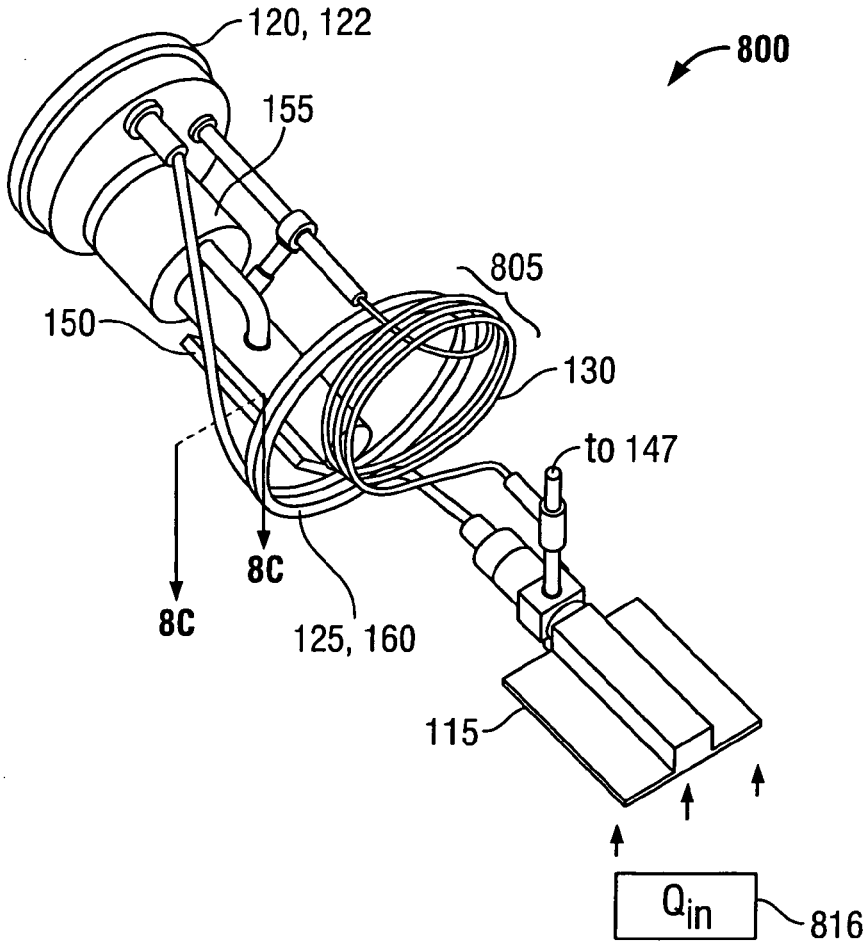
FIGS. 8A, 8B, 9A, and 9B are perspective views of applications using a heat transport system.
Figure 8B:
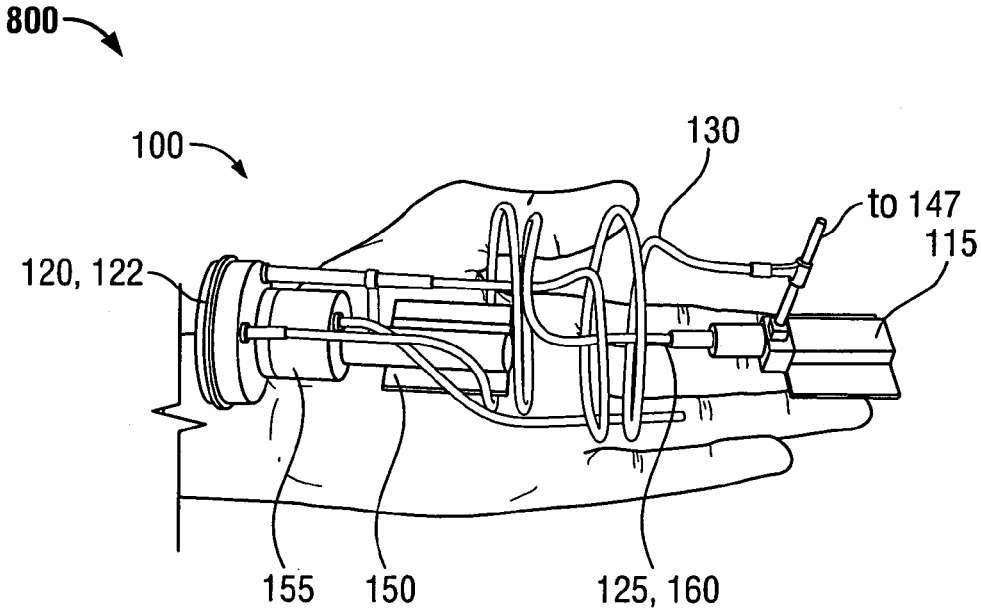
Figure 8C:
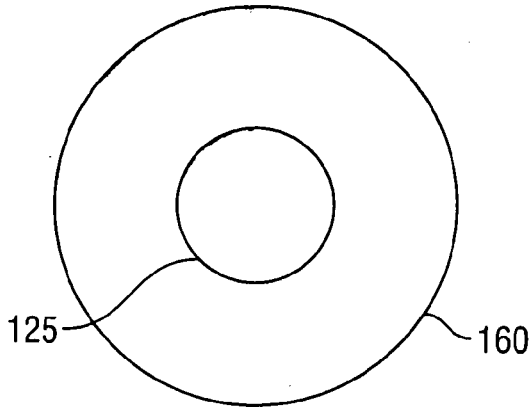
FIG. 8C is a cross-sectional view of a fluid line taken along 8C—8C of FIG. 8A.
Figure 8D:
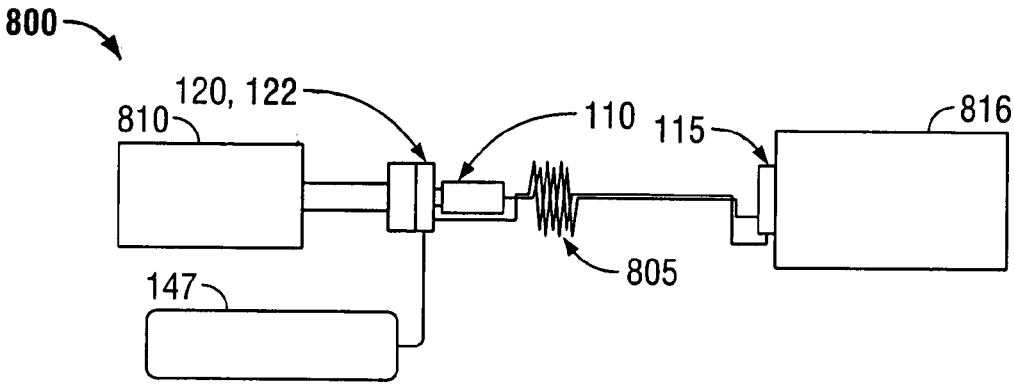
FIGS. 8D and 9C are schematic diagrams of the implementations of the heat transport systems of FIGS. 8A and 9A, respectively.

Similarly, to reduce parasitic heat input to the liquid line 125, the secondary fluid line 160 and the liquid line 125 can form a coaxial configuration and the secondary fluid line 160 surrounds and insulates the liquid line 125 from surrounding heat. This implementation is discussed further below with reference to FIGS. 8A and 8B. As a consequence of this configuration, it is possible for the surrounding heat to cause vapor bubbles to form in the secondary fluid line 160, instead of in the liquid line 125. As discussed, by virtue of capillary action affected at the secondary wick 145, fluid flows from the main evaporator 115 to the secondary condenser 122. This fluid flow, and the relatively low temperature of the secondary condenser 122, causes a sweeping of the vapor bubbles within the secondary fluid line 160 through the condenser 122, where they are condensed into liquid and pumped into the reservoir 155.

Figure 4:
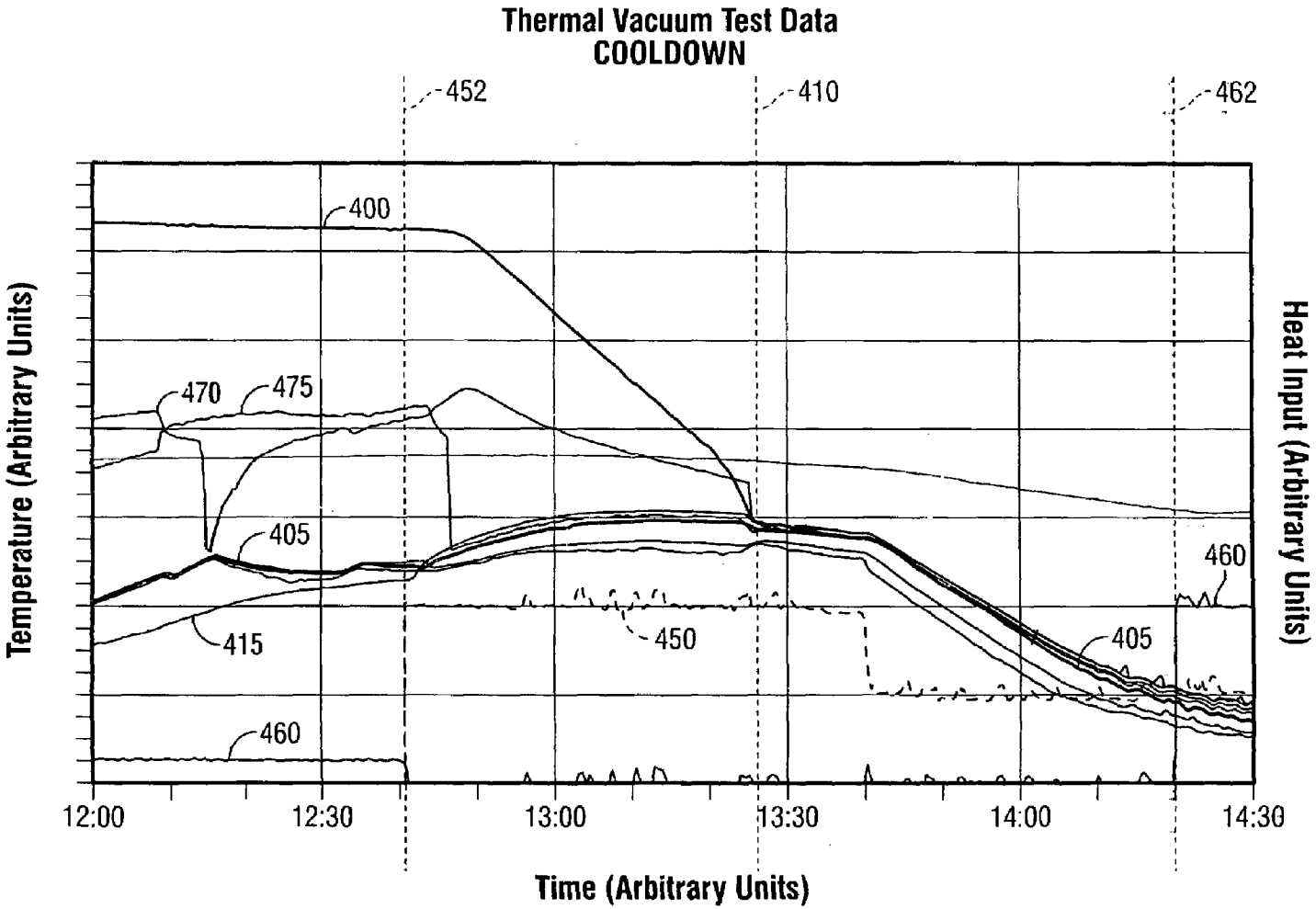
FIG. 4 is a graph showing temperature profiles of various components of the heat transport system during the process flow of FIG. 3.

As shown in FIG. 4, data from a test run is shown. In this implementation, prior to startup of the main evaporator 115 at temperature 410, a temperature 400 of the main evaporator 115 is significantly higher than a temperature 405 of the reservoir 155, which has been cold-biased to the set point temperature (step 305). As the priming system 110 is wetted (step 310), power Qsp 450 is applied to the secondary evaporator 150 (step 315) at a time 452, causing liquid to be pumped to the main evaporator 115 (step 330), the temperature 400 of the main evaporator 115 drops until it reaches the temperature 405 of the reservoir 155 at time 410. Power Qin 460 is applied to the main evaporator 115 at a time 462, when the system 100 is operating in LHP mode (step 340). As shown, power input Qin 460 to the main evaporator 115 is held relatively low while the main evaporator 115 is cooling down. Also shown are the temperatures 470 and 475, respectively, of the secondary fluid line 160 and the liquid line 125. After time 410, temperatures 470 and 475 track the temperature 400 of the main evaporator 115. Moreover, a temperature 415 of the secondary evaporator 150 follows closely with the temperature 405 of the reservoir 155 because of the thermal communication between the secondary evaporator 150 and the reservoir 155.

As mentioned, in one implementation, ethane may be used as the fluid in the heat transfer system 105. Although the critical temperature of ethane is 33° C., for the reasons generally described above, the system 100 can start up from a supercritical state in which the system 100 is at a temperature of 70° C. As power Qsp is applied to the secondary evaporator 150, the temperatures of the condenser 120 and the reservoir 155 drop rapidly (between times 452 and 410). A trim heater can be used to control the temperature of the reservoir 155 and thus the condenser 120 to −10° C. To startup the main evaporator 115 from the supercritical temperature of 70° C., a heat load or power input Qsp of 10 W is applied to the secondary evaporator 150. Once the main evaporator 115 is primed, the power input from the heat source Qsp 151 to the secondary evaporator 150 and the power applied to and through the trim heater both may be reduced to bring the temperature of the system 100 down to a nominal operating temperature of about −50° C. For instance, during the main mode, if a power input Qin of 40 W is applied to the main evaporator 115, the power input Qsp to the secondary evaporator 150 can be reduced to approximately 3 W while operating at −45° C. to mitigate the 3 W lost through heat conditions (as discussed above).

As another example, the main evaporator 115 can operate with power input Qin from about 10 W to about 40 W with 5 W applied to the secondary evaporator 150 and with the temperature 405 of the reservoir 155 at approximately −45° C.

Figure 5A:
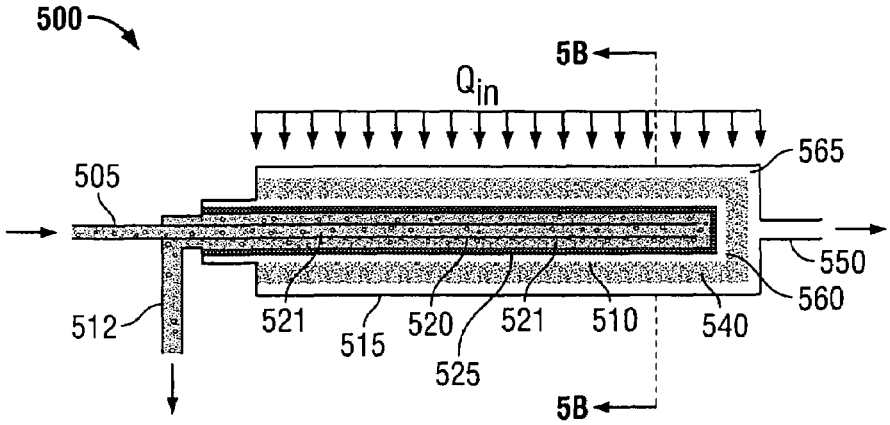
FIG. 5A is a diagram of a three-port main evaporator shown within the heat transport system of FIG. 1.
Figure 5B:
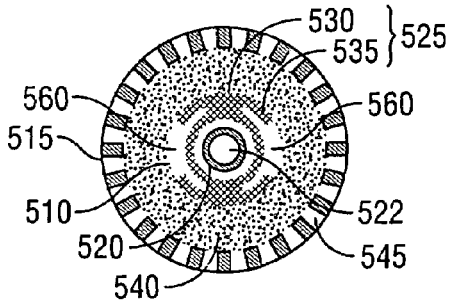
FIG. 5B is a cross-sectional view of the main evaporator taken along 5B—5B of FIG. 5A.

Referring to FIGS. 5A and 5B, in one implementation, the main evaporator 115 is designed as a three-port evaporator 500 (which is the design shown in FIG. 1). Generally, in the three-port evaporator 500, liquid flows into a liquid inlet 505 into a core 510, defined by a primary wick 540, and fluid from the core 510 flows from a fluid outlet 512 to a cold-biased reservoir (such as reservoir 155). The fluid and the core 510 are housed within a container 515 made of, for example, aluminum. In particular, fluid flowing from the liquid inlet 505 into the core 510 flows through a bayonet tube 520, into a liquid passage 521 that flows through and around the bayonet tube 520. Fluid can flow through a secondary wick 525 (such as secondary wick 145 of evaporator 115) made of a wick material 530 and an annular artery 535. The wick material 530 separates the annular artery 535 from a first vapor passage 560. As power from the heat source Qin 116 is applied to the evaporator 500, liquid from the core 510 enters a primary wick 540 and evaporates, forming vapor that is free to flow along a second vapor passage 565 that includes one or more vapor grooves 545 and out a vapor outlet 550 into the vapor line 130. Vapor bubbles that form within first vapor passage 560 of the core 510 are swept out of the core 510 through the first vapor passage 560 and into the fluid outlet 512. As discussed above, vapor bubbles within the first vapor passage 560 may pass through the secondary wick 525 if the pore size of the secondary wick 525 is large enough to accommodate the vapor bubbles. Alternatively, or additionally, vapor bubbles within the first vapor passage 560 may pass through an opening of the secondary wick 525 formed at any suitable location along the secondary wick 525 to enter the liquid passage 521 or the fluid outlet 512.

Figure 6:
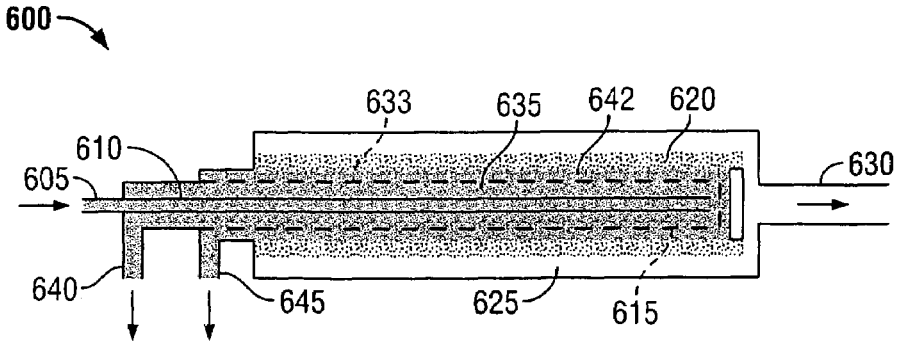
FIG. 6 is a diagram of a four-port main evaporator that can be integrated into a heat transport system illustrated by FIG. 1.

Referring to FIG. 6, in another implementation, the main evaporator 115 is designed as a four-port evaporator 600, which is a design described in U.S. application Ser. No. 09/896,561, filed Jun. 29, 2001. Briefly, and with emphasis on aspects that differ from the three-port evaporator configuration, liquid flows into the evaporator 600 through a fluid inlet 605, through a bayonet 610, and into a core 615. The liquid within the core 615 enters a primary wick 620 and evaporates, forming vapor that is free to flow along vapor grooves 625 and out a vapor outlet 630 into the vapor line 130. A secondary wick 633 within the core 615 separates liquid within the core from vapor or bubbles in the core (that are produced when liquid in the core 615 heats). The liquid carrying bubbles formed within a first fluid passage 635 inside the secondary wick 633 flows out of a fluid outlet 640 and the vapor or bubbles formed within a vapor passage 642 positioned between the secondary wick 633 and the primary wick 620 flow out of a vapor outlet 645.

Figure 7:
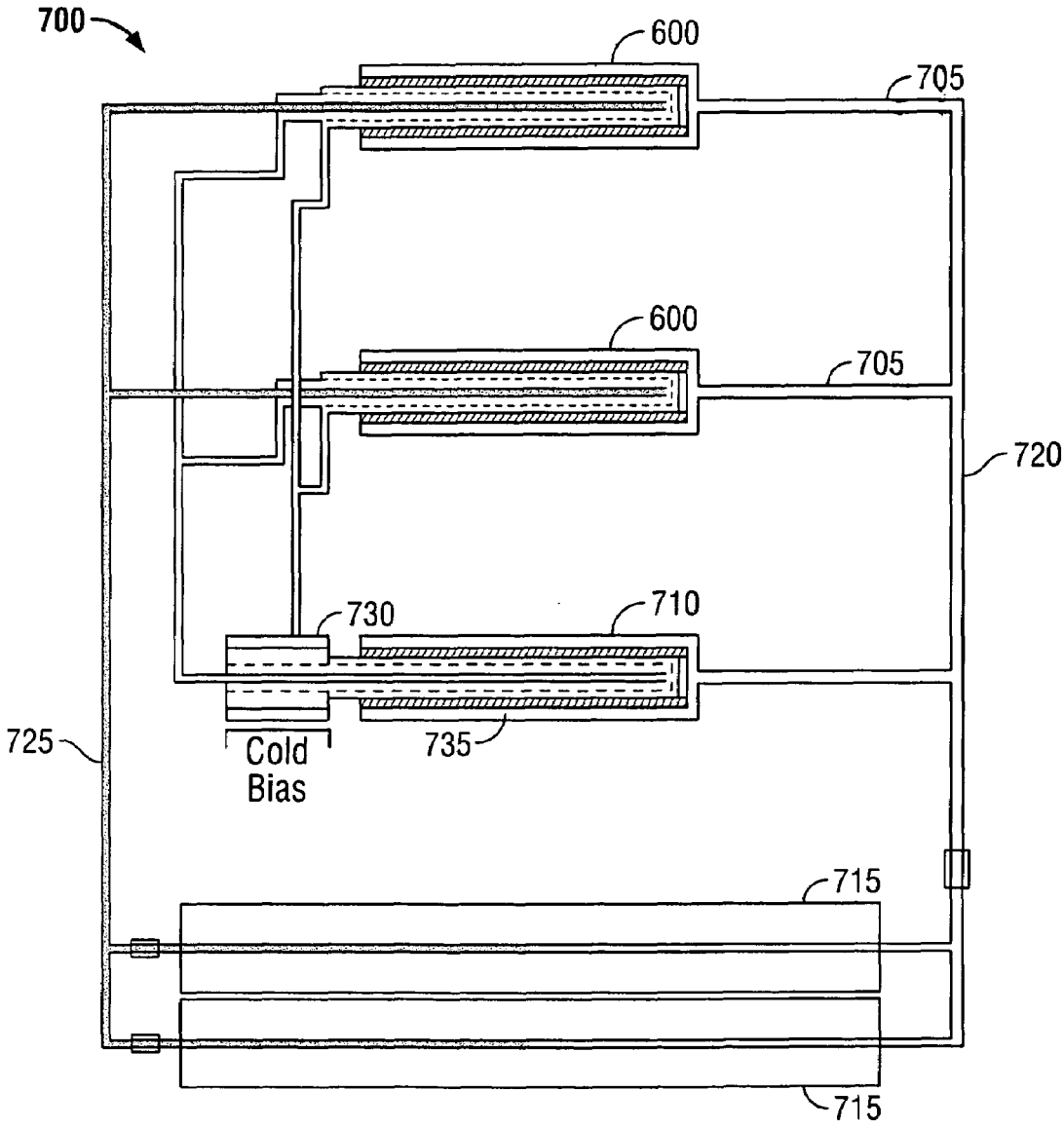
FIG. 7 is a schematic diagram of an implementation of a heat transport system.

Referring also to FIG. 7, a heat transport system 700 is shown in which the main evaporator is a four-port evaporator 600. The system 700 includes one or more heat transfer systems 705 and a priming system 710 configured to convert fluid within the heat transfer systems 705 into a liquid to prime the heat transfer systems 705. The four-port evaporators 600 are coupled to one or more condensers 715 by a vapor line 720 and a fluid line 725. The priming system 710 includes a cold-biased reservoir 730 hydraulically and thermally connected to a priming evaporator 735.

Design considerations of the heat transport system 100 include startup of the main evaporator 115 from a supercritical state, management of parasitic heat leaks, heat conduction across the primary wick 140, cold biasing of the cold reservoir 155, and pressure containment at ambient temperatures that are greater than the critical temperature of the working fluid within the heat transfer system 105. To accommodate these design considerations, the body or container (such as container 515) of the evaporator 115 or 150 can be made of extruded 6063 aluminum and the primary wicks 140 and/or 190 can be made of a fine-pored wick. In one implementation, the outer diameter of the evaporator 115 or 150 is approximately 0.625 inches and the length of the container is approximately 6 inches. The reservoir 155 may be cold-biased to an end panel of the radiator 165 using the aluminum shunt 170. Furthermore, a heater (such as a kapton heater) can be attached at a side of the reservoir 155.

In one implementation, the vapor line 130 is made with smooth walled stainless steel tubing having an outer diameter (OD) of 3/16" and the liquid line 125 and the secondary fluid line 160 are made of smooth walled stainless steel tubing having an OD of 1/8". The lines 125, 130, 160 may be bent in a serpentine route and plated with gold to minimize parasitic heat gains. Additionally, the lines 125, 130, 160 may be enclosed in a stainless steel box with heaters to simulate a particular environment during testing. The stainless steel box can be insulated with multi-layer insulation (MLI) to minimize heat leaks through panels of the heat sink 165.

In one implementation, the condenser 122 and the secondary fluid line 160 are made of tubing having an OD of 0.25 inches. The tubing is bonded to the panels of the heat sink 165 using, for example, epoxy. Each panel of the heat sink 165 is an 8×19 inch direct condensation, aluminum radiator that uses a 1/16-inch thick face sheet. Kapton heaters can be attached to the panels of the heat sink 165, near the condenser 120 to prevent inadvertent freezing of the working fluid. During operation, temperature sensors such as thermocouples can be used to monitor temperatures throughout the system 100.

The heat transport system 100 may be implemented in any circumstances where the critical temperature of the working fluid of the heat transfer system 105 is below the ambient temperature at which the system 100 is operating. The heat transport system 100 can be used to cool down components that require cryogenic cooling.

Referring to FIGS. 8A–8D, the heat transport system 100 may be implemented in a miniaturized cryogenic system 800. In the miniaturized system 800, the lines 125, 130, 160 are made of flexible material to permit coil configurations 805, which save space. The miniaturized system 800 can operate at −238° C. using neon fluid. Power input Qin 116 is approximately 0.3 to 2.5 W. The miniaturized system 800 thermally couples a cryogenic component (or heat source that requires cryogenic cooling) 816 to a cryogenic cooling source such as a cryocooler 810 coupled to cool the condensers 120, 122.

The miniaturized system 800 reduces mass, increases flexibility, and provides thermal switching capability when compared with traditional thermally-switchable, vibration-isolated systems. Traditional thermally-switchable, vibration-isolated systems require two flexible conductive links (FCLs), a cryogenic thermal switch (CTSW), and a conduction bar (CB) that form a loop to transfer heat from the cryogenic component to the cryogenic cooling source. In the miniaturized system 800, thermal performance is enhanced because the number of mechanical interfaces is reduced. Heat conditions at mechanical interfaces account for a large percentage of heat gains within traditional thermally-switchable, vibration-isolated systems. The CB and two FCLs are replaced with the low-mass, flexible, thin-walled tubing used for the coil configurations 805 of the miniaturized system 800.

Moreover, the miniaturized system 800 can function of a wide range of heat transport distances, which permits a configuration in which the cooling source (such as the cryocooler 810) is located remotely from the cryogenic component 816. The coil configurations 805 have a low mass and low surface area, thus reducing parasitic heat gains through the lines 125 and 160. The configuration of the cooling source 810 within miniaturized system 800 facilitates integration and packaging of the system 800 and reduces vibrations on the cooling source 810, which becomes particularly important in infrared sensor applications. In one implementation, the miniaturized system 800 was tested using neon, operating at 25–40K.

Figure 9A:
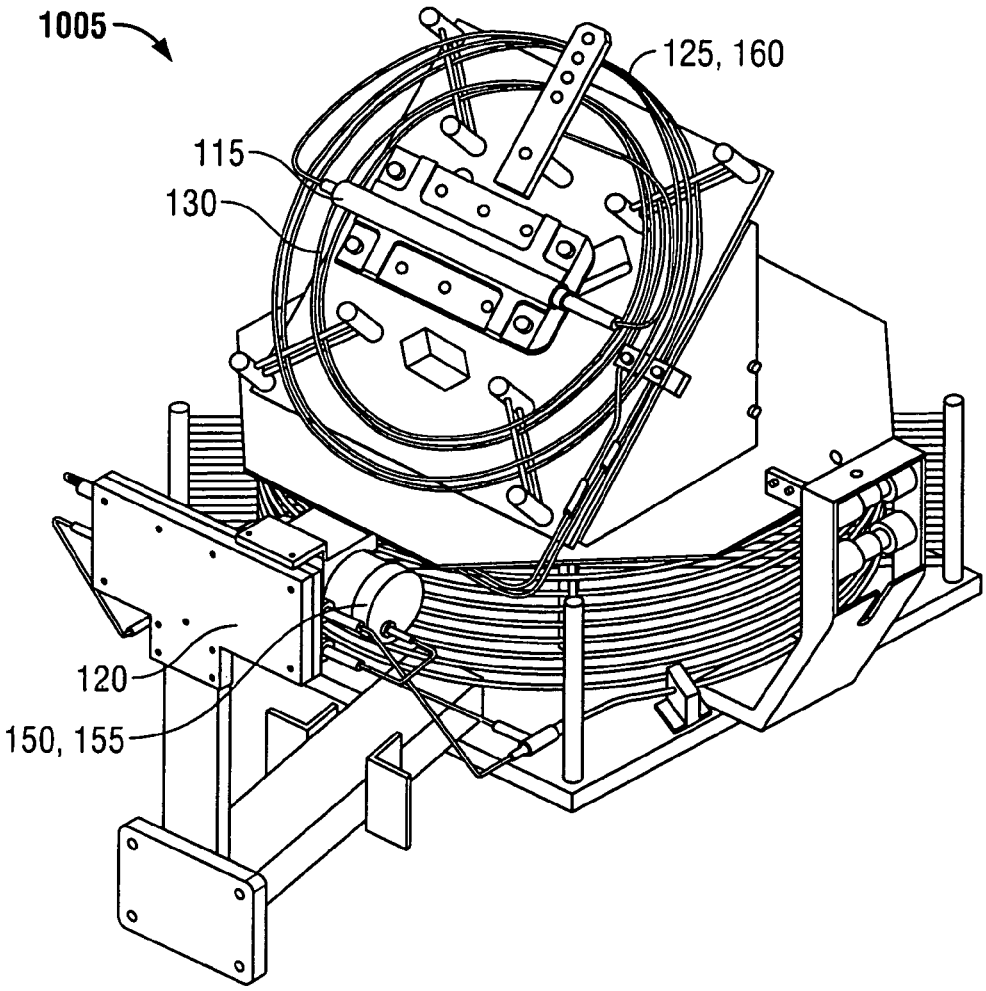
Figure 9B:
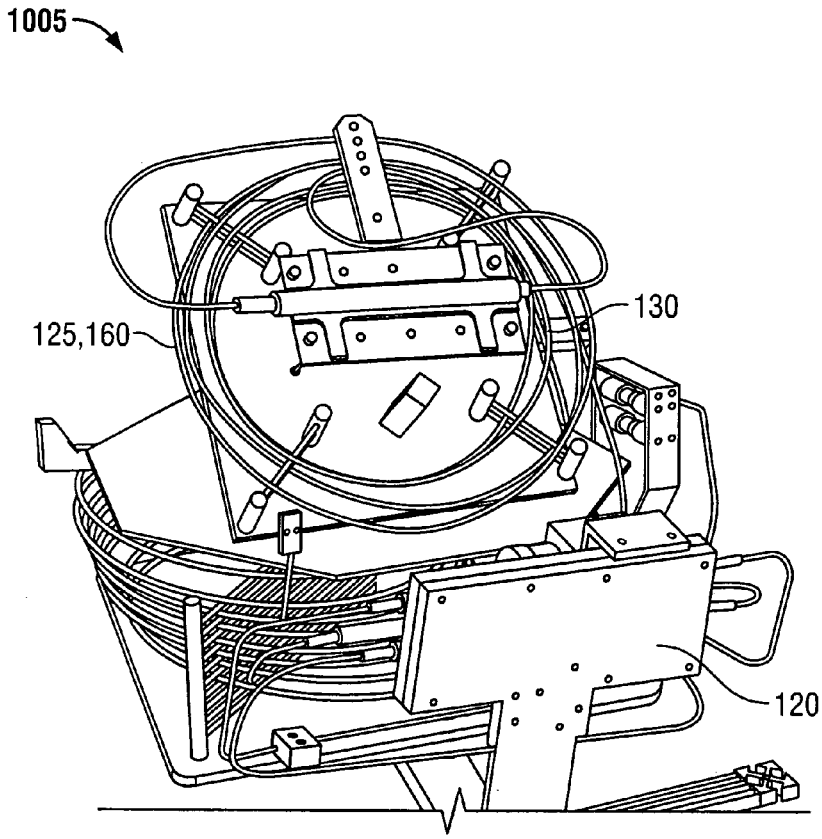
Figure 9C:
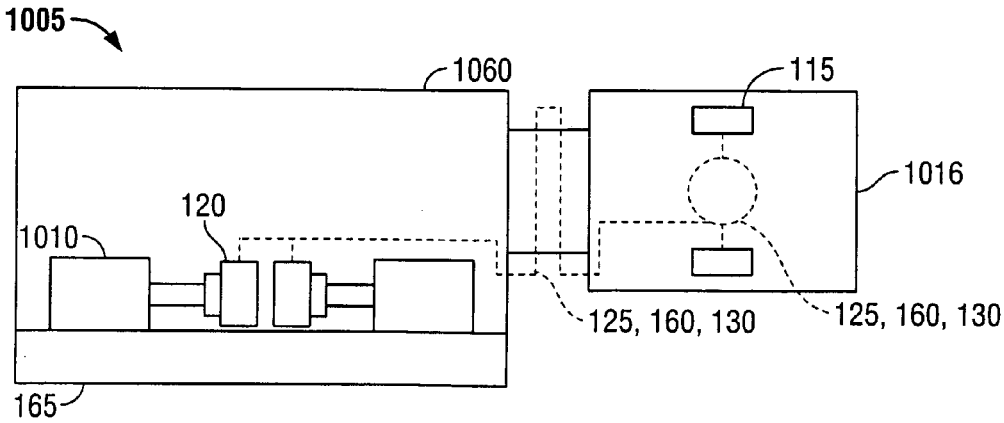

Referring to FIGS. 9A–9C, the heat transport system 100 may be implemented in an adjustable mounted or Gimbaled system 1005 in which the main evaporator 115 and a portion of the lines 125, 160, and 130 are mounted to rotate about an elevation axis 1020 within a range of ±45° and a portion of the lines 125, 160, and 130 are mounted to rotate about an azimuth axis 1025 within a range of ±220°. The lines 125, 160, 130 are formed from thin-walled tubing and are coiled around each axis of rotation. The system 1005 thermally couples a cryogenic component (or heat source that requires cryogenic cooling) 1016 such as a sensor of a cryogenic telescope to a cryogenic cooling source such as a cryocooler 1010 coupled to cool the condensers 120, 122. The cooling source 1010 is located at a stationary spacecraft 1060, thus reducing mass at the cryogenic telescope. Motor torque for controlling rotation of the lines 125, 160, 130, power requirements of the system 1005, control requirements for the spacecraft 1060, and pointing accuracy for the sensor 1016 are improved. The cryocooler 1010 and the radiator or heat sink 165 can be moved from the sensor 1016, reducing vibration within the sensor 1016. In one implementation, the system 1005 was tested to operate within the range of 70–115K when the working fluid is nitrogen.

The heat transfer system 105 may be used in medical applications, or in applications where equipment must be cooled to below-ambient temperatures. As another example, the heat transfer system 105 may be used to cool an infrared (IR) sensor, which operates at cryogenic temperatures to reduce ambient noise. The heat transfer system 105 may be used to cool a vending machine, which often houses items that preferably are chilled to sub-ambient temperatures. The heat transfer system 105 may be used to cool components such as a display or a hard drive of a computer, such as a laptop computer, handheld computer, or a desktop computer. The heat transfer system 105 can be used to cool one or more components in a transportation device such as an automobile or an airplane.

Other implementations are within the scope of the following claims. For example, the condenser 120 and heat sink 165 can be designed as an integral system, such as, for example, a radiator. Similarly, the secondary condenser 122 and heat sink 165 can be formed from a radiator. The heat sink 165 can be a passive heat sink (such as a radiator) or a cryocooler that actively cools the condensers 120, 122.

In another implementation, the temperature of the reservoir 155 is controlled using a heater. In a further implementation, the reservoir 155 is heated using parasitic heat.

In another implementation, a coaxial ring of insulation is formed and placed between the liquid line 125 and the secondary fluid line 160, which surrounds the insulation ring.

Evaporator Design

Evaporators are integral components in two-phase heat transfer systems. For example, as shown above in FIGS. 5A and 5B, the evaporator 500 includes an evaporator body or container 515 that is in contact with the primary wick 540 that surrounds the core 510. The core 510 defines a flow passage for the working fluid. The primary wick 540 is surrounded at its periphery by a plurality of peripheral flow channels or vapor grooves 545. The channels 545 collect vapor at the interface between the wick 540 and the evaporator body 515. The channels 545 are in contact with the vapor outlet 550 that feeds into the vapor line that feeds into the condenser to enable evacuation of the vapor formed within the evaporator 115.

The evaporator 500 and the other evaporators discussed above often have a cylindrical geometry, that is, the core of the evaporator forms a cylindrical passage through which the working fluid passes. The cylindrical geometry of the evaporator is useful for cooling applications in which the heat acquisition surface is cylindrically hollow. Many cooling applications require that heat be transferred away from a heat source having a flat surface. In these sort of applications, the evaporator can be modified to include a flat conductive saddle to match the footprint of the heat source having the flat surface. Such a design is shown, for example, in U.S. Pat. No. 6,382,309.

The cylindrical geometry of the evaporator facilitates compliance with thermodynamic constraints of LHP operation (that is, the minimization of heat leaks into the reservoir). The constraints of LHP operation stem from the amount of subcooling an LHP needs to produce for normal equilibrium operation. Additionally, the cylindrical geometry of the evaporator is relatively easy to fabricate, handle, machine, and process.

However, as will be described hereinafter, an evaporator can be designed with a planar form to more naturally attach to a flat heat source.

Planar Design

Figure 10:
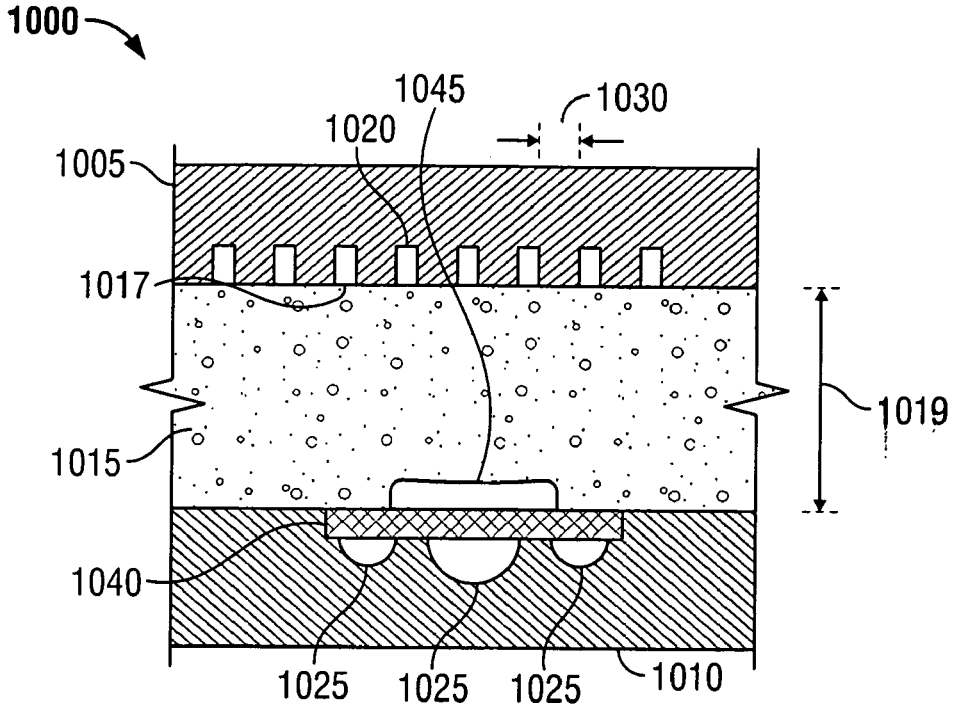
FIG. 10 is a cross-sectional view of a planar evaporator.
Figure 11:
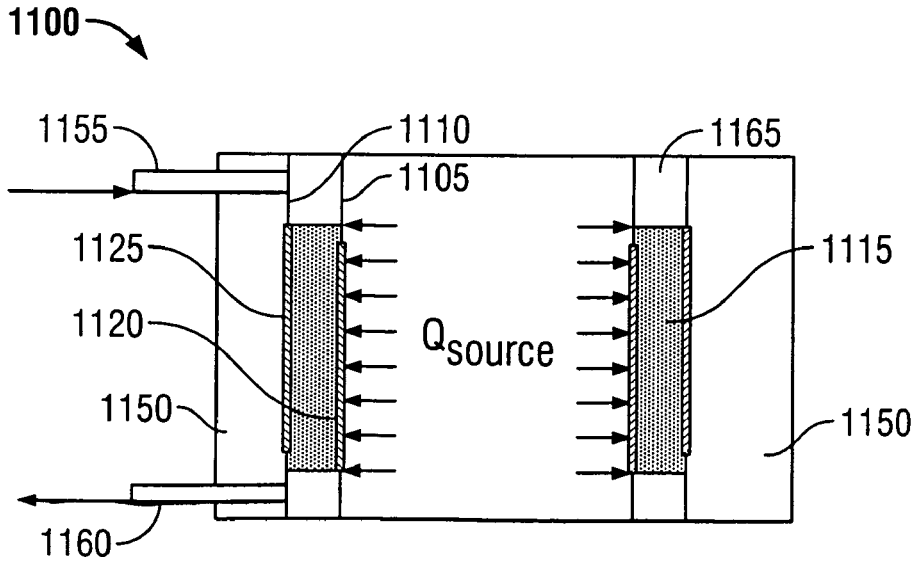
FIG. 11 is an axial cross-sectional view of an annular evaporator.

Referring to FIG. 10, an evaporator 1000 for a heat transfer system includes a vapor barrier wall 1005, a liquid barrier wall 1010, a primary wick 1015 between the vapor barrier wall and the inner side of the liquid barrier wall 1010, vapor removal channels 1020, and liquid flow channels 1025.

The vapor barrier wall 1005 is in intimate contact with the primary wick 1015. The liquid barrier wall 1010 contains working fluid on an inner side of the liquid barrier wall 1010 such that the working fluid flows only along the inner side of the liquid barrier wall 1010. The liquid barrier wall 1010 closes the evaporator's envelope and helps to organize and distribute the working fluid through the liquid flow channels 1025. The vapor removal channels 1020 are located at an interface between a vaporization surface 1017 of the primary wick 1015 and the vapor barrier wall 1005. The liquid flow channels 1025 are located between the liquid barrier wall 1010 and the primary wick 1015.

The vapor barrier wall 1005 acts as a heat acquisition surface for a heat source. The vapor barrier wall 1005 is made from a heat-conductive material, such as, for example, sheet metal. Material chosen for the vapor barrier wall 1005 typically is able to withstand internal pressure of the working fluid.

The vapor removal channels 1020 are designed to balance the hydraulic resistance of the channels 1020 with the heat conduction through the vapor barrier wall 1005 into the primary wick 1015. The channels 1020 can be electro-etched, machined, or formed in a surface with any other convenient method.

The vapor removal channels 1020 are shown as grooves in the inner side of the vapor barrier wall 1005. However, the vapor removal channels can be designed and located in several different ways, depending on the design approach chosen. For example, according to other implementations, the vapor removal channels 1020 are grooved into the outer surface of the primary wick 1015 or embedded into the primary wick 1015 such that they are under the surface of the primary wick. The design of the vapor removal channels 1020 is selected to increase the ease and convenience of manufacturing and to closely approximate one or more of the following guidelines.

First, the hydraulic diameter of the vapor removal channels 1020 should be sufficient to handle a vapor flow generated on the vaporization surface 1017 of the primary wick 1015 without a significant pressure drop. Second, the surface of contact between the vapor barrier wall 1005 and the primary wick 1015 should be maximized to provide efficient heat transfer from the heat source to vaporization surface of the primary wick 1015. Third, a thickness 1030 of the vapor barrier wall 1005, which is in contact with the primary wick 1015, should be minimized. As the thickness 1030 increases, vaporization at the surface of the primary wick 1015 is reduced and transport of vapor through the vapor removal channels 1020 is reduced.

The evaporator 1000 can be assembled from separate parts. Alternatively, the evaporator 1000 can be made as a single part by in-situ sintering of the primary wick 1015 between two walls having special mandrels to form channels on both sides of the wick.

The primary wick 1015 provides the vaporization surface 1017 and pumps or feeds the working fluid from the liquid flow channels 1025 to the vaporization surface of the primary wick 1015.

The size and design of the primary wick 1015 involves several considerations. The thermal conductivity of the primary wick 1015 should be low enough to reduce heat leak from the vaporization surface 1017, through the primary wick 1015, and to the liquid flow channels 1025. Heat leakage can also be affected by the linear dimensions of the primary wick 1015. For this reason, the linear dimensions of the primary wick 1015 should be properly optimized to reduce heat leakage. For example, an increase in a thickness 1019 of the primary wick 1015 can reduce heat leakage. However, increased thickness 1019 can increase hydraulic resistance of the primary wick 1015 to the flow of the working fluid. In working LHP designs, hydraulic resistance of the working fluid due to the primary wick 1015 can be significant and a proper balancing of these factors is important.

The force that drives or pumps the working fluid of a heat transfer system is a temperature or pressure difference between the vapor and liquid sides of the primary wick. The pressure difference is supported by the primary wick and it is maintained by proper management of the incoming working fluid thermal balance.

The liquid returning to the evaporator from the condenser passes through a liquid return line and is slightly subcooled. The degree of subcooling offsets the heat leak through the primary wick and the heat leak from the ambient into the reservoir within the liquid return line. The subcooling of the liquid maintains a thermal balance of the reservoir. However, there exist other useful methods to maintain thermal balance of the reservoir.

One method is an organized heat exchange between reservoir and the environment. For evaporators having a planar design, such as those often used for terrestrial applications, the heat transfer system includes heat exchange fins on the reservoir and/or on the liquid barrier wall 1010 of the evaporator 1000. The forces of natural convection on these fins provide subcooling and reduce stress on the condenser and the reservoir of the heat transfer system.

The temperature of the reservoir or the temperature difference between the reservoir and the vaporization surface 1017 of the primary wick 1015 supports the circulation of the working fluid through the heat transfer system. Some heat transfer systems may require an additional amount of subcooling. The required amount may be greater than what the condenser can produce, even if the condenser is completely blocked.

In designing the evaporator 1000, three variables need to be managed. First, the organization and design of the liquid flow channels 1025 needs to be determined. Second, the venting of the vapor from the liquid flow channels 1025 needs to be accounted for. Third, the evaporator 1000 should be designed to ensure that liquid fills the liquid flow channels 1025. These three variables are interrelated and thus should be considered and optimized together to form an effective heat transfer system.

As mentioned, it is important to obtain a proper balance between the heat leak into the liquid side of the evaporator and the pumping capabilities of the primary wick. This balancing process cannot be done independently from the optimization of the condenser, which provides subcooling, because the greater heat leak allowed in the design of the evaporator, the more subcooling needs to be produced in the condenser. The longer the condenser, the greater are the hydraulic losses in a fluid lines, which may require different wick material with better pumping capabilities.

In operation, as power from a heat source is applied to the evaporator 1000, liquid from the liquid flow channels 1025 enters the primary wick 1015 and evaporates, forming vapor that is free to flow along the vapor removal channels 1020. Liquid flow into the evaporator 1000 is provided by the liquid flow channels 1025. The liquid flow channels 1025 supply the primary wick 1015 with the enough liquid to replace liquid that is vaporized on the vapor side of the primary wick 1015 and to replace liquid that is vaporized on the liquid side of the primary wick 1015.

The evaporator 1000 may include a secondary wick 1040, which provides phase management on a liquid side of the evaporator 1000 and supports feeding of the primary wick 1015 in critical modes of operation (as discussed above). The secondary wick 1040 is formed between the liquid flow channels 1025 and the primary wick 1015. The secondary wick can be a mesh screen (as shown in the FIG. 10), or an advanced and complicated artery, or a slab wick structure. Additionally, the evaporator 1000 may include a vapor vent channel 1045 at an interface between the primary wick 1015 and the secondary wick 1040.

Heat conduction through the primary wick 1015 may initiate vaporization of the working fluid in a wrong place—on a liquid side of the evaporator 1000 near or within the liquid flow channels 1025. The vapor vent channel 1045 delivers the unwanted vapor away from the wick into the two-phase reservoir.

The fine pore structure of the primary wick 1015 can create a significant flow resistance for the liquid. Therefore, it is important to optimize the number, the geometry, and the design of the liquid flow channels 1025. The goal of this optimization is to support a uniform, or close to uniform, feeding flow to the vaporization surface 1017. Moreover, as the thickness 1019 of the primary wick 1015 is reduced, the liquid flow channels 1025 can be space farther apart.

The evaporator 1000 may require significant vapor pressure to operate with a particular working fluid within the evaporator 1000. Use of a working fluid with a high vapor pressure can cause several problems with pressure containment of the evaporator envelope. Traditional solutions to the pressure containment problem, such as thickening the walls of the evaporator, are not always effective. For example, in planar evaporators having a significant flat area, the walls become so thick that the temperature difference is increased and the evaporator heat conductance is degraded. Additionally, even microscopic deflection of the walls due to the pressure containment results in a loss of contact between the walls and the primary wick. Such a loss of contact impacts heat transfer through the evaporator. And, microscopic deflection of the walls creates difficulties with the interfaces between the evaporator and the heat source and any external cooling equipment.

Annular Design

Referring to FIGS. 10–13, an annular evaporator 1100 is formed by effectively rolling the planar evaporator 1000 such that the primary wick 1015 loops back into itself and forms an annular shape. The evaporator 1100 can be used in applications in which the heat sources have a cylindrical exterior profile, or in applications where the heat source can be shaped as a cylinder. The annular shape combines the strength of a cylinder for pressure containment and the curved interface surface for best possible contact with the cylindrically-shaped heat sources.

The evaporator 1100 includes a vapor barrier wall 1105, a liquid barrier wall 1110, a primary wick 1115 positioned between the vapor barrier wall 1105 and the inner side of the liquid barrier wall 1110, vapor removal channels 1120, and liquid flow channels 1125. The liquid barrier wall 1110 is coaxial with the primary wick 1115 and the vapor barrier wall 1105.

The vapor barrier wall 1105 intimately contacts the primary wick 1115. The liquid barrier wall 1110 contains working fluid on an inner side of the liquid barrier wall 1110 such that the working fluid flows only along the inner side of the liquid barrier wall 1110. The liquid barrier wall 1110 closes the evaporator's envelope and helps to organize and distribute the working fluid through the liquid flow channels 1125.

The vapor removal channels 1120 are located at an interface between a vaporization surface 1117 of the primary wick 1115 and the vapor barrier wall 1105. The liquid flow channels 1125 are located between the liquid barrier wall 1110 and the primary wick 1115. The vapor barrier wall 1105 acts a heat acquisition surface and the vapor generated on this surface is removed by the vapor removal channels 1120.

The primary wick 1115 fills the volume between the vapor barrier wall 1105 and the liquid barrier wall 1110 of the evaporator 1100 to provide reliable reverse menisci vaporization.

The evaporator 1100 can also be equipped with heat exchange fins 1150 that contact the liquid barrier wall 1110 to cold bias the liquid barrier wall 1110. The liquid flow channels 1125 receive liquid from a liquid inlet 1155 and the vapor removal channels 1120 extend to and provide vapor to a vapor outlet 1160.

The evaporator 1100 can be used in a heat transfer system that includes an annular reservoir 1165 adjacent the primary wick 1115. The reservoir 1165 may be cold biased with the heat exchange fins 1150, which extend across the reservoir 1165. The cold biasing of the reservoir 1165 permits utilization of the entire condenser area without the need to generate subcooling at the condenser. The excessive cooling provided by cold biasing the reservoir 1165 and the evaporator 1100 compensates the parasitic heat leaks through the primary wick 1115 into the liquid side of the evaporator 1100.

In another implementation, the evaporator design can be inverted and vaporization features can be placed on an outer perimeter and the liquid return features can be placed on the inner perimeter.

The annular shape of the evaporator 1100 may provide one or more of the following or additional advantages. First, problems with pressure containment may be reduced or eliminated in the annular evaporator 1100. Second, the primary wick 1115 may not need to be sintered inside, thus providing more space for a more sophisticated design of the vapor and liquid sides of the primary wick 1115.

Figure 14A:
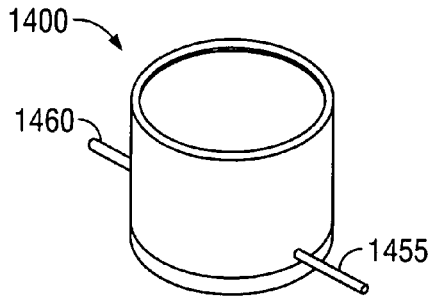
FIG. 14A is a perspective view of the annular evaporator of FIG. 11.
Figure 14B:
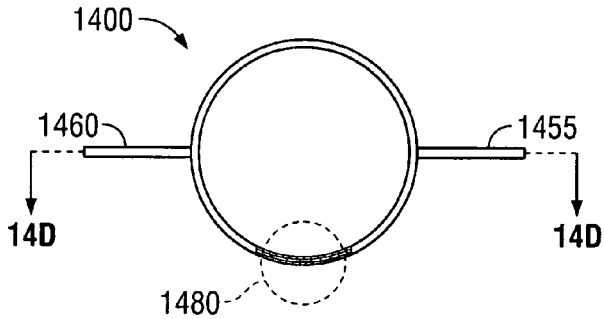
FIG. 14B is a top and partial cutaway view of the annular evaporator of FIG. 14A.
Figure 14C:
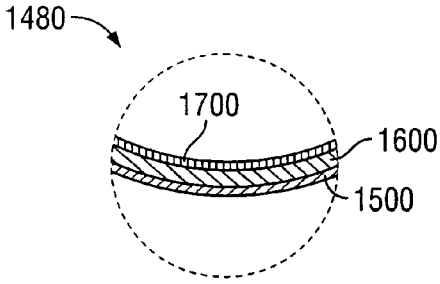
FIG. 14C is an enlarged cross-sectional view of a portion of the annular evaporator of FIG. 14B.
Figure 14D:
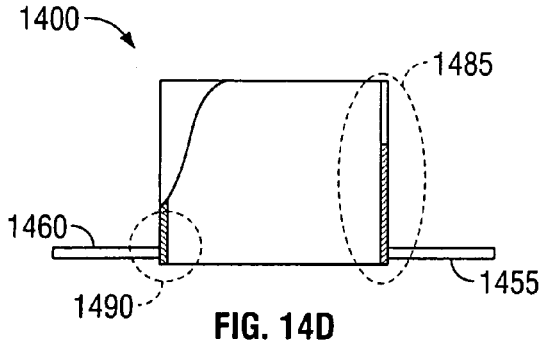
FIG. 14D is a cross-sectional view of the annular evaporator of FIG. 14B taken along line 14D—14D.
Figure 14E:
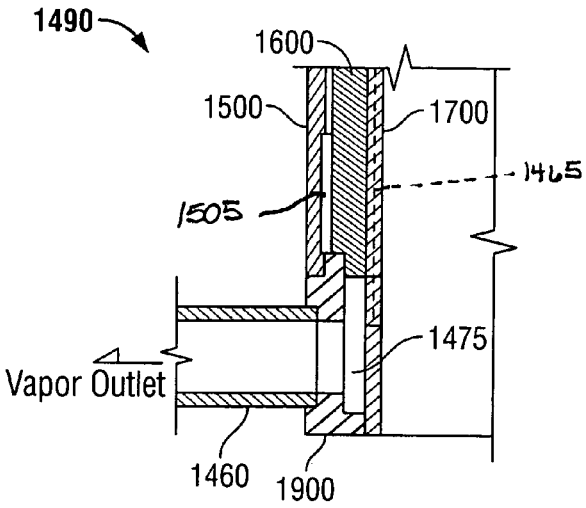
FIGS. 14E and 14F are enlarged views of portions of the annular evaporator of FIG. 14D.
Figure 14F:
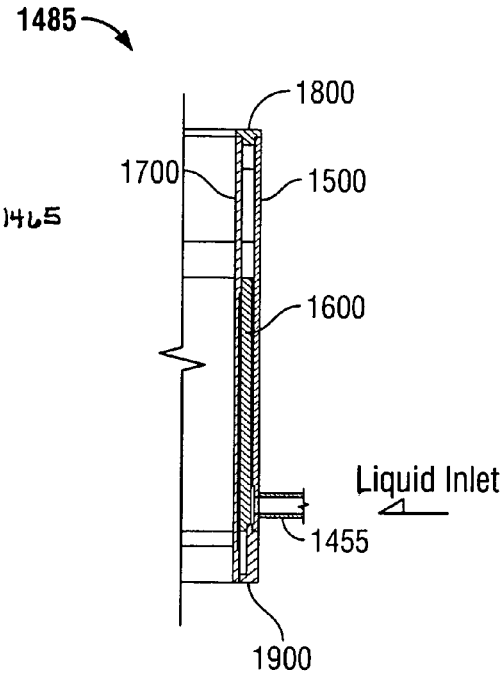
Figure 14G:
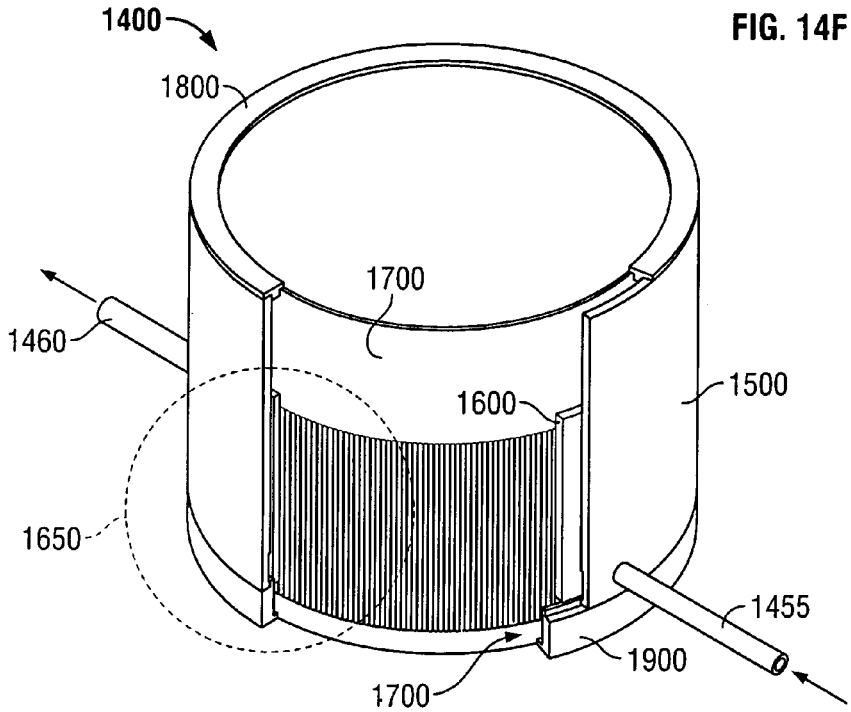
FIG. 14G is a perspective cut-away view of the annular evaporator of FIG. 14A.
Figure 14H:
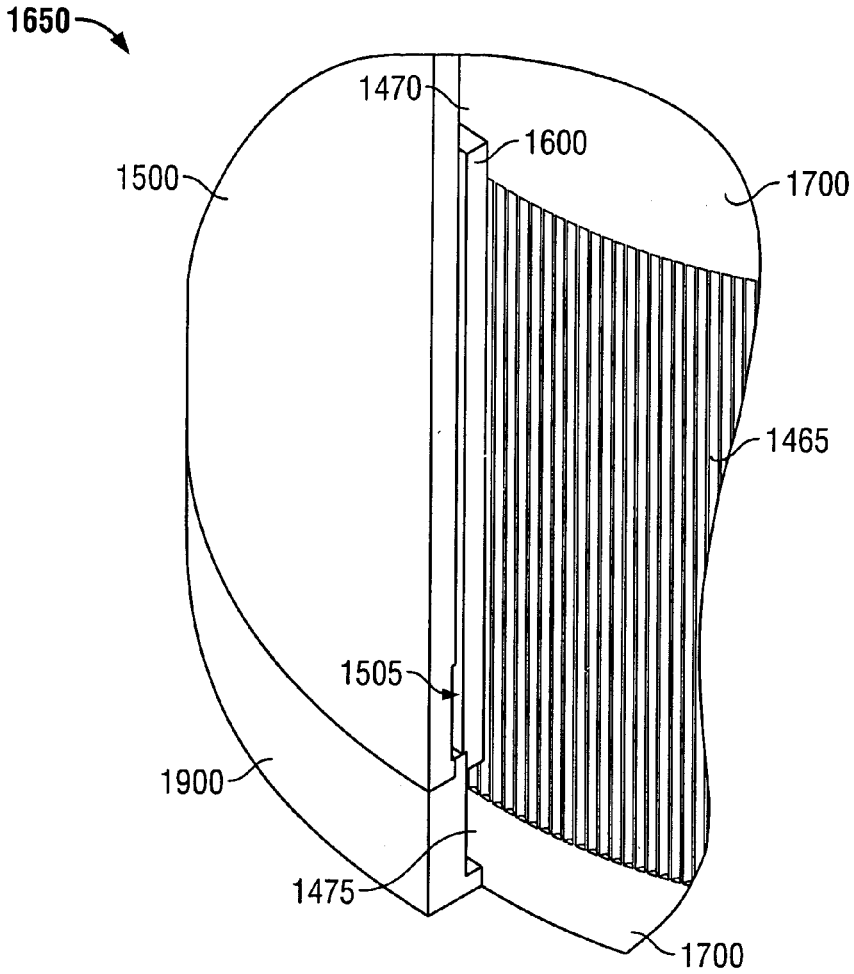
FIG. 14H is a detail perspective cut-away view of the annular evaporator of FIG. 14G.

Referring also to FIGS. 14A–H, an annular evaporator 1400 is shown having a liquid inlet 1455 and a vapor outlet 1460. The annular evaporator 1400 includes a vapor barrier wall 1700 (FIGS. 14G, 14H, and 17A–D), a liquid barrier wall 1500 (FIGS. 14G, 14H, and 17A–17D), a primary wick 1600 (FIGS. 14G, 14H, and 16A–D) positioned between the vapor barrier wall 1700 and the inner side of the liquid barrier wall 1500, vapor removal channels 1465 (FIGS. 14H, 15A, 15B), and liquid flow channels 1505 (FIG. 14H). The annular evaporator 1400 also includes a ring 1800 (FIGS. 14G and 18A–D) that ensures spacing between the vapor barrier wall 1700 and the liquid barrier wall 1500 and a ring 1900 (FIGS. 14G, 14H, and 19A–D) at a base of the evaporator 1400 that provides support for the liquid barrier wall 1500 and the primary wick 1600. The vapor barrier wall 1700, the liquid barrier wall 1500, the ring 1800, the ring 1900, and the wick 1600 are preferably formed of stainless steel.

The upper portion of the evaporator 1400 (that is, above the wick 1600) includes an expansion volume 1470 (FIG. 14H). The liquid flow channels 1505, which are formed in the liquid barrier wall 1500, are fed by the liquid inlet 1455. The wick 1600 separates the liquid flow channels 1505 from the vapor removal channels 1465 that lead to the vapor outlet 1460 through a vapor annulus 1475 (FIG. 14H) formed in the ring 1900. The vapor channels 1465 may be photo-etched into the surface of the vapor barrier wall 1700, as discussed below in greater detail.

The evaporators disclosed herein can operate in any combination of materials, dimensions and arrangements, so long as they embody the features as described above. There are no restrictions other than criteria mentioned here; the evaporator can be made of any shape size and material. The only design constraints are that the applicable materials be compatible with each other and that the working fluid be selected in consideration of structural constraints, corrosion, generation of noncondensable gases, and lifetime issues.

Many terrestrial applications can incorporate an LHP with an annular evaporator 1100. The orientation of the annular evaporator in a gravity field is predetermined by the nature of application and the shape of the hot surface.

Cyclical Heat Exchange System

Cyclical heat exchange systems may be configured with one or more heat transfer systems to control a temperature at a region of the heat exchange system. The cyclical heat exchange system may be any system that operates using a thermodynamic cycle, such as, for example, a cyclical heat exchange system, a Stirling heat exchange system (also known as a Stirling engine), or an air conditioning system.

Figure 20:
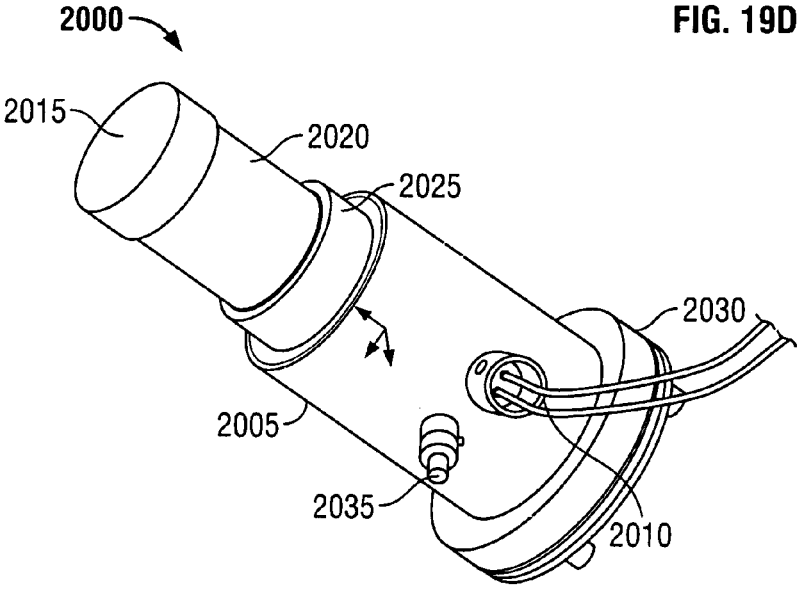
FIG. 20 is a perspective view of a cyclical heat exchange system that can be cooled using a heat transfer system.

Referring to FIG. 20, a Stirling heat exchange system 2000 utilizes a known type of environmentally friendly and efficient refrigeration cycle. The Stirling system 2000 functions by directing a working fluid (for example, helium) through four repetitive operations; that is, a heat addition operation at constant temperature, a constant volume heat rejection operation, a constant temperature heat rejection operation and a heat addition operation at constant volume.

Figure 21:
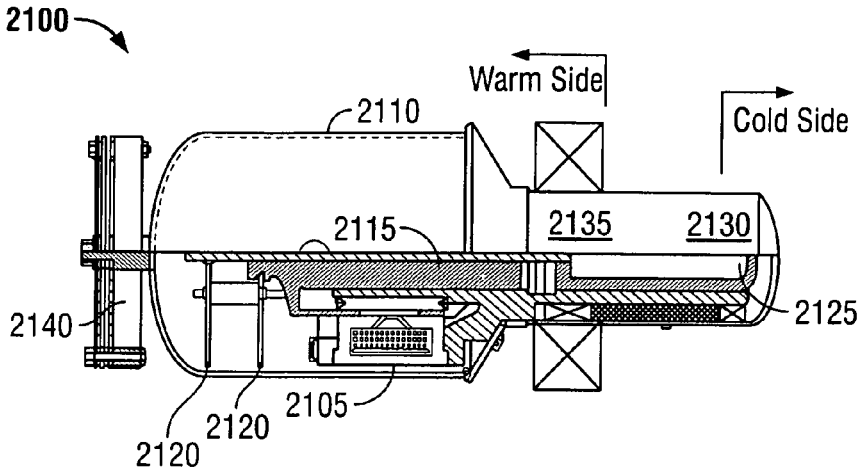
FIG. 21 is a cross-sectional view of a cyclical heat exchange system such as the cyclical heat exchange system of FIG. 20.

The Stirling system 2000 is designed as a Free Piston Stirling Cooler (FPSC), such as Global Cooling's model M100B (Available from Global Cooling Manufacturing, 94 N. Columbus Rd., Athens, Ohio). The FPSC 2000 includes a linear motor portion 2005 housing a linear motor (not shown) that receives an AC power input 2010. The FPSC 2000 includes a heat acceptor 2015, a regenerator 2020, and a heat rejecter 2025. The FPSC 2000 includes a balance mass 2030 coupled to the body of the linear motor within the linear motor portion 2005 to absorb vibrations during operation of the FPSC. The FPSC 2000 also includes a charge port 2035. The FPSC 2000 includes internal components, such as those shown in the FPSC 2100 of FIG. 21.

The FPSC 2100 includes a linear motor 2105 housed within the linear motor portion 2110. The linear motor portion 2110 houses a piston 2115 that is coupled to flat springs 2120 at one end and a displacer 2125 at another end. The displacer 2125 couples to an expansion space 2130 and a compression space 2135 that form, respectively, cold and hot sides. The heat acceptor 2015 is mounted to the cold side 2130 and the heat rejector is mounted to the hot side 2135. The FPSC 2100 also includes a balance mass 2140 coupled to the linear motor portion 2110 to absorb vibrations during operation of the FPSC 2100.

Figure 22:
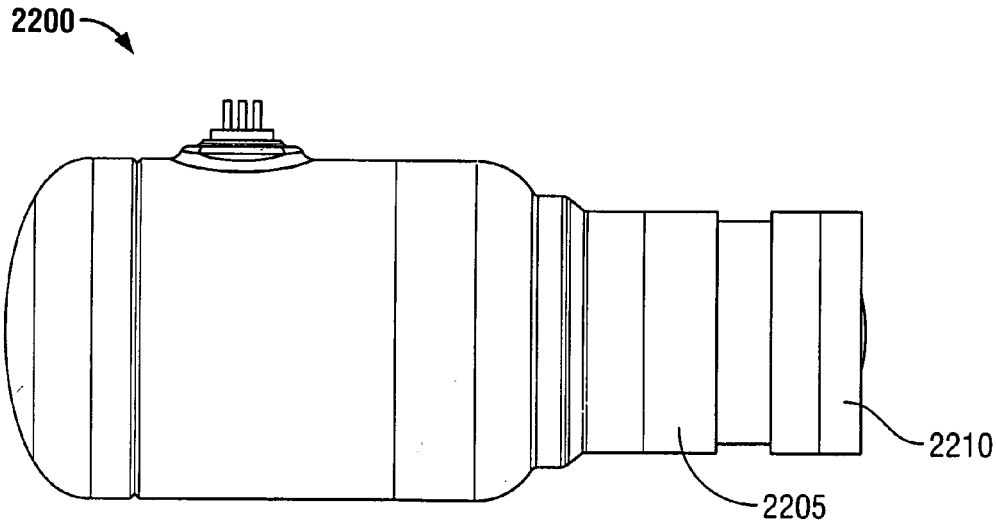
FIG. 22 is a side view of a cyclical heat exchange system such as the cyclical heat exchange system of FIG. 20.

Referring also to FIG. 22, in one implementation, a FPSC 2200 includes heat rejector 2205 made of a copper sleeve and a heat acceptor 2210 may of a copper sleeve. The heat rejector 2205 has an outer diameter (OD) of approximately 100 mm and a width of approximately 53 mm to provide a 166 $cm^2$ heat rejection surface capable of providing a flux of 6 $W/cm^2$ when operating in a temperature range of 20–70° C. The heat acceptor 2210 has an OD of approximately 100 mm and a width of approximately 37 mm to provide a 115 $cm^2$ heat accepting surface capable of providing a flux of 5.2 $W/cm^2$ in a temperature range of −30–5° C.

Briefly, in operation an FPSC is filled with a coolant (such as, for example, Helium gas) that is shuttled back and forth by combined movements of the piston and the displacer. In an ideal system, thermal energy is rejected to the environment through the heat rejector while the coolant is compressed by the piston and thermal energy is extracted from the environment through the heat acceptor while the coolant expands.

Figure 23:
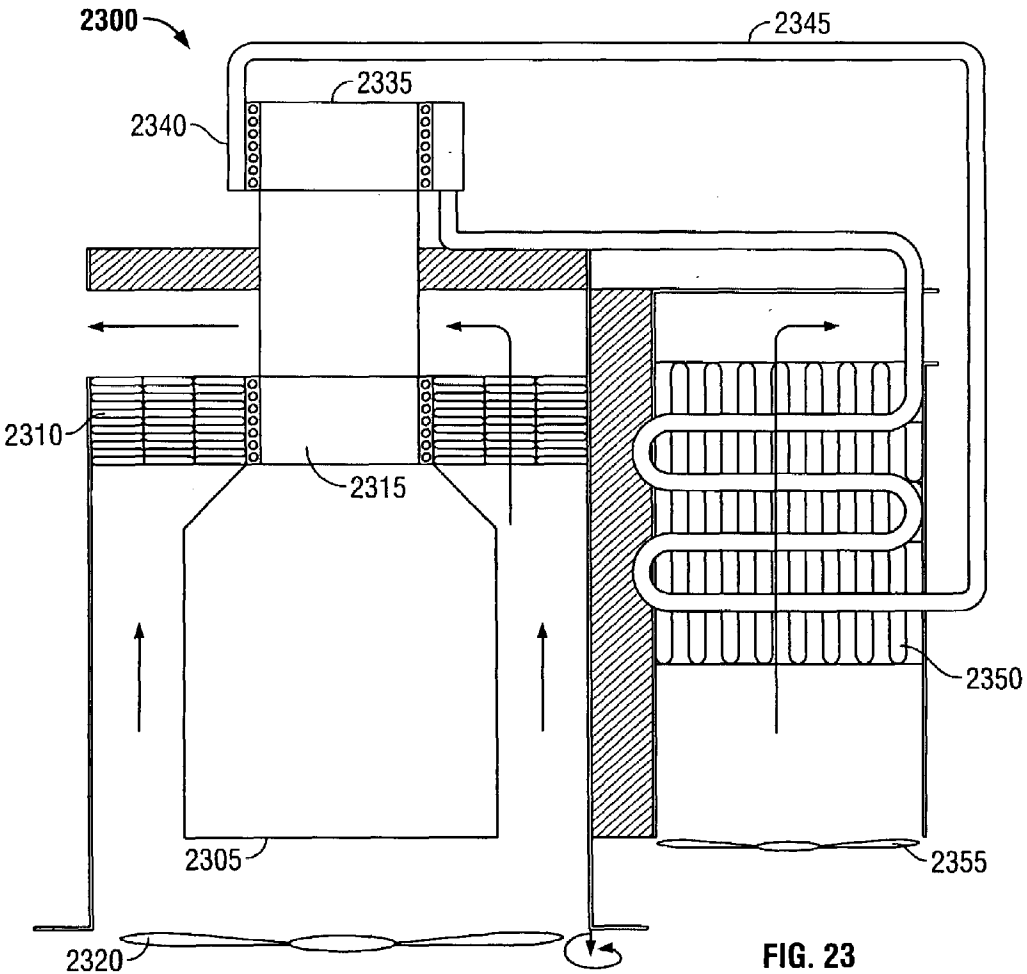
FIG. 23 is a schematic diagram of a first implementation of a thermodynamic system including a cyclical heat exchange system and a heat transfer system.

Referring to FIG. 23, a thermodynamic system 2300 includes a cyclical heat exchange system such as a cyclical heat exchange system 2305 (for example, the systems 2000, 2100, 2200) and a heat transfer system 2310 thermally coupled to a portion 2315 of the cyclical heat exchange system 2305. The cyclical heat exchange system 2305 is cylindrical and the heat transfer system 2310 is shaped to surround the portion 2315 of the cyclical heat exchange system 2305 to reject heat from the portion 2315. In this implementation, the portion 2315 is the hot side (that is, the heat rejector) of the cyclical heat exchange system 2305. The thermodynamic system 2300 also includes a fan 2320 positioned at the hot side of the cyclical heat exchange system 2305 to force air over a condenser of the heat transfer system 2310 and thus to provide additional convection cooling.

A cold side 2335 (that is, the heat acceptor) of the cyclical heat exchange system 2305 is thermally coupled to a $CO_2$ refluxer 2340 of a thermosiphon 2345. The thermosiphon 2345 includes a cold-side heat exchanger 2350 that is configured to cool air within the thermodynamic system 2300 that is forced across the heat exchanger 2350 by a fan 2355. A thermosiphon is a closed system of tubes that are connected to a cooling engine (in this case, the heat exchanger 2350) that permits natural circulation and cooling of the liquid within the refluxer.

Figure 24:
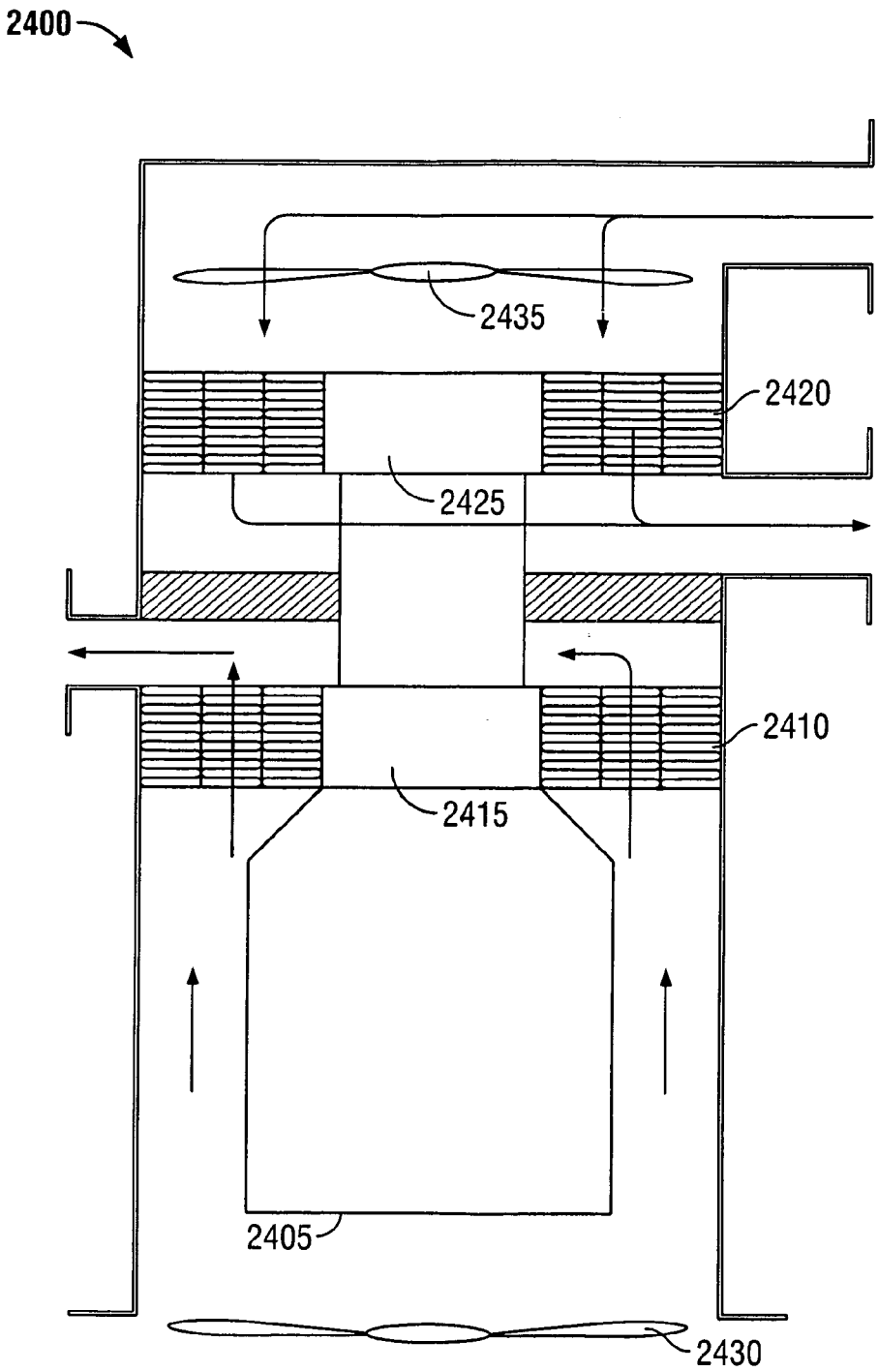
FIG. 24 is a schematic diagram of a second implementation of a thermodynamic system including a cyclical heat exchange system and a heat transfer system.

Referring to FIG. 24, in another implementation, a thermodynamic system 2400 includes a cyclical heat exchange system such as a cyclical heat exchange system 2405 (for example, the systems 2000, 2100, 2200) and a heat transfer system 2410 thermally coupled to a hot side 2415 of the cyclical heat exchange system 2405. The thermodynamic system 2400 includes a heat transfer system 2420 thermally coupled to a cold side 2425 of the cyclical heat exchange system 2405. The thermodynamic system 2400 also includes fans 2430, 2435. The fan 2430 is positioned at the hot side 2415 to force air through a condenser of the heat transfer system 2410. The fan 2435 is positioned at the cold side 2425 to force air through a condenser of the heat transfer system 2420.

Figure 25:
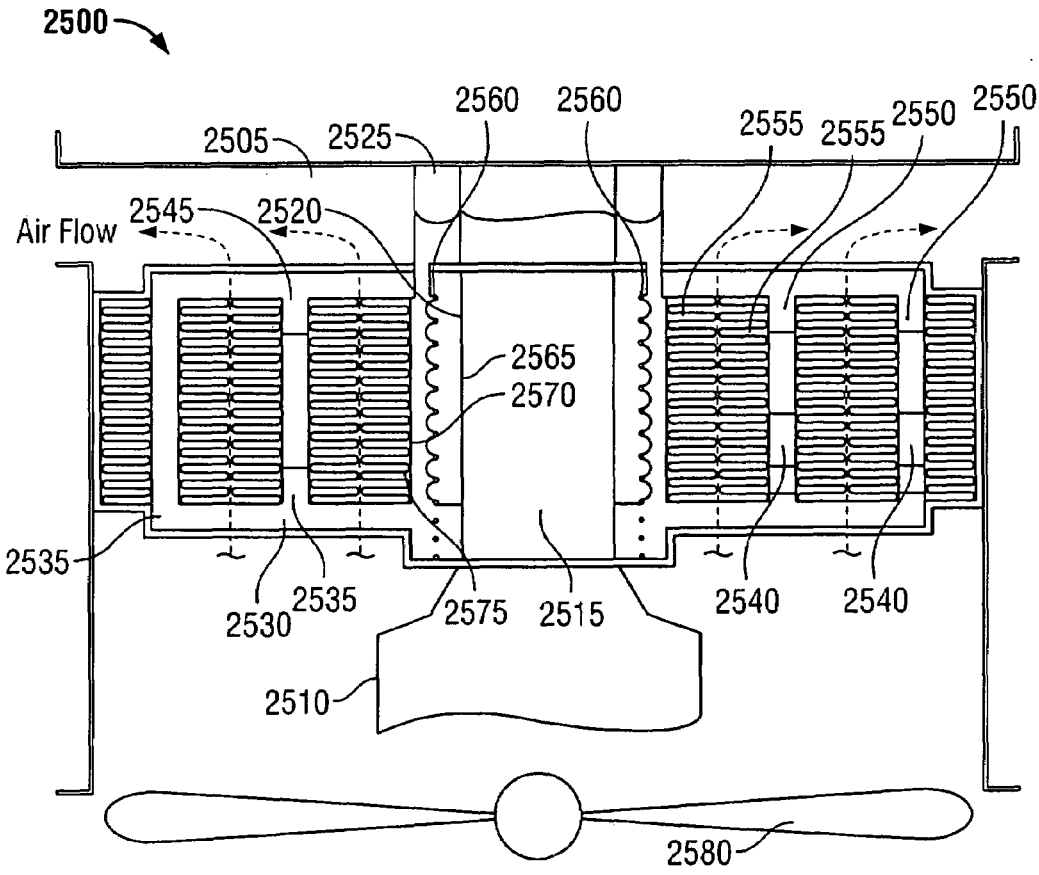
FIG. 25 is a schematic diagram of a heat transfer system using an evaporator designed in accordance with the principles of FIGS. 10–13.

Referring to FIG. 25, in one implementation, a thermodynamic system 2500 includes a heat transfer system 2505 coupled to a cyclical heat exchange system such as a cyclical heat exchange system 2510. The heat transfer system 2505 is used to cool a hot side 2515 of the cyclical heat exchange system 2510. The heat transfer system 2505 includes an annular evaporator 2520 that includes an expansion volume (or reservoir) 2525, a liquid return line 2530 providing fluid communication between liquid outlets 2535 of a condenser 2540 and the liquid inlet of the evaporator 2520. The heat transfer system 2505 also includes a vapor line 2545 providing fluid communication between the vapor outlet of the evaporator 2520 and vapor inlets 2550 of the condenser 2540.

The condenser 2540 is constructed from smooth wall tubing and is equipped with heat exchange fins 2555 or fin stock to intensify heat exchange on the outside of the tubing.

The evaporator 2520 includes a primary wick 2560 sandwiched between a vapor barrier wall 2565 and a liquid barrier wall 2570 and separating the liquid and the vapor. The liquid barrier wall 2570 is cold biased by heat exchange fins 2575 formed along the outer surface of the wall 2565. The heat exchange fins 2575 provide subcooling for the reservoir 2525 and the entire liquid side of the evaporator 2520. The heat exchange fins 2575 of the evaporator 2520 may be designed separately from the heat exchange fins 2555 of the condenser 2540.

The liquid return line 2530 extends into the reservoir 2525 located above the primary wick 2560, and vapor bubbles, if any, from the liquid return line 2530 and the vapor removal channels at the interface of the primary wick 2560 and the vapor barrier wall 2565 are vented into the reservoir 2525. Typical working fluids for the heat transfer system 2505 include (but are not limited to) methanol, butane, $CO_2$, propylene, and ammonia.

The evaporator 2520 is attached to the hot side 2515 of the cyclical heat exchange system 2510. In one implementation, this attachment is integral in that the evaporator 2520 is an integral part of the cyclical heat exchange system 2510. In another implementation, attachment can be non-integral in that the evaporator 2520 can be clamped to an outer surface of the hot side 2510. The heat transfer system 2505 is cooled by a forced convection sink, which can be provided by a simple fan 2580. Alternatively, the heat transfer system 2505 is cooled by a natural or draft convection.

Initially, the liquid phase of the working fluid is collected in a lower part of the evaporator 2520, the liquid return line 2530, and the condenser 2540. The primary wick 2560 is wet because of the capillary forces. As soon as heat is applied (for example, the cyclical heat exchange system 2510 is turned on), the primary wick 2560 begins to generate vapor, which travels through the vapor removal channels (similar to vapor removal channels 1120 of evaporator 1100) of the evaporator 2520, through the vapor outlet of the evaporator 2520, and into the vapor line 2545.

The vapor then enters the condenser 2540 at an upper part of the condenser 2540. The condenser 2540 condenses the vapor into liquid and the liquid is collected at a lower part of the condenser 2540. The liquid is pushed into the reservoir 2525 because of the pressure difference between the reservoir 2525 and the lower part of the condenser 2540. Liquid from the reservoir 2525 enters liquid flow channels of the evaporator 2520. The liquid flow channels of the evaporator 2520 are configured like the channels 1125 of the evaporator 1100 and are properly sized and located to provide adequate liquid replacement for the liquid that vaporized. Capillary pressure created by the primary wick 2560 is sufficient to withstand the overall LHP pressure drop and to prevent vapor bubbles from traveling through the primary wick 2560 toward the liquid flow channels.

The liquid flow channels of the evaporator 2520 can be replaced by a simple annulus, if the cold biasing discussed above is sufficient to compensate the increased heat leak across the primary wick 2560, which is caused by the increase in surface area of the heat exchange surface of annulus versus the surface area of the liquid flow channels.

Figure 26:
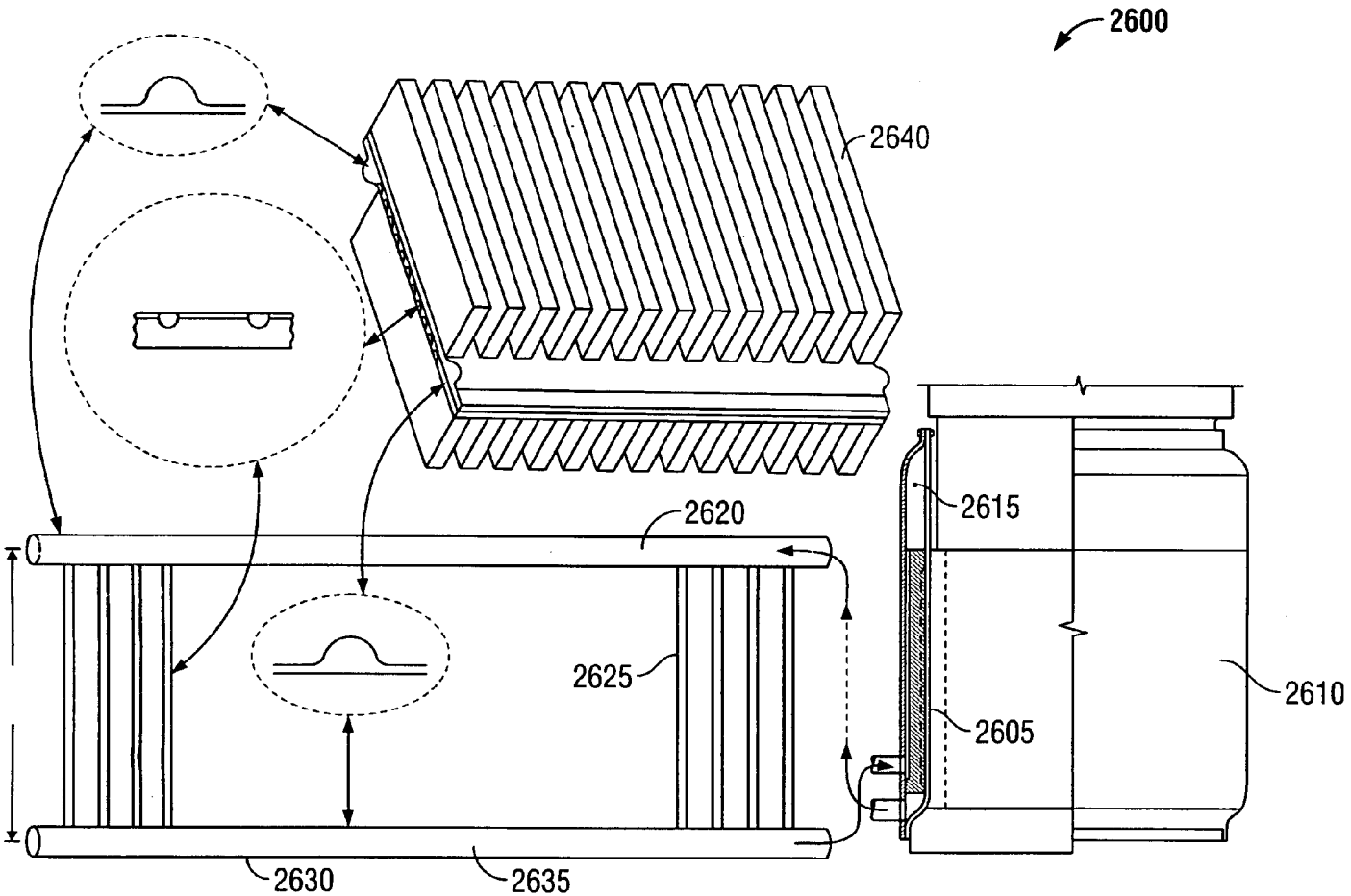
FIG. 26 is a functional exploded view of the heat transfer system of FIG. 25.
Figure 27:
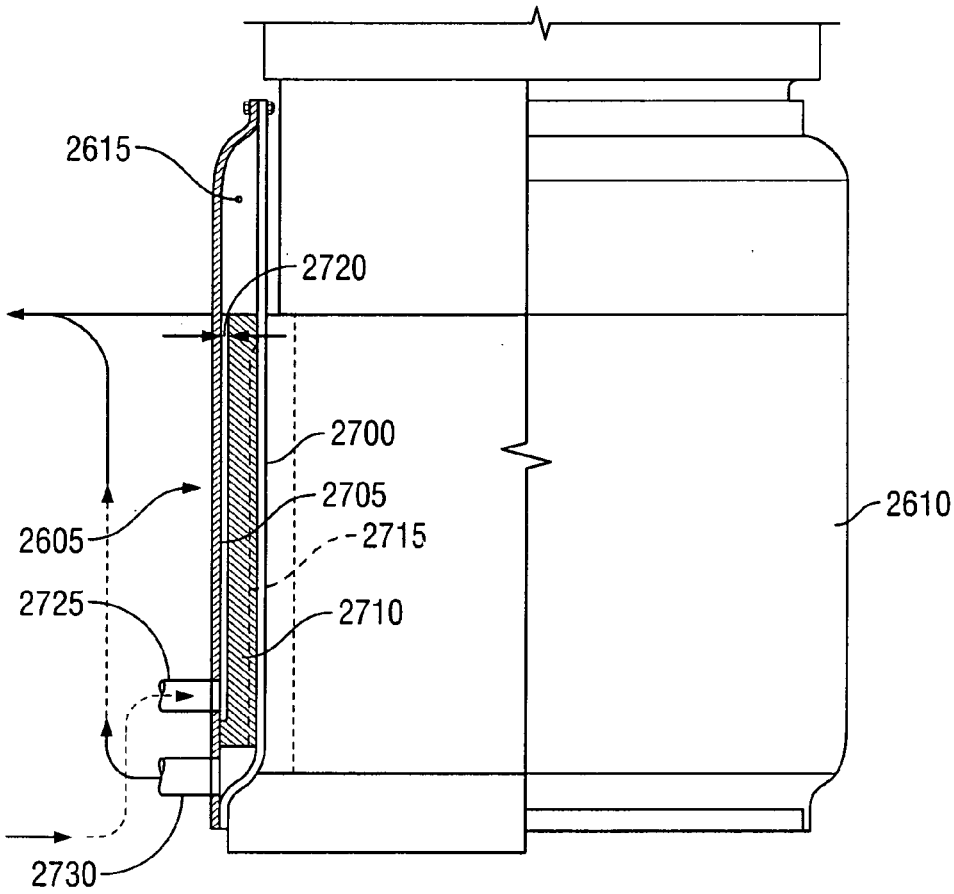
FIG. 27 is a partial cross-sectional detail view of an evaporator used in the heat transfer system of FIG. 25.
Figure 28:
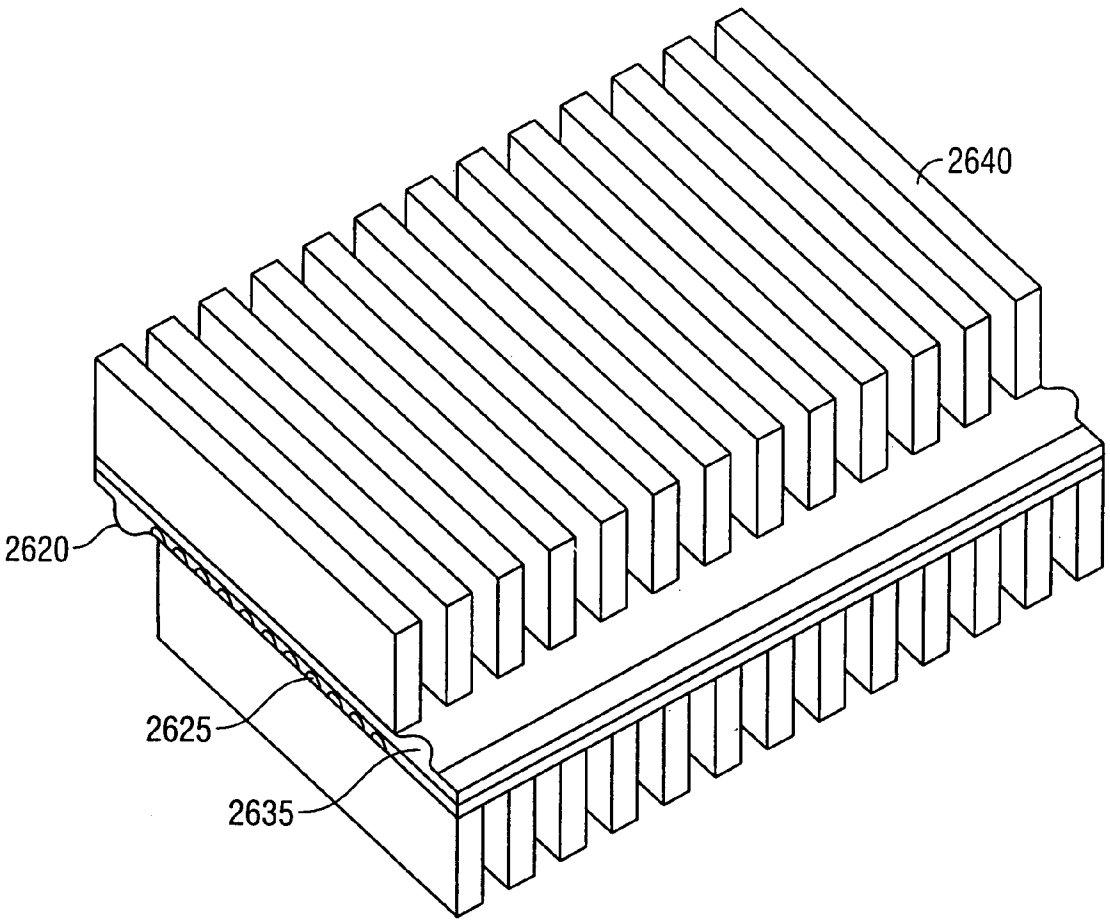
FIG. 28 is a perspective view of a heat exchanger used in the heat transfer system of FIG. 25.

Referring to FIGS. 26–28, a heat transfer system 2600 includes an evaporator 2605 coupled to a cyclical heat exchange system 2610 and an expansion volume 2615 coupled to the evaporator 2605. The vapor channels of the evaporator 2605 feed to a vapor line 2620 that feed a series of channels 2625 of a condenser 2630. The condensed liquid from the condenser 2630 is collected in a liquid return channel 2635. The heat transfer system 2600 also includes fin stock 2640 thermally coupled to the condenser 2630.

The evaporator 2605 includes a vapor barrier wall 2700, a liquid barrier wall 2705, a primary wick 2710 positioned between the vapor barrier wall 2700 and the inner side of the liquid barrier wall 2705, vapor removal channels 2715, and liquid flow channels 2720. The liquid barrier wall 2705 is coaxial with the primary wick 2710 and the vapor barrier wall 2700. The liquid flow channels 2720 are fed by a liquid return channel 2725 and the vapor removal channels 2715 feed into a vapor outlet 2730.

The vapor barrier wall 2700 intimately contacts the primary wick 2710. The liquid barrier wall 2705 contains working fluid on an inner side of the liquid barrier wall 2705 such that the working fluid flows only along the inner side of the liquid barrier wall 2705. The liquid barrier wall 2705 closes the evaporator's envelope and helps to organize and distribute the working fluid through the liquid flow channels 2720.

In one implementation, the evaporator 2605 is approximately 2" tall and the expansion volume 2615 is approximately 1" in height. The evaporator 2605 and the expansion volume 2615 are wrapped around a portion of the cyclical heat exchange system 2610 having a 4" outer diameter. The vapor line 2620 has a radius of ⅛". The cyclical heat exchange system 2610 includes approximately 58 condenser channels 2625, with each condenser channel 2625 having a length of 2" and a radius of 0.012," the channels 2625 being spread out such that the width of the condenser 2630 is approximate 40". The liquid return channel 2725 has a radius of 1/16". The heat exchanger 2800 (which includes the condenser 2630 and the fin stock 2640 is approximately 40" long and is wrapped into an inner and outer loop (see FIGS. 30, 33, and 34) to produce a cylindrical heat exchanger having an outer diameter of approximately 8". The evaporator 2605 have a cross-sectional width 2750 of approximately ⅛," as defined by the vapor barrier wall 2700 and the liquid barrier wall 2705. The vapor removal channels 2715 have widths of approximately 0.020" and depths of approximately 0.020" and are separated from each other by approximately 0.020" to produce 25 channels per inch.

As mentioned above, the heat transfer system (such as system 2310) is thermally coupled to the portion (such as portion 2315) of the cyclical heat exchange system. The thermal coupling between the heat transfer system and the portion can be by any suitable method. In one implementation, if the evaporator of the heat transfer system is thermally coupled to the hot side of the cyclical heat exchange system, the evaporator may surround and contact the hot side and the thermal coupling may be enabled by a thermal grease compound applied between the hot side and the evaporator. In another implementation, if the evaporator of the heat transfer system is thermally coupled to the hot side of the cyclical heat exchange system, the evaporator may be constructed integrally with the hot side of the cyclical heat exchange system by forming vapor channels directly into the hot side of the cyclical heat exchange system.

Figure 30:
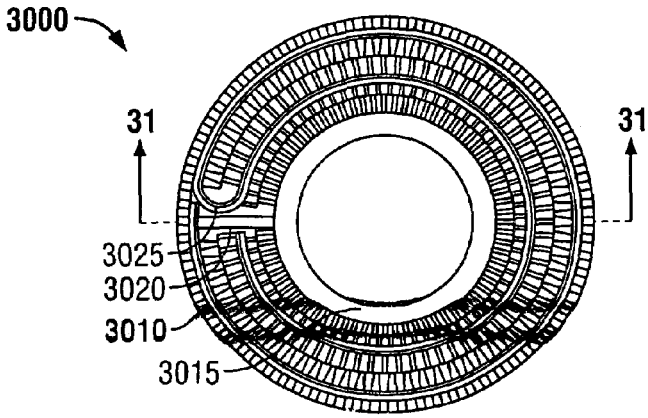
FIG. 30 is a top plan view of a heat transfer system packaged around a portion of a cyclical heat exchange system.
Figure 31:
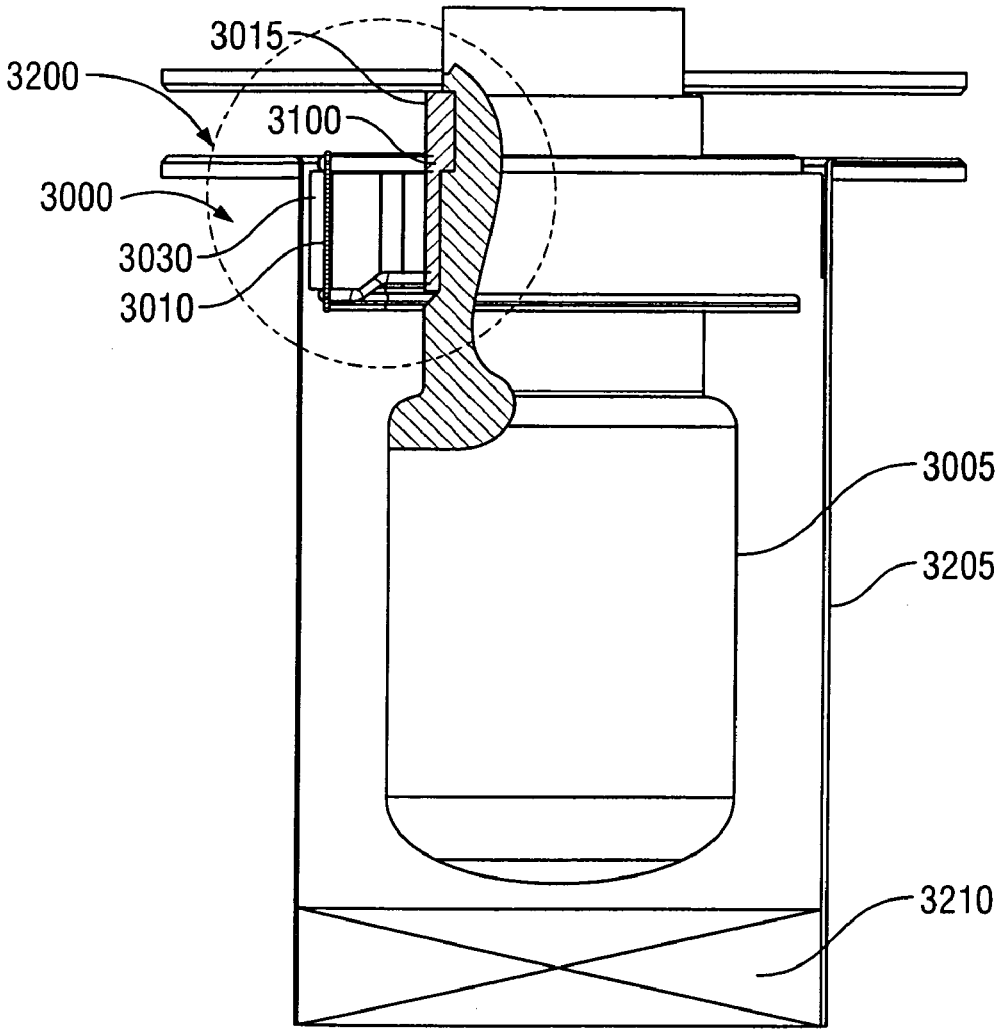
FIG. 31 is a partial cross-sectional elevation view (taken along line 31—31) of the heat transfer system packaged around the cyclical heat exchange system portion of FIG. 30.
Figure 32:
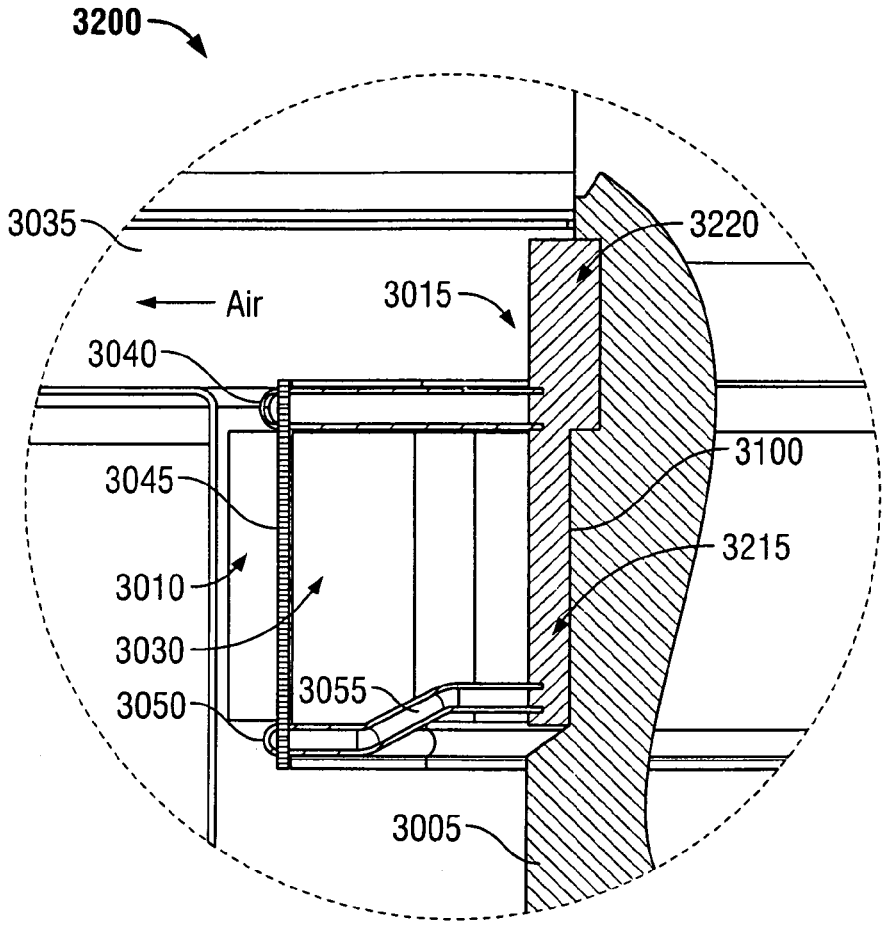
FIG. 32 is a partial cross-sectional elevation view (taken at detail 3200) of the interface between the heat transfer system and the cyclical heat exchange system of FIG. 30.

Referring to FIGS. 30–32, a heat transfer system 3000 is packaged around a cyclical heat exchange system 3005. The heat transfer system 3000 includes a condenser 3010 surrounding an evaporator 3015. Working fluid that has been vaporized exits the evaporator 3015 through a vapor outlet 3020 connected to the condenser 3010. The condenser 3010 loops around and doubles back inside itself at junction 3025.

The cyclical heat exchange system 3005 is surrounded about its heat rejection surface 3100 by the evaporator 3015. The evaporator 3015 is in intimate contact with the heat rejection surface 3100. The refrigeration assembly (which is the combination of the cyclical heat exchange system 3005 and the heat transfer system 3000) is mounted in a tube 3205, with a fan 3210 mounted at the end of the tube 3205 to force air through fins 3030 of the condenser 3010 to exhaust channels 3035.

The evaporator 3015 has a wick 3215 in which working fluid absorbs heat from the heat rejection surface 3100 and changes phase from liquid to vapor. The heat transfer system 3000 includes a reservoir 3220 at the top of the evaporator 3015 that provides an expansion volume. For simplicity of illustration, the evaporator 3015 has been illustrated in this view as a simple hatched block that shows no internal detail. Such internal details are discussed elsewhere in this description.

The vaporized working fluid exits the evaporator 3015 through the vapor outlet 3020 and enters a vapor line 3040 of the condenser 3010. The working fluid flows downward from the vapor line 3040, through channels 3045 of the condenser 3010, to the liquid return line 3050. As the working fluid flows through the channels 3045 of the condenser 3010 it loses heat, through the fins 3030 to the air passing between the fins, to change phase from vapor to liquid. Air that has passed through the fins 3030 of the condenser 3010 flows away through the exhaust channel 3035. Liquefied working fluid (and possibly some uncondensed vapor) flows from the liquid return line 3050 back into the evaporator 3015 through the liquid return port 3055.

Figure 33:
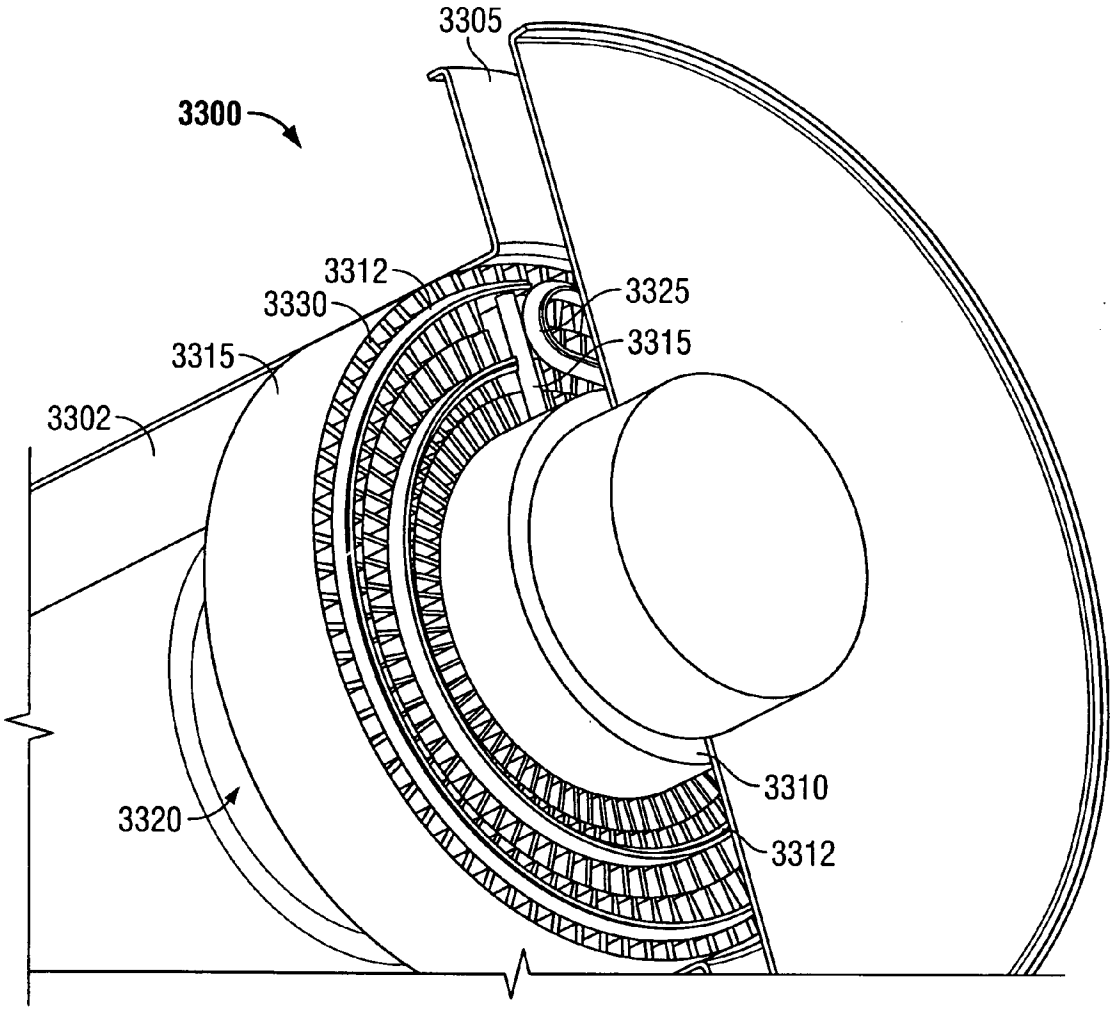
FIG. 33 is an upper perspective view of a heat transfer system mounted to a cyclical heat exchange system.
Figure 34:
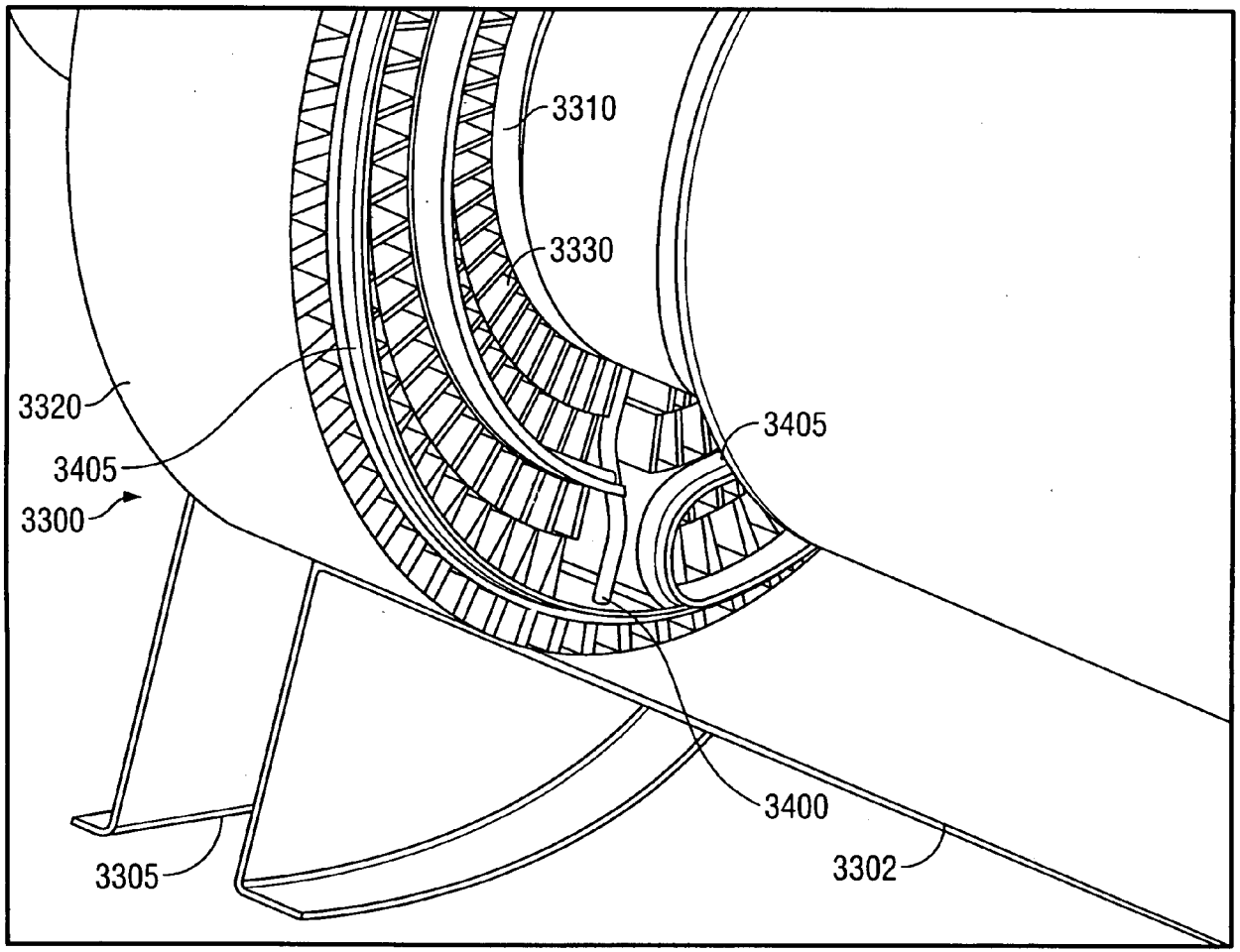
FIG. 34 is a lower perspective view of the heat transfer system mounted to the cyclical heat exchange system of FIG. 33.

Referring to FIGS. 33 and 34, a heat transport system 3300 surrounds a portion of a cyclical heat exchange system 3302, that is surrounded, in turn, by exhaust channels 3305. The heat transport system 3300 includes an evaporator 3310 having an upper portion that surrounds the cyclical heat exchange system 3302. A vapor port 3315 connects the evaporator 3310 to a vapor line 3312 of a condenser 3320. The vapor line 3312 includes an outer region that circles around the evaporator 3310 and then doubles back on itself at junction 3325 to form an inner region that circles back around the evaporator 3310 in the opposite direction. The heat transport system 3300 also includes cooling fins 3330 on the condenser 3320.

The heat transport system 3300 also includes a liquid return port 3400 that provides a path for condensed working fluid from the liquid line 3405 of the condenser 3320 to return to the evaporator 3310.

As mentioned above, the interface between the evaporator 3310 and the heat rejection surface of the cyclical heat exchange system 3302 may be implemented according one of several alternate implementations.

Figure 35:
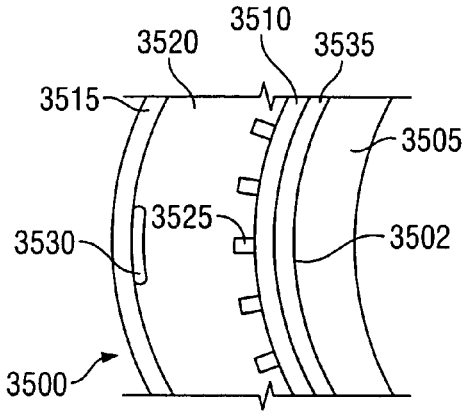
FIG. 35 is a partial cross-sectional view of an interface between an evaporator of a heat transfer system and a cyclical heat exchange system in which the evaporator is clamped onto the cyclical heat exchange system.

Referring to FIG. 35, in one implementation, an evaporator 3500 slips over a heat rejection surface 3502 of a cyclical heat exchange system 3505. The evaporator 3500 includes a vapor barrier wall 3510, a liquid barrier wall 3515, and a wick 3520 sandwiched between the walls 3510 and 3515. The wick 3520 is equipped with vapor channels 3525 and liquid flow channels 3530 are formed at the liquid barrier wall 3515 in simplified form for clarity.

Figure 36:
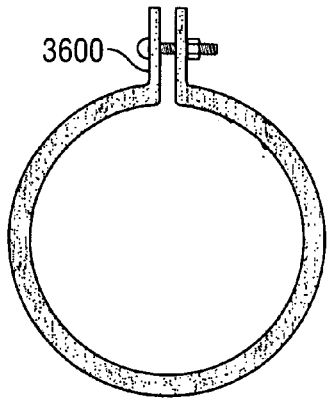
FIG. 36 is a side view of a clamp used to clamp the evaporator onto the cyclical heat exchange system of FIG. 35.

The evaporator 3500 is slipped over the cyclical heat exchange system 3050 and may be held in place with the use of a clamp 3600 (shown in FIG. 36). To aid heat transfer, thermally conductive grease 3535 is disposed between the cyclical heat exchange system 3050 and vapor barrier wall 3510 of the evaporator 3500. In an alternate implementation, the vapor channels 3525 are formed in the vapor barrier wall 3510 instead of in the wick 3520.

Figure 37:
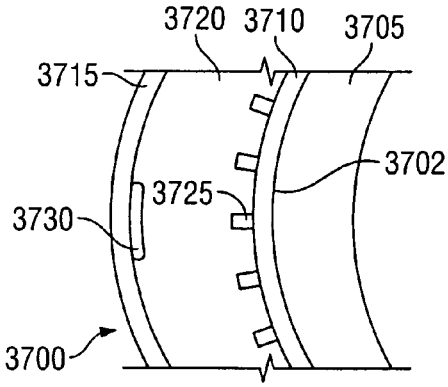
FIG. 37 is a partial cross-sectional view of an interface between an evaporator of a heat transfer system and a cyclical heat exchange system in which the interface is formed by an interference fit between the evaporator and the cyclical heat exchange system.

Referring to FIG. 37, in another implementation, an evaporator 3700 is fit over a heat rejection surface 3702 of a cyclical heat exchange system 3705 with an interference fit. The evaporator 3700 includes a vapor barrier wall 3710, a liquid barrier wall 3715, and a wick 3720 sandwiched between the walls 3710 and 3715. The evaporator 3700 is sized to have an interference fit with the heat rejection surface 3702 of the cyclical heat exchange system 3705.

The evaporator 3700 is heated so that its inner diameter expands to permit it to slip over the unheated heat rejection surface 3702. As the evaporator 3700 cools, it contracts to fix onto the cyclical heat exchange system 3705 in an interference fit relationship. Because of the tightness of the fit, no thermally conductive grease is needed to enhance heat transfer. The wick 3720 is equipped with vapor channels 3725. In an alternate implementation, the vapor channels are formed in the vapor barrier wall 3710 instead of in the wick 3720. Liquid flow channels 3730 are formed at the liquid barrier wall 3715 in a simplified form for clarity.

Figure 38:
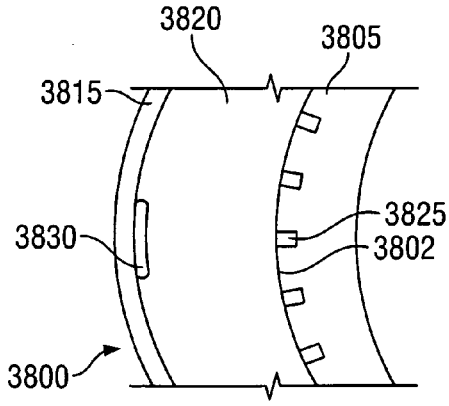
FIG. 38 is a partial cross-sectional view of an interface between an evaporator of a heat transfer system and a cyclical heat exchange system in which the interface is formed by forming the evaporator integrally with the cyclical heat exchange system.
Figure 42:
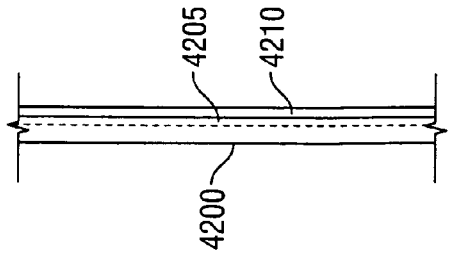
FIGS. 41–43 are detail cross-sectional views of a condenser having a laminated construction.
Figure 41:
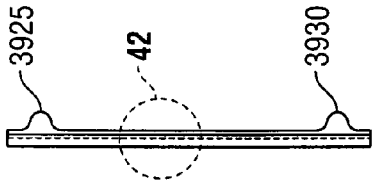

Referring to FIG. 38, in another implementation, an evaporator 3800 is fit over a heat rejection surface 3802 of a cyclical heat exchange system 3805 and features previously designed within the evaporator 3800 are now integrally formed within the heat rejection surface 3802. In particular, the evaporator 3800 and the heat rejection surface 3802 are constructed together as an integrated assembly. The heat rejection surface 3802 is modified to have vapor channels 3825; in this way, the heat rejection surface 3802 acts as a vapor barrier wall for the evaporator 3800.

The evaporator 3800 includes a wick 3820 and a liquid barrier wall 3815 formed about the modified heat rejection surface 3802, the wick 3820 and the liquid barrier wall 3815 being integrally bonded to the heat rejection surface 3802 to form a sealed evaporator 3800. Liquid flow channels 3830 are portrayed in a simplified form for clarity. In this way, a hybrid cyclical heat exchange system with an integrated evaporator is formed. This integral construction provides enhanced thermal performance in comparison to the clamp-on construction and the interference fit construction because thermal resistance is reduced between the cyclical heat exchange system and the wick of the evaporator.

Figure 29:
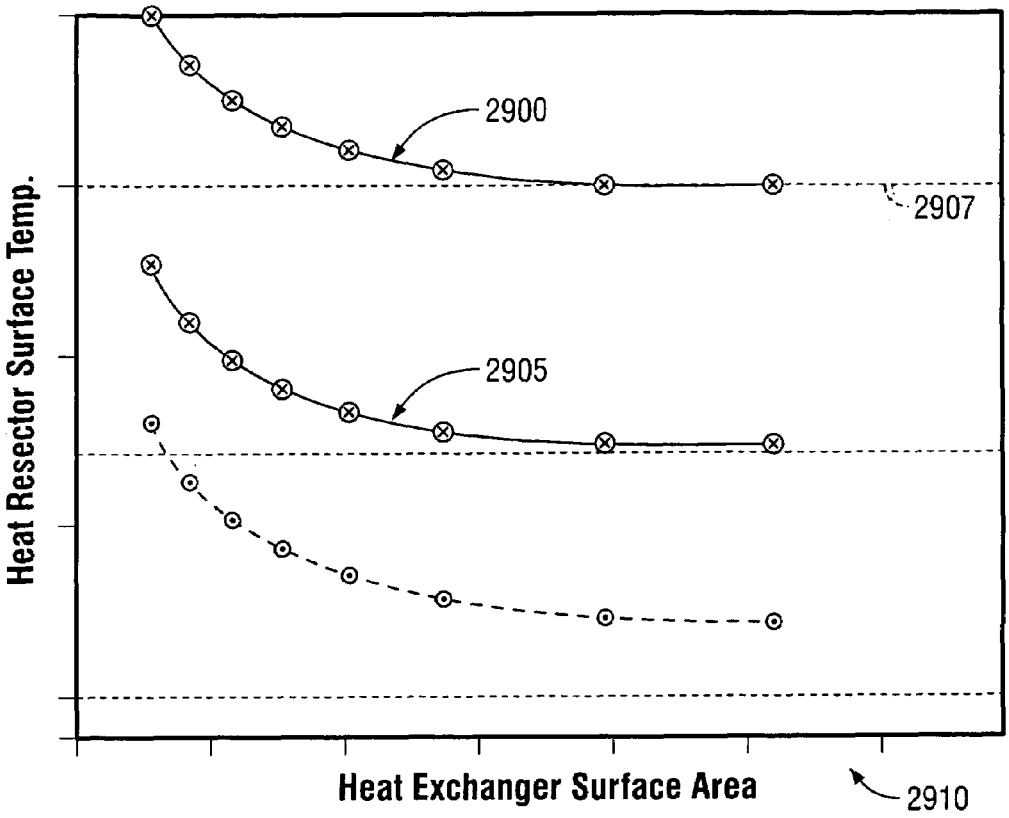
FIG. 29 is a graph of temperature of a heat source of a cyclical heat exchange system versus a surface area of an interface between the heat transfer system and the heat source of the cyclical heat exchange system.

Referring to FIG. 29, graphs 2900 and 2905 show the relationship between a maximum temperature of the surface of the portion of the cyclical heat exchange system that is to be cooled by the heat transfer system and a surface area of the interface between the heat transfer system and the portion of the cyclical heat exchange system to be cooled. The maximum temperature indicates the maximum amount of heat rejection. In graph 2900, the interface between the portion and the heat transfer system is accomplished with a thermal grease compound. In graph 2905, the heat transfer system is made integral with the portion.

As shown, at an air flow of 300 CFM, if the interface is a thermal grease interface, then the maximum amount of heat rejection would fall within a maximum heat rejection surface temperature 2907 (for example, 70° C.) with a heat exchange surface area 2910 (for example, 100 $ft^2$). When the evaporator is constructed integrally with the portion by forming vapor channels directly in the heat rejection surface, that heat rejection surface would operate below the maximum heat rejection surface temperature of the thermal grease interface with significantly smaller heat exchange surface areas.

Figure 39:
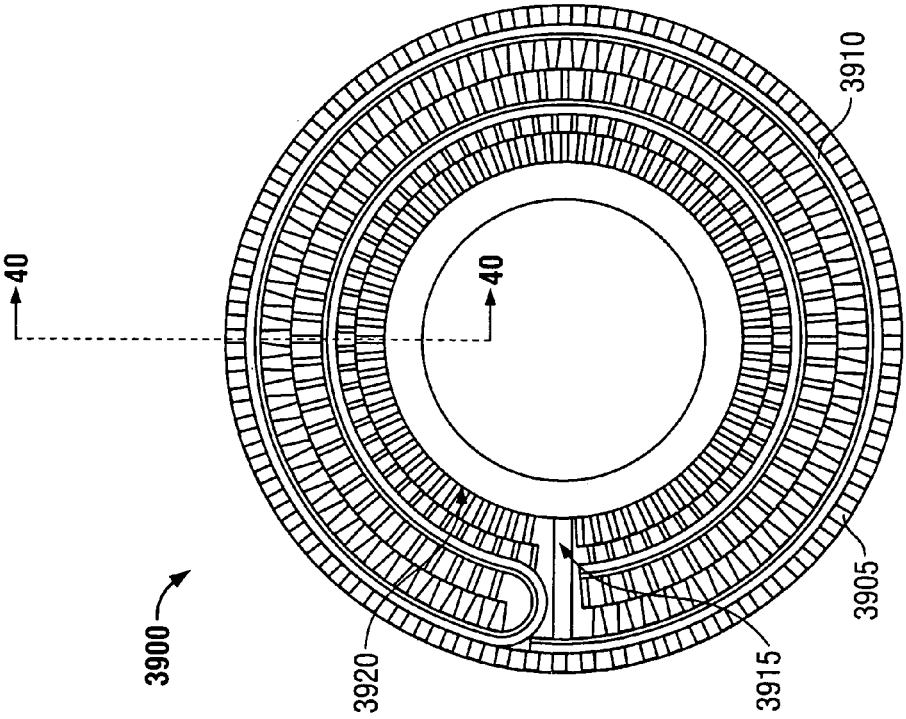
FIG. 39 is a top plan view of a condenser of a heat transfer system.

Referring to FIG. 39, a condenser 3900 is formed with fins 3905, which provide thermal communication between the air or the environment and a vapor line 3910 of the condenser 3900. The vapor line 3910 couples to a vapor outlet 3915 that connects the evaporator 3920 positioned within the condenser 3900.

Referring to FIGS. 40–43, in one implementation, the condenser 3900 is laminated and is formed with flow channels that extend through a flat plate 4000 of the condenser 3900 between a vapor head 3925 and a liquid head 3930. Copper is a suitable material for use in making a laminated condenser. The laminated structure condenser 3900 includes a base 4200 having fluid flow channels 4205 (shown in phantom) formed therein and a top layer 4210 is bonded to the base 4200 to cover and seal the fluid flow channels 4205. The fluid flow channels 4205 are designed as trenches formed in the base 4200 and sealed beneath the top layer 4210. The trenches for the fluid flow channels 4205 may be formed by chemical etching, electrochemical etching, mechanical machining, or electrical discharge machining processes.

Figure 44:
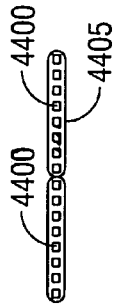
FIG. 44 is a detail cross-sectional view of a condenser having an extruded construction.
Figure 43:
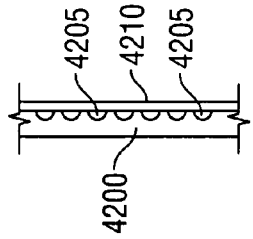
Figure 45:
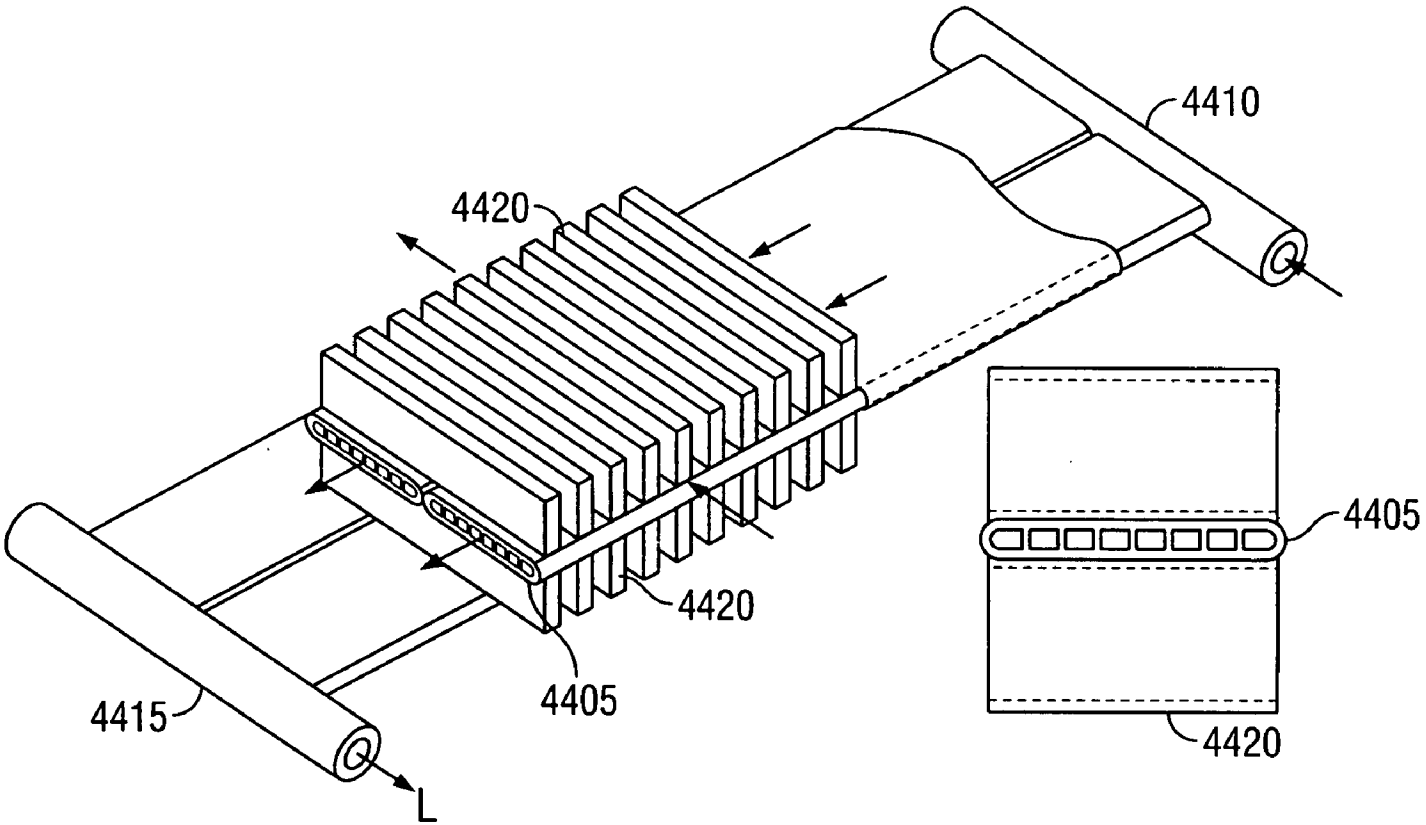
FIG. 45 is a perspective detail and cross-sectional view of a condenser having an extruded construction.

Referring to FIGS. 44 and 45, in another implementation, the condenser 3900 is extruded and small flow channels 4400 extend through a flat plate 4405 of the condenser 3900. Aluminum is a suitable material for use in such an extruded condenser. The extruded micro channel flat plate 4405 extends between a vapor header 4410 and a liquid header 4415. Moreover, corrugated fin stock 4420 is bonded (for example, brazed or epoxied) to both sides of the flat plate 4405.

Figure 46:
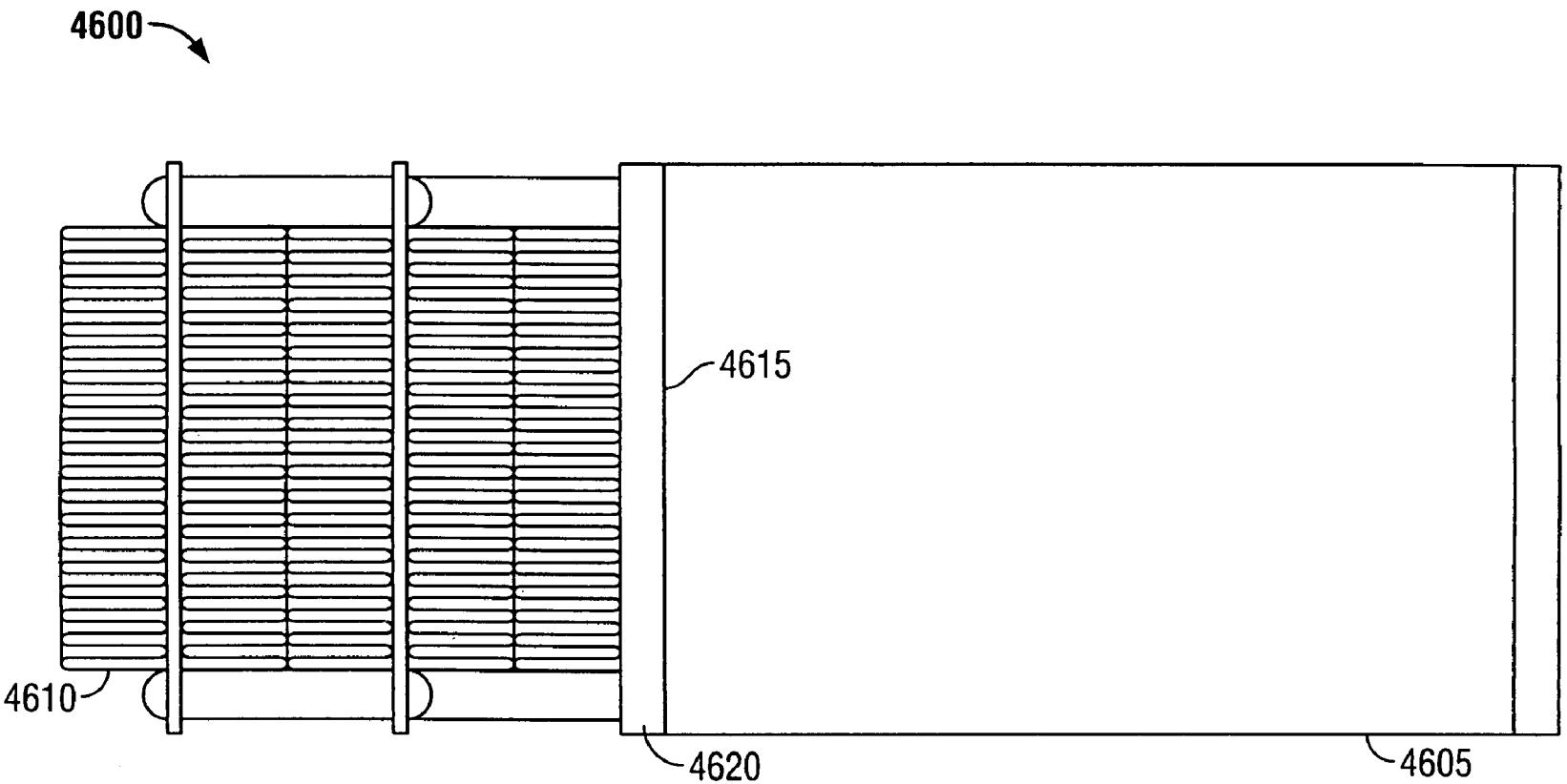
FIG. 46 is a cross-sectional view of one side of a heat transfer system packaging around a cyclical heat exchange system.

Referring to FIG. 46, a cross-sectional view of one side of a heat transfer system 4600 that is coupled to a cyclical heat exchange system 4605. This view shows relative dimensions that provide for particularly compact packaging of the heat transfer system. In this view, fins 4610 are portrayed as being 90 degrees out of phase for ease of illustration. To cool the heat rejection surface 4615 of the cyclical heat exchange system 4605 having a 4 inch diameter, the evaporator 4620 has a thickness of 0.25 inch and the radial thickness of the condenser is 1.75 inches. This provides on overall dimension for the packaging (the combination of the heat transfer system 4600 and the cyclical heat exchange system 4605 of 8 inches.

As discussed, the evaporator used in the heat transfer system is equipped with a wick. Because a wick is employed within the evaporator of the heat transfer system, the condenser may be positioned at any location relative to the evaporator and relative to gravity. For example, the condenser may be positioned above the evaporator (relative to a gravitational pull), below the evaporator (relative to a gravitational pull), or adjacent the evaporator, thus experiencing the same gravitational pull as the evaporator.

Other implementations are within the scope of the following claims.

Notably, the terms Stirling engine, Stirling heat exchange system, and Free Piston Stirling Cooler have been referenced in several implementations above. However, the features and principals described with respect to those implementations also may be applied to other engines capable of conversions between mechanical energy and thermal energy.

Moreover, the features and principals described above may be applied to any heat engine, which is a thermodynamic system that can undergo a cycle, that is, a sequence of transformations that ultimately return it to its original state. If every transformation in the cycle is reversible, the cycle is reversible and the heat transfers occur in the opposite direction and the amount of work done switches sign. The simplest reversible cycle is a Carnot cycle, which exchanges heat with two heat reservoirs.

Manufacture

Figure 47:
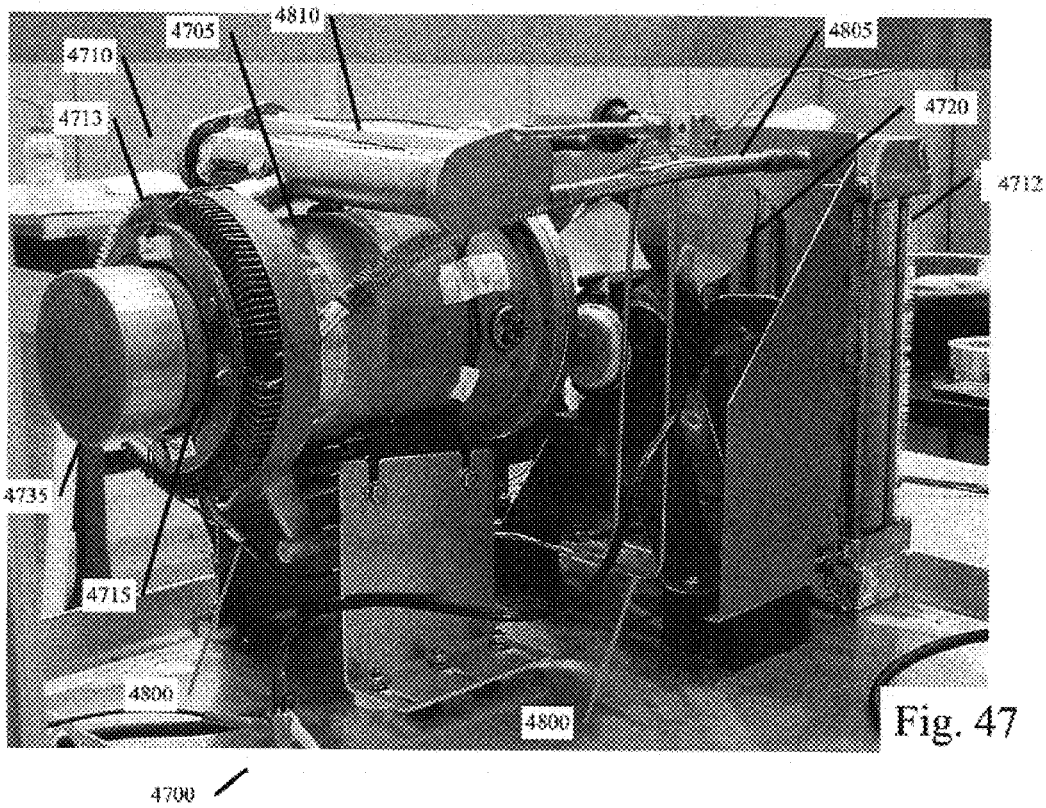
FIG. 47 is a perspective view of a thermodynamic system that includes a cyclical heat exchange system and a heat transfer system.
Figure 51:
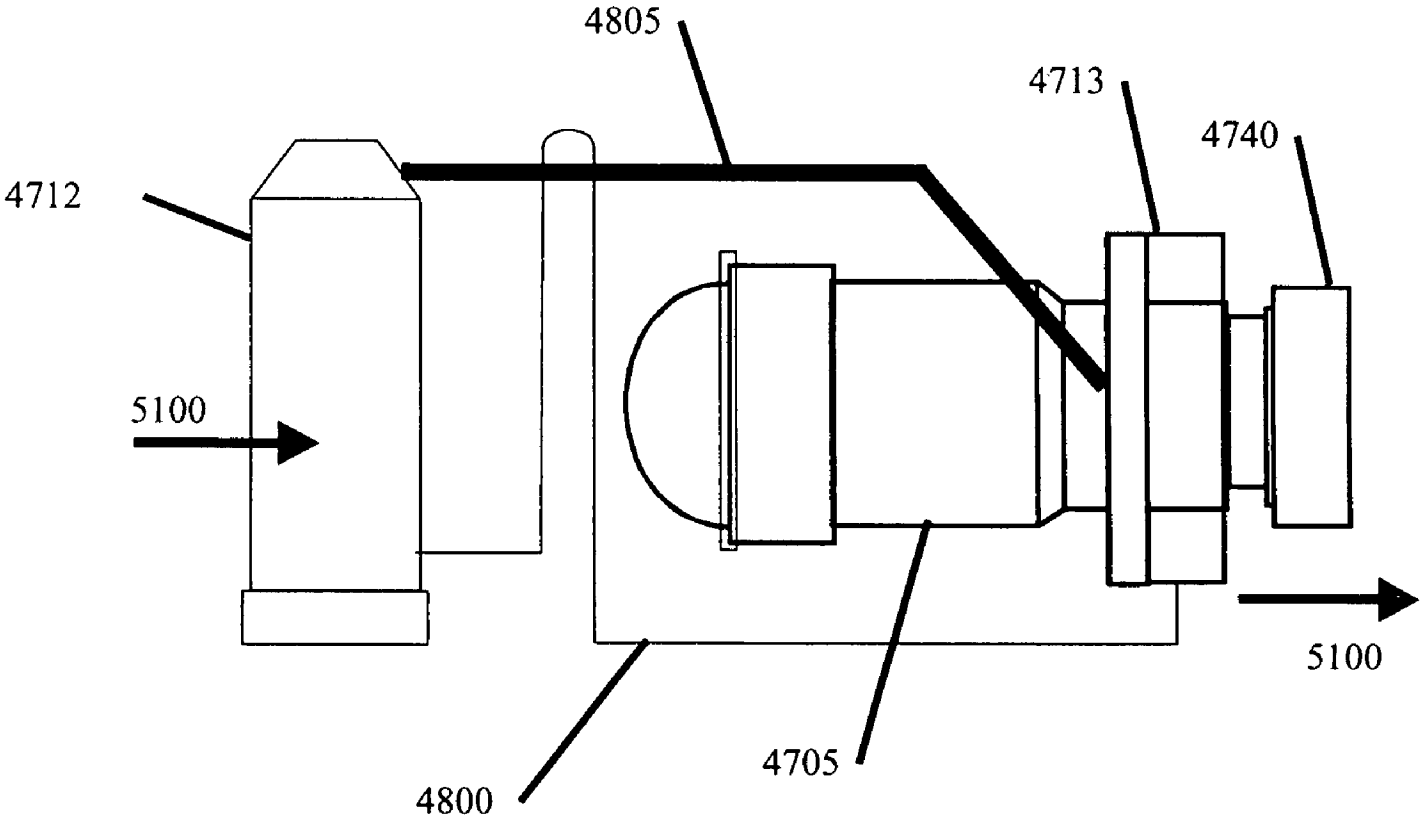
FIG. 51 is a schematic diagram of a portion of the thermodynamic system of FIG. 47.

Referring to FIG. 47, a thermodynamic system 4700 includes a heat source such as, for example, a cyclical heat exchange system 4705, and a heat transfer system 4710 thermally coupled to a portion 4715 of the cyclical heat exchange system 4705. The heat transfer system 4710 is designed with an annular evaporator 4713 such as, for example, the annular evaporator 1100 of FIG. 11. The evaporator 4713 is shaped to surround the portion 4715 of the cyclical heat exchange system 4705 to reject heat from the portion 4715. The thermodynamic system 4700 also includes a fan 4720 positioned to force air over a condenser 4712 of the heat transfer system 4710 along a path 5100 (FIG. 51) and thus to provide additional convection cooling.

Referring also to FIGS. 48–51, the heat transfer system 4710 includes a liquid line 4800 that pumps liquid from the condenser 4712 into the evaporator 4713 and a vapor line 4805 that feeds vapor into the condenser 4712. A discussion of the operation of a heat transfer system is provided above and is not repeated here. The heat transfer system 4710 may also include a reservoir 4810 coupled to the vapor line 4805 through a port 4812 for additional pressure containment, as needed. In particular, the reservoir 4810 increases the volume of the heat transfer system 4710, as also discussed above.

As shown, the cyclical heat exchange system 4705 is cylindrical. The cyclical heat exchange system 4705 includes a cold side 4735, that is, the heat acceptor, and a hot side, that is, the heat rejector or portion 4715, which is surrounded by the evaporator 4713.

Figure 50:
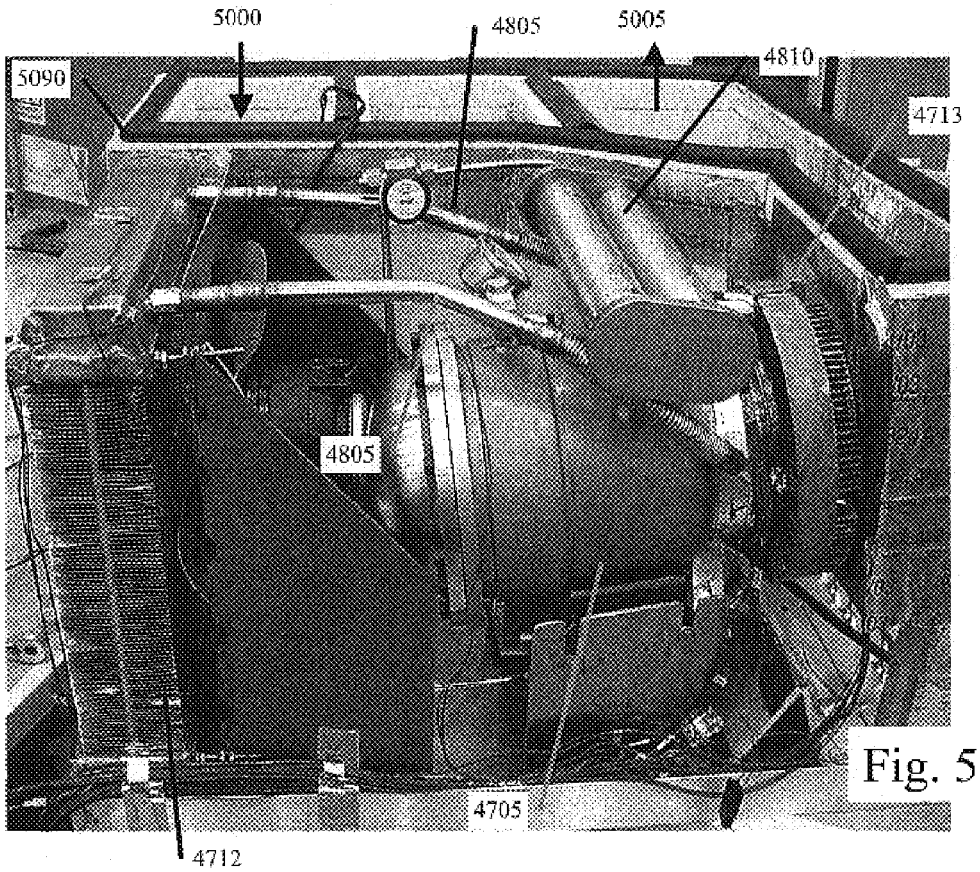
FIG. 50 is a side perspective view of the thermodynamic system of FIG. 47.
Figure 52:
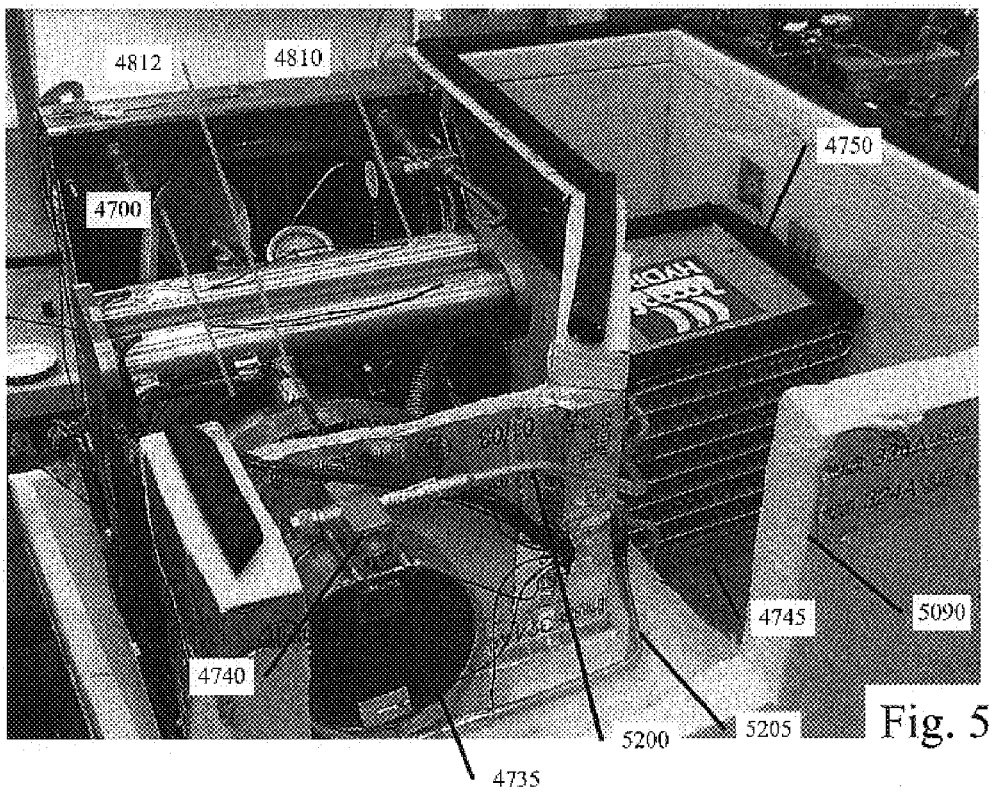
FIG. 52 is a perspective view of the thermodynamic system of FIG. 47.

Referring also to FIG. 52, the cold side 4735 of the cyclical heat exchange system 4705 may be thermally coupled to a refluxer 4740 of a thermosiphon 4745. The thermosiphon 4745 includes a cold-side heat exchanger 4750 that is configured to cool air within the thermodynamic system 4700 that is forced across the heat exchanger 4750 by a thermosiphon fan (not shown in FIGS. 50 and 52, but mounted adjacent the heat exchanger 4750). The thermosiphon fan blows the air into the thermosiphon along path 5000 and blows the air out of the thermosiphon along path 5005 (FIG. 50). The thermosiphon includes a vapor line 5200 from the refluxer 4740 to the heat exchanger 4750 and a liquid line 5205 from the heat exchanger 4750 to the refluxer 4740. Vapor that is heated at the cold side 4735 flows through the heat exchanger from the line 5200, where it is condensed and cooled by the thermosiphon fan and the condensed liquid is returned through the line 5205 to the refluxer 4740.

Figure 48:
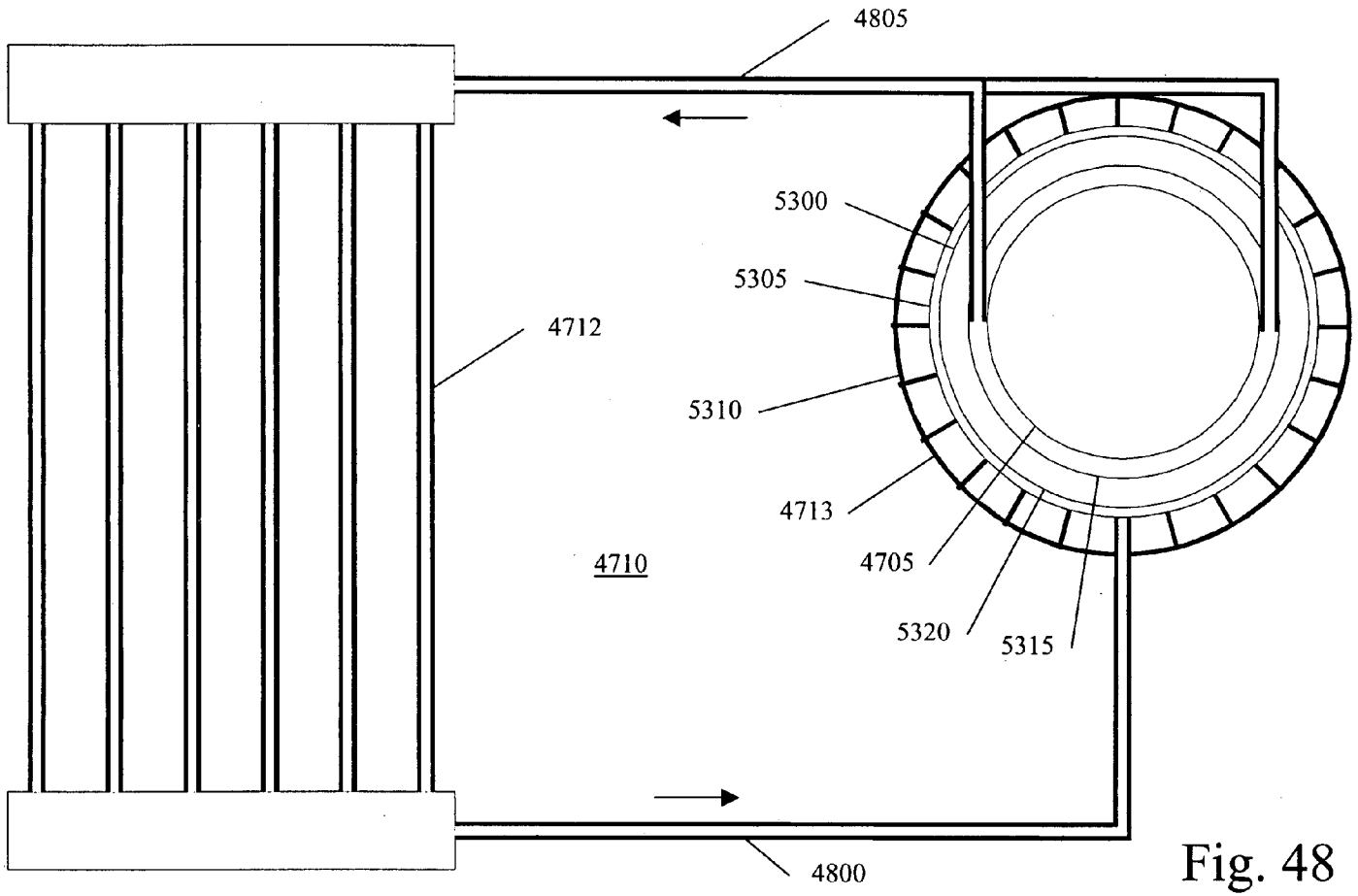
FIG. 48 is a schematic diagram of a portion of the heat transfer system of FIG. 47.

Referring to FIG. 48 and also to FIGS. 53A–E, the evaporator 4713 includes a wick subassembly 5300 surrounded by an outer subassembly. The outer subassembly includes an outer ring or liquid barrier wall 5305 and a subcooler 5310. The subcooler 5310 is an array of fins that help dissipate heat from the liquid barrier wall 5305. The wick subassembly 5300 includes an inner ring or vapor barrier wall 5315 such as, for example, the vapor barrier wall 1700 of FIGS. 14A–H, 15A, 15B, and 17A–D. The wick subassembly 5300 also includes a wick 5320 such as, for example, the wick 1600 of FIGS. 14G, 14H, and 16A–D. The vapor barrier wall 5315 includes vapor removal channels 5325 such as, for example, the channels 1465 of FIGS. 14A–H, 15A, 15B, and 17A–D. The vapor barrier wall 5315 is surrounded by the wick 5320.

Figure 53A:
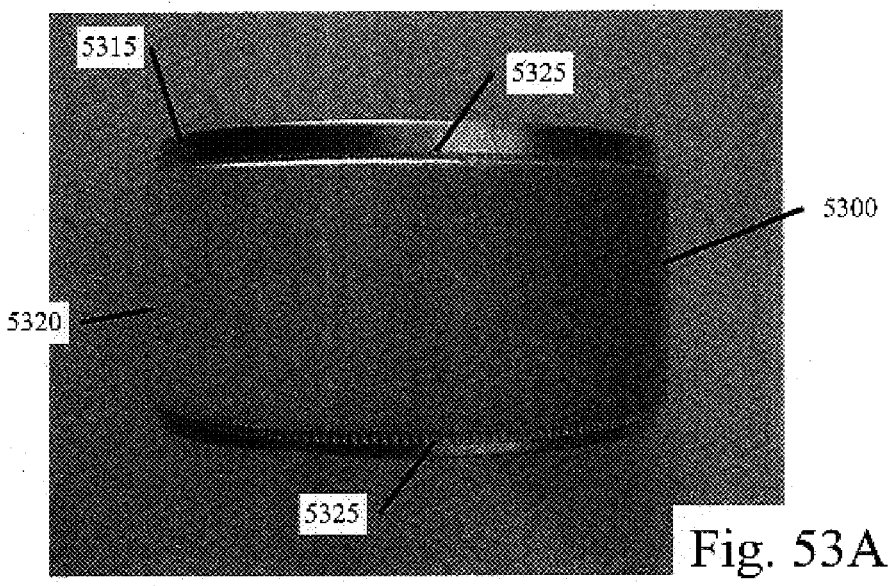
FIG. 53A is a perspective view of a wick subassembly that is a part of an evaporator of the heat transfer system of FIG. 47.
Figure 53C:
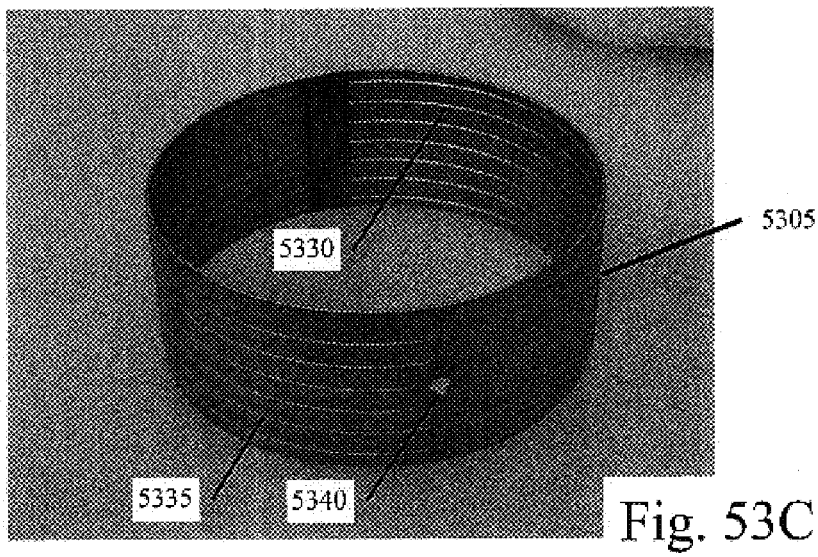
FIG. 53C is a perspective view of a liquid barrier wall that is a part of the evaporator of the heat transfer system of FIG. 47.
Figure 53B:
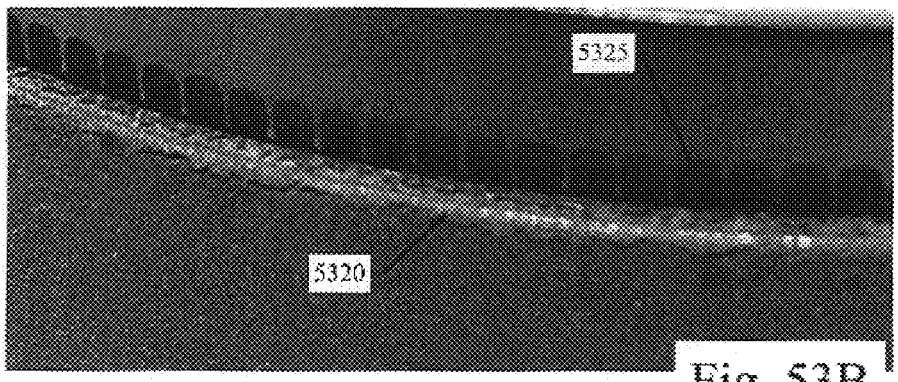
FIG. 53B is a perspective view of a portion of the wick subassembly of FIG. 53A.
Figure 53D:
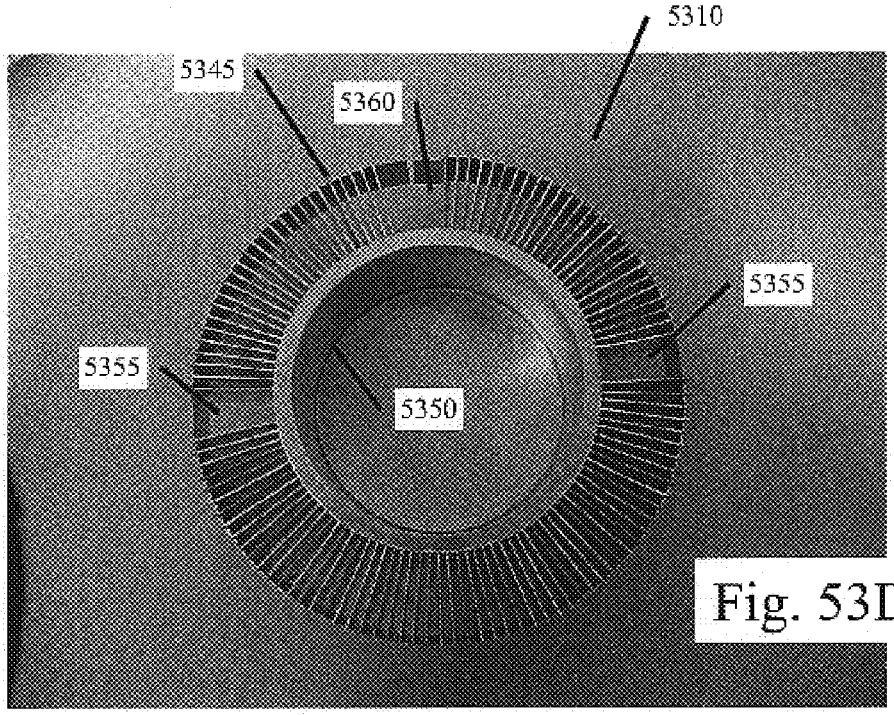
FIG. 53D is a perspective view of a subcooler that is a part of the evaporator of the heat transfer system of FIG. 47.
Figure 53E:
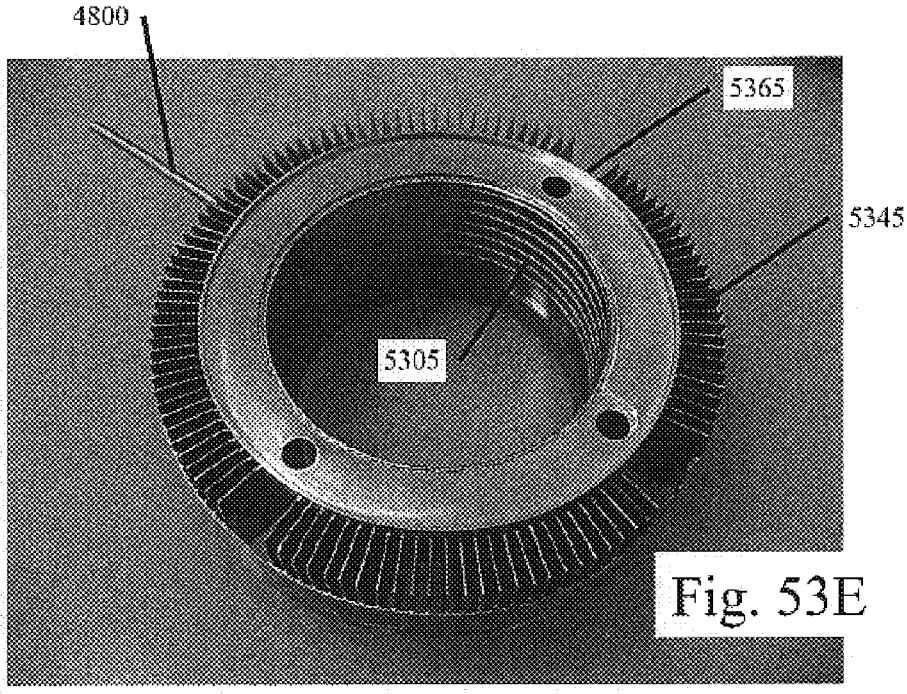
FIG. 53E is a perspective view of the evaporator of the heat transfer system of FIG. 47.

As discussed above with respect to the evaporator 1400, in one implementation, the wick 5320 and the vapor barrier wall 5315 are made of stainless steel. The wick 5320 has, prior to manufacture, a pore radius of about 9.8 microns, an outer diameter of about 4.141 inches, an inner diameter of about 3.985 inches, and a length of about 1.75 inches. The vapor barrier wall 5315 has, for example, 186 vapor removal channels 5325, with each channel 5325 formed as a semicircle having about a 0.025 inch radius (FIG. 53B). The vapor barrier wall 5315 has a thickness of about 0.035 inches.

The liquid barrier wall 5305 includes one or more liquid flow channels 5330 such as, for example, the liquid flow channels 1505 of the wall 1500 of FIGS. 14A–H. The liquid flow channels 5330 are formed along an inner surface of the wall 5305. The liquid barrier wall 5305 can also include cooling grooves 5335 formed along an outer surface of the wall 5305 to provide additional convection cooling for the liquid. The liquid barrier wall 5305 also includes a liquid port 5340 for receiving liquid from the liquid line 4800.

The liquid barrier wall 5305 can be made of stainless steel and can have seven liquid flow channels 5330, with each channel 5330 having a radius of about 0.030 inches. The liquid barrier wall 5305 can have, prior to manufacture, an outer diameter of about 4.24 inches, an inner diameter of about 4.13 inches, and a length of about 1.69 inches.

The subcooler 5310 includes an array of fins 5345 that surround an inner body 5350. The fins 5345 and the inner body 5350 include openings 5355 for the vapor line 4805 and an opening 5360 for the reservoir port 4812. The subcooler 5310 can be made from copper or any other suitable heat transferring metal. The subcooler 5310 can be designed with, for example, 119 fins. The inner body 5350 can have an outer diameter of, for example, 4.25 inches and have a length of 1.57 inches.

The evaporator 4713 also includes a reservoir plate 5365 (FIG. 53E) that is sealed to an edge of the liquid barrier wall 5305, as shown in more detail below. The reservoir plate 5365 is in fluid communication with the reservoir 4810 and the vapor line 4805.

Figure 54:
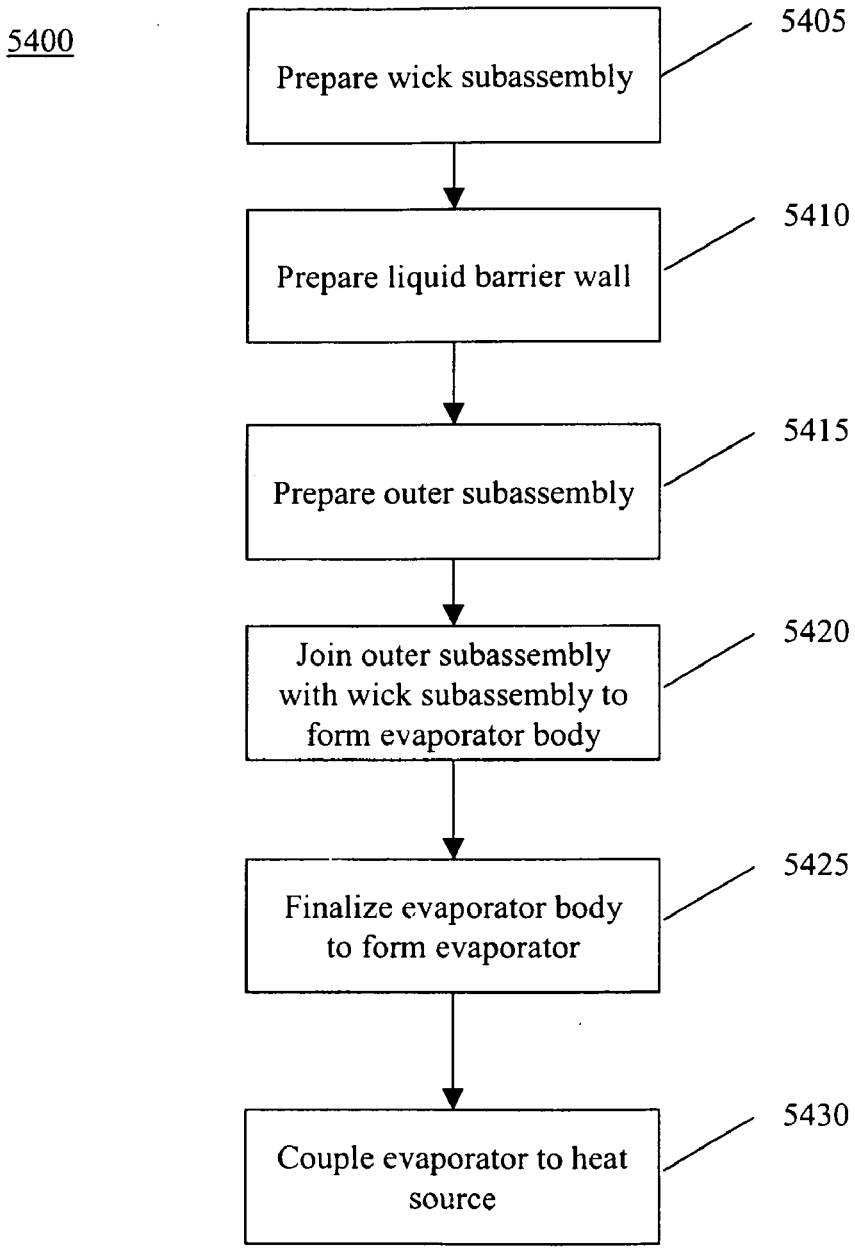
FIG. 54 is a flow chart of a procedure for manufacturing the thermodynamic system of FIG. 47, including a procedure for manufacturing the heat transfer system of FIG. 47.

Referring to FIG. 54, a procedure 5400 is performed for manufacturing the thermodynamic system 4700 of FIG. 47. Initially, the wick subassembly 5300 (that is, the vapor barrier wall 5315 and the wick 5320) is prepared (step 5405). Next, the liquid barrier wall 5305 is prepared (step 5410). The outer subassembly (that is, the liquid barrier wall 5305 and the subcooler 5310) is then prepared (step 5415) and the prepared outer subassembly is joined with the wick subassembly to form the evaporator body (step 5420). Next, the evaporator body is finalized to form the evaporator 4713 (step 5425) and the evaporator 4713 is coupled to the heat source (for example, the cyclical heat exchange system) (step 5430).

Figure 15A:
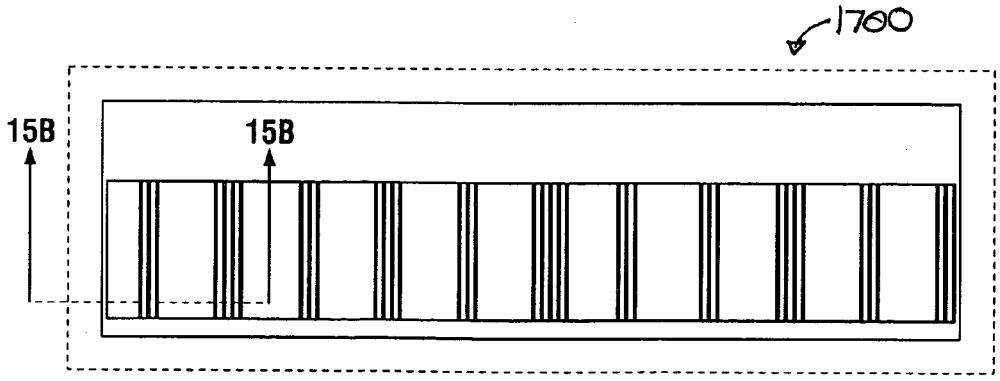
FIG. 15A is a flat detail view of the vapor barrier wall formed into a shell ring component of the annular evaporator of FIG. 14A.
Figure 15B:
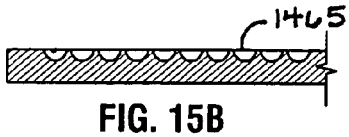
FIG. 15B is a cross-sectional view of the vapor barrier wall of FIG. 15A taken along line 15B—15B.
Figure 16A:
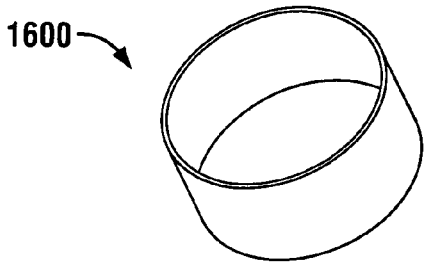
FIG. 16A is a perspective view of a primary wick of the annular evaporator of FIG. 14A.
Figure 16B:
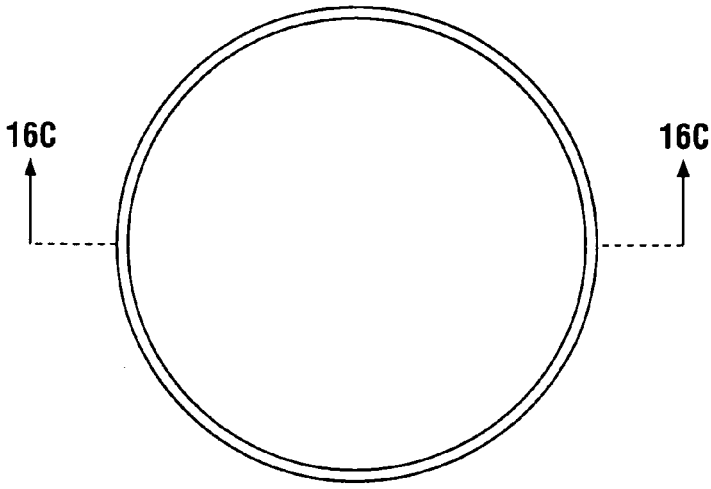
FIG. 16B is a top view of the primary wick of FIG. 16A.
Figure 16C:
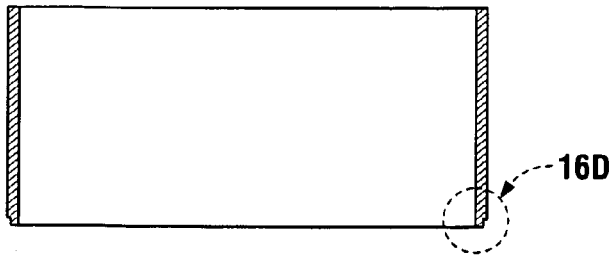
FIG. 16C is a cross-sectional view of the primary wick of FIG. 16B taken along line 16C—16C.
Figure 16D:
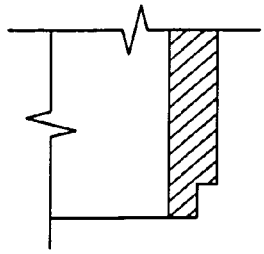
FIG. 16D is an enlarged view of a portion of the primary wick of FIG. 16C.
Figure 17A:
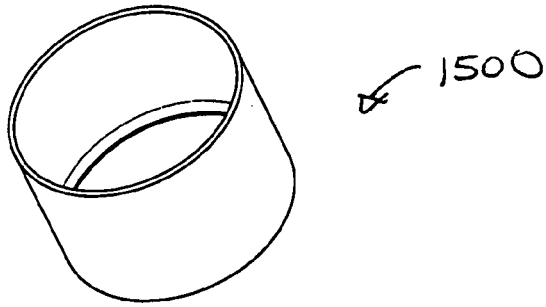
FIG. 17A is a perspective view of a liquid barrier wall formed into an annular ring of the annular evaporator of FIG. 14A.
Figure 17B:
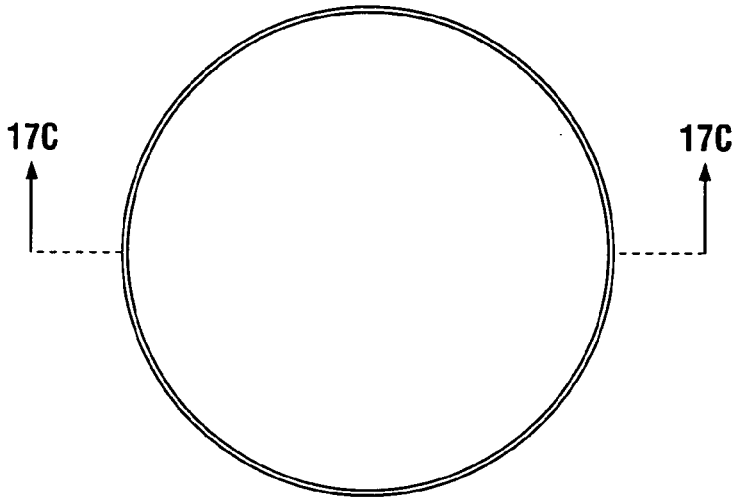
FIG. 17B is a top view of the liquid barrier wall of FIG. 17A.
Figure 17C:
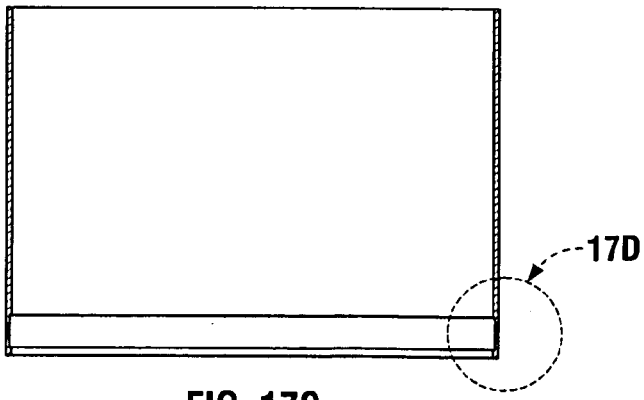
FIG. 17C is a cross-sectional view of the liquid barrier wall of FIG. 17B taken along line 17C—17C.
Figure 17D:
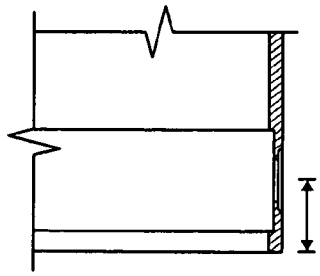
FIG. 17D is an enlarged view of a portion of the liquid barrier wall of FIG. 17C.
Figure 18A:
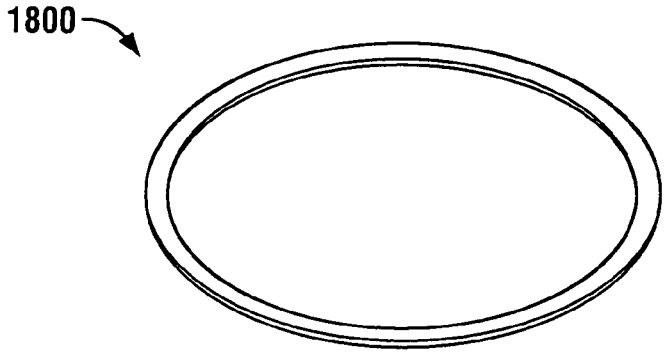
FIG. 18A is a perspective view of a ring separating the liquid barrier wall of FIG. 17A from the vapor barrier wall of FIG. 15A.
Figure 18B:
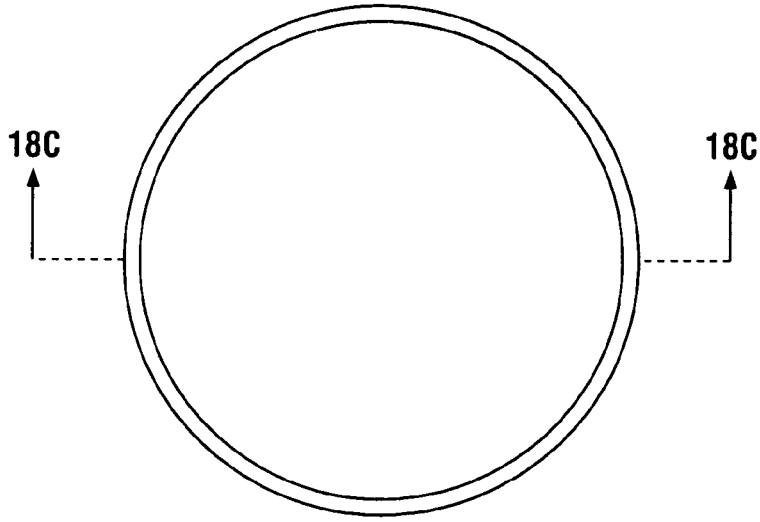
FIG. 18B is a top view of the ring of FIG. 18A.
Figure 18C:
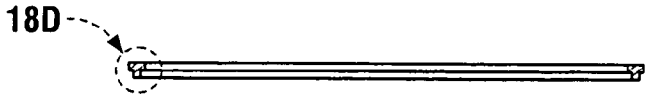
FIG. 18C is a cross-sectional view of the ring of FIG. 18B taken along line 18C—18C.
Figure 18D:
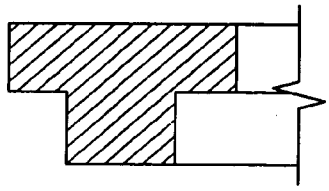
FIG. 18D is an enlarged view of a portion of the ring of FIG. 18C.
Figure 19A:
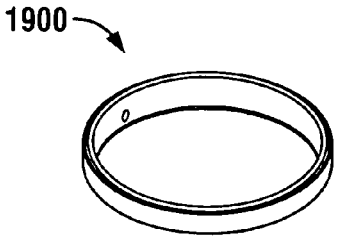
FIG. 19A is a perspective view of a ring of the annular evaporator of FIG. 14A.
Figure 19B:
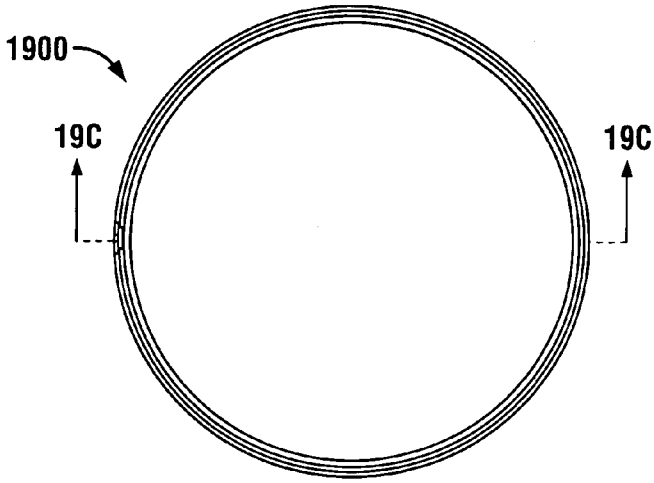
FIG. 19B is a top view of the ring of FIG. 19A.
Figure 19C:
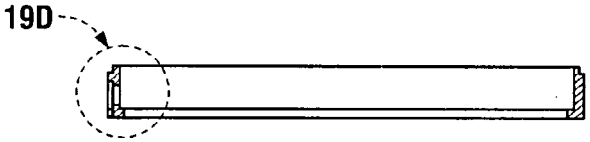
FIG. 19C is a cross-sectional view of the ring of FIG. 19B taken along 19C—19C.
Figure 19D:
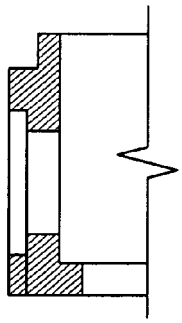
FIG. 19D is an enlarged view of a portion of the ring of FIG. 19C.
Figure 55:
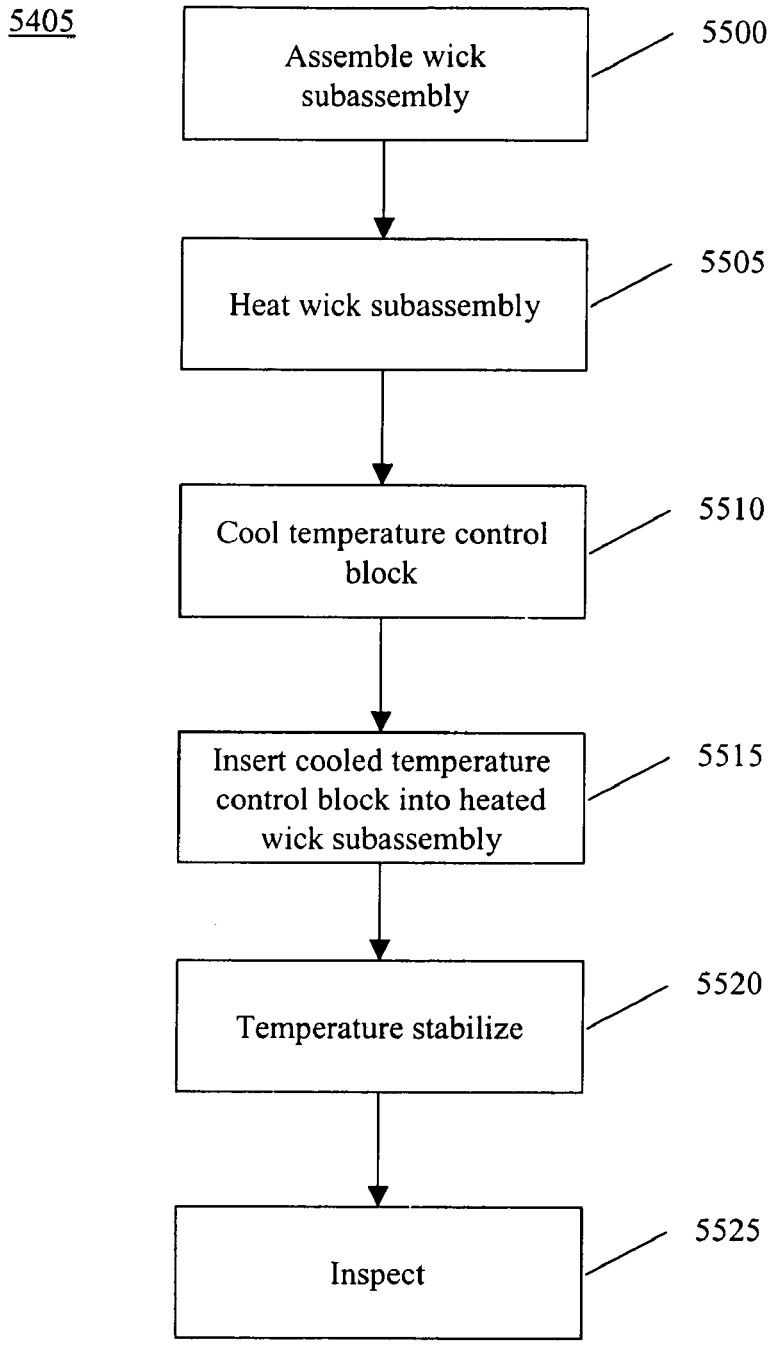
FIG. 55 is a flow chart of a procedure for preparing the wick subassembly of FIGS. 53A and B.

Referring to FIG. 55, a procedure 5405 is performed for preparing the wick subassembly 5300. Initially, the wick subassembly 5300 is assembled (step 5500). Assembly of the wick subassembly 5300 includes forming the vapor removal channels 5325 the material that will form the vapor barrier wall 5315 (FIGS. 15A and 15B show the material used for forming the vapor barrier wall 5315). For example, the vapor removal channels 5325 can be photoetched into the material. The photoetched material is rolled into a cylindrical form and then welded at its edges to form the vapor barrier wall 5315. The wick 5320 is formed from a wick material that is cut to a suitable length, rolled, and formed around the vapor barrier wall 5315. The wick 5320 is mechanically squeezed onto the vapor barrier wall 5315 to improve the fit between the wick 5320 and the vapor barrier wall 5315 and to reduce the space between the wick 5320 and the wall 5315, thus improving thermal transfer between the wick 5320 and the vapor barrier wall 5315. Next, the wick is welded at its seams to form a complete cylindrical form.

In another implementation, the wick 5320 also may be sintered onto the vapor barrier wall 5315 by heating the wick 5320 and the wall 5315 at a temperature that is below the melting point of the materials used in the wick 5320 and the wall 5315. During this heating, pressure may be applied to the wick 5320 and to the wall 5315 to help form the sintered bond. Sintering can be used to further improve the thermal transfer between the wick 5320 and the vapor barrier wall 5315.

Figure 56A:
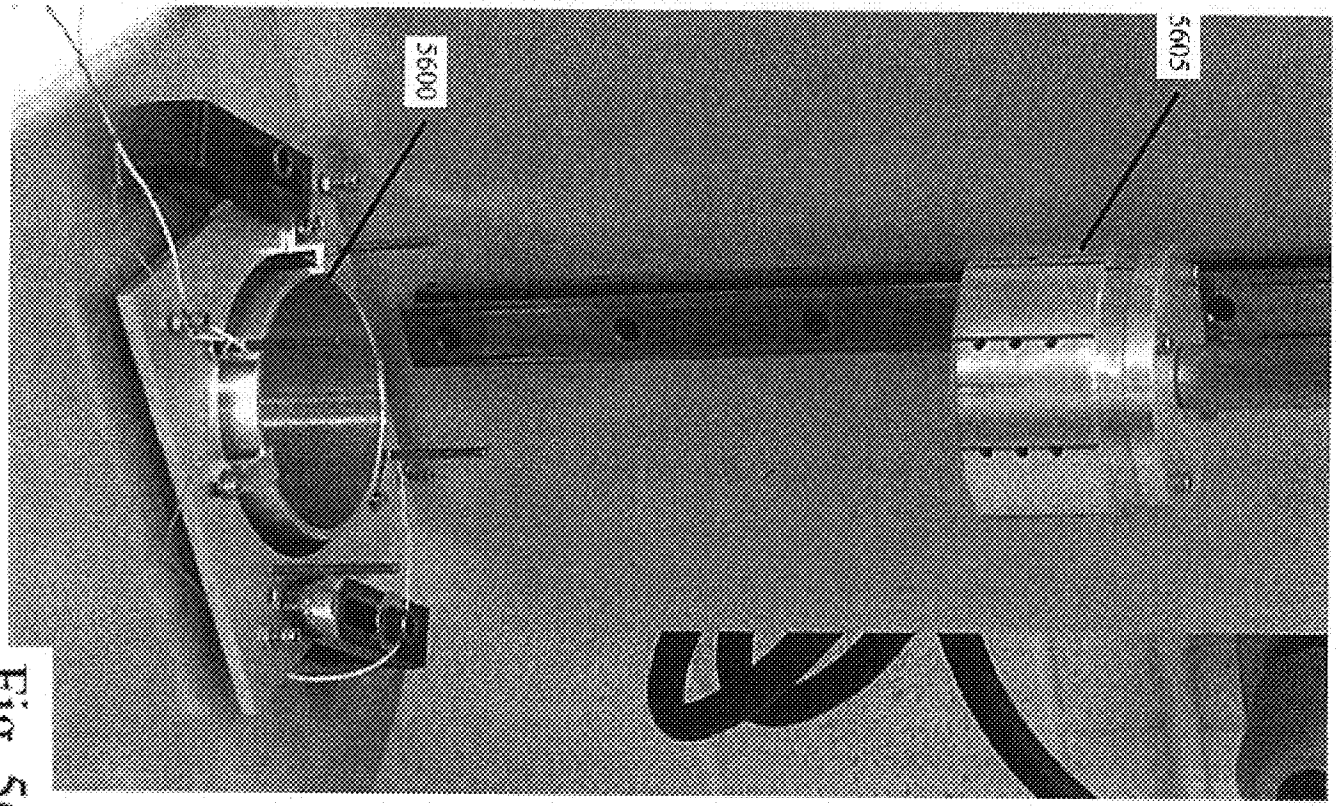
FIGS. 56A–56E are perspective views showing steps in the procedure of FIG. 55.
Figure 56B:
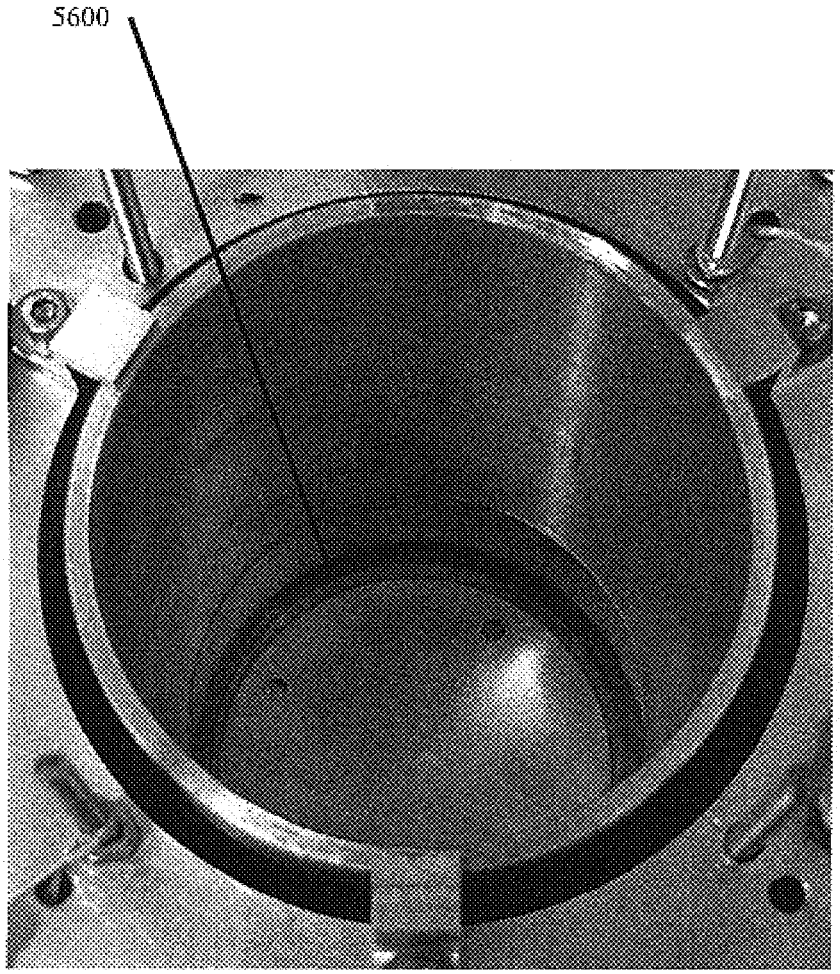
Figure 56C:
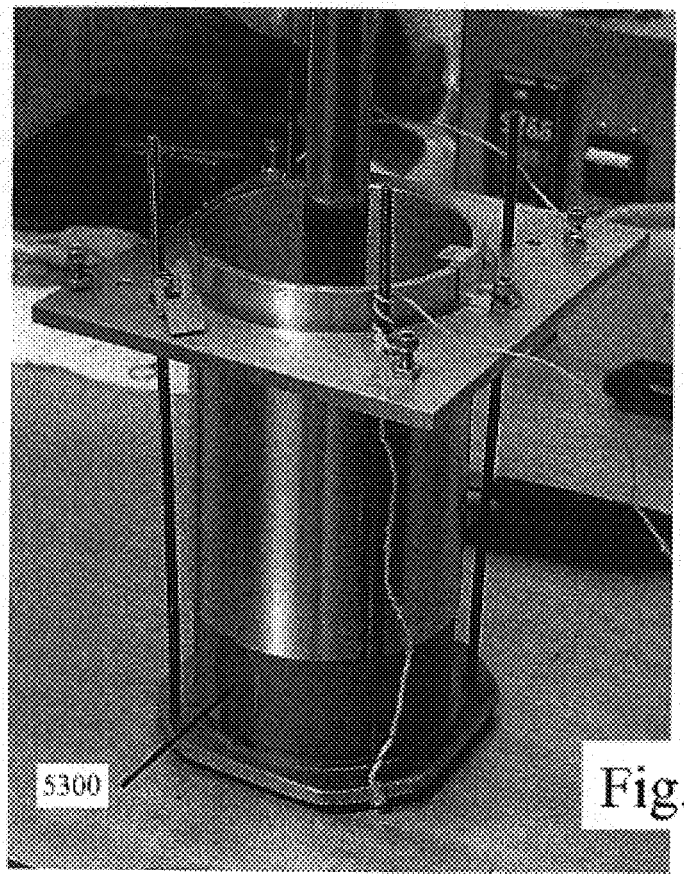
Figure 56D:
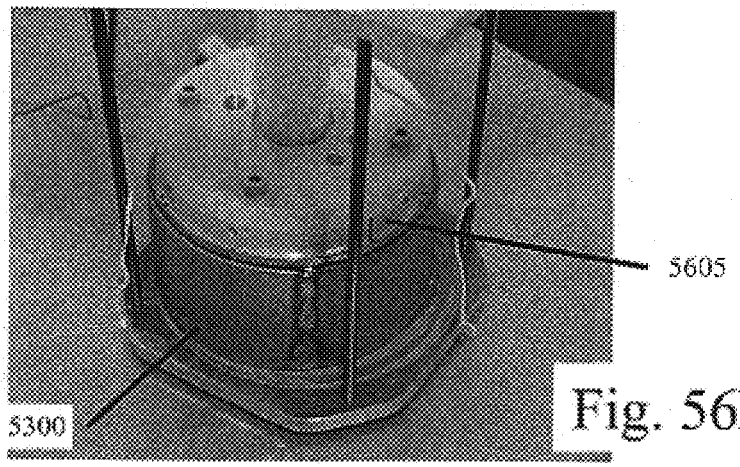
Figure 56E:
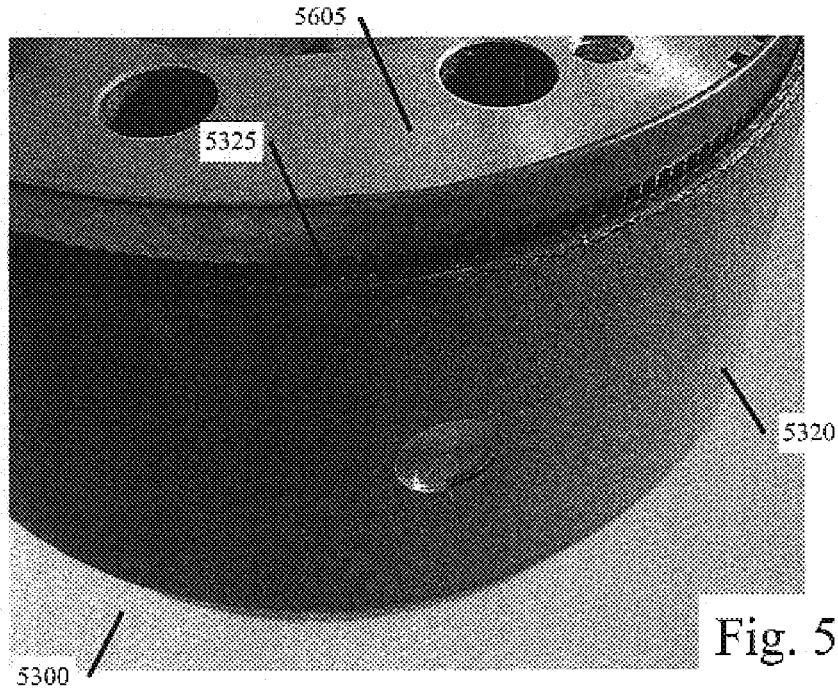

After the wick subassembly 5300 is assembled (step 5500), the wick subassembly is heat shrunk to ensure that it is as round as needed to properly join with the outer subassembly at step 5420. Initially during the heat shrink process, the wick subassembly 5300 is heated (step 5505). In one implementation, the subassembly 5300 is placed in a furnace 5600 (shown in FIGS. 56A and B) that heats the subassembly to 460° C.±15° C. Next, as also shown in FIG. 56A, a temperature control block 5605 is cooled to a temperature at which its outer diameter is smaller than the inner diameter of the heated subassembly 5300 (step 5510). The temperature control block 5605 can be cooled using liquid nitrogen. Referring also to FIGS. 56C and D, the cooled temperature control block 5605 is inserted into the heated wick subassembly 5300 (step 5515). Next, as shown in FIG. 56E, upon insertion of the control block 5605 (step 5515), the heat is removed from the wick subassembly 5300 and the cooling is removed from the temperature control block 5605, thus permitting the temperature of the wick subassembly 5300 to stabilize (step 5520). After the temperature of the wick subassembly 5300 has stabilized (step 5520), the wick subassembly 5300 is inspected to ensure that the outer diameter of the wick subassembly 5300 is as round as needed (step 5525).

Figure 57:
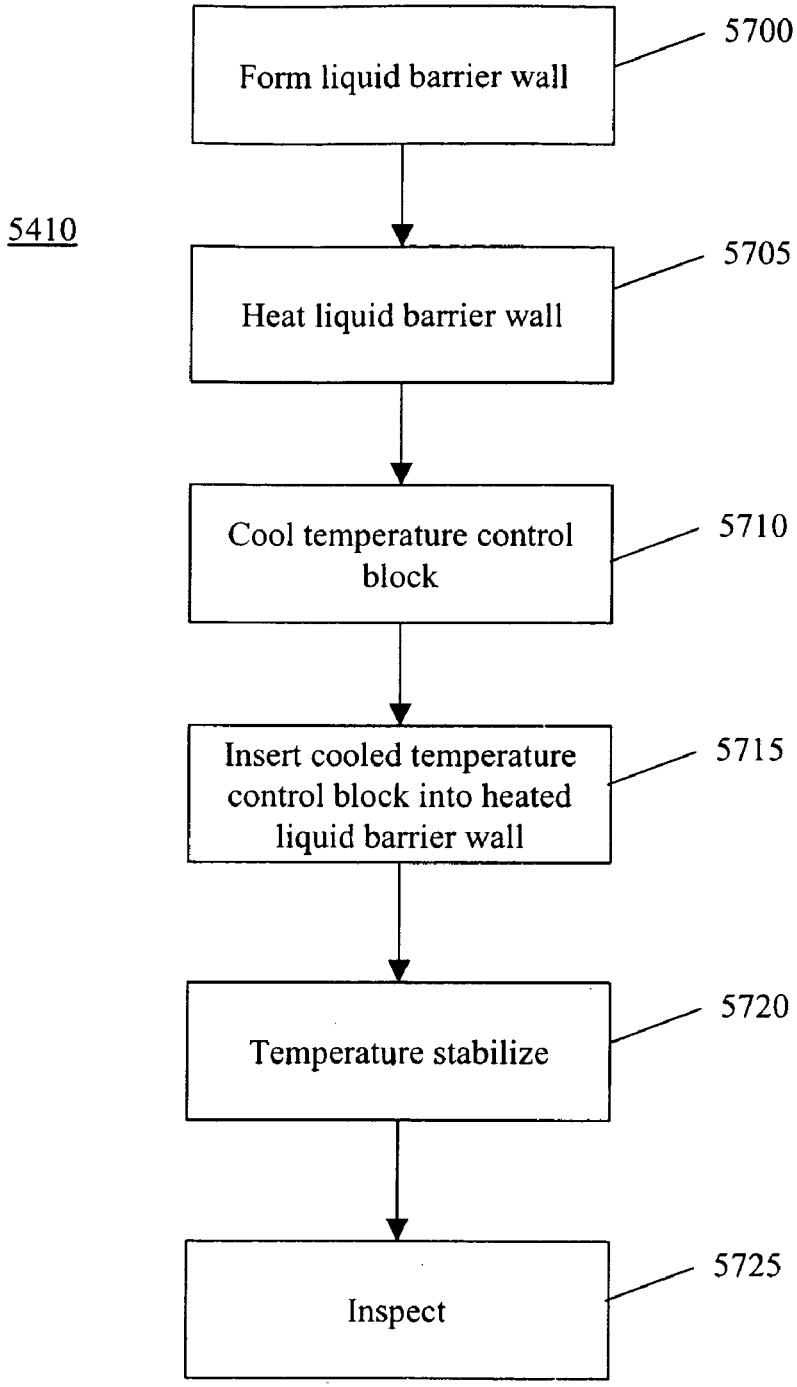
FIG. 57 is a flow chart of a procedure for preparing the liquid barrier wall of FIG. 53C.

Referring to FIG. 57, a procedure 5410 is performed for preparing the liquid barrier wall 5305. Initially, the liquid barrier wall 5305 is formed (step 5700) by rolling the material and then welding the material at the seam to form a nearly cylindrical shape (FIG. 53C). Then, the welded material is photoetched on its inner surface to form the liquid flow channels 5330 and is photoetched on its outer surface to form the cooling grooves 5335 (FIG. 53C).

Figure 58A:
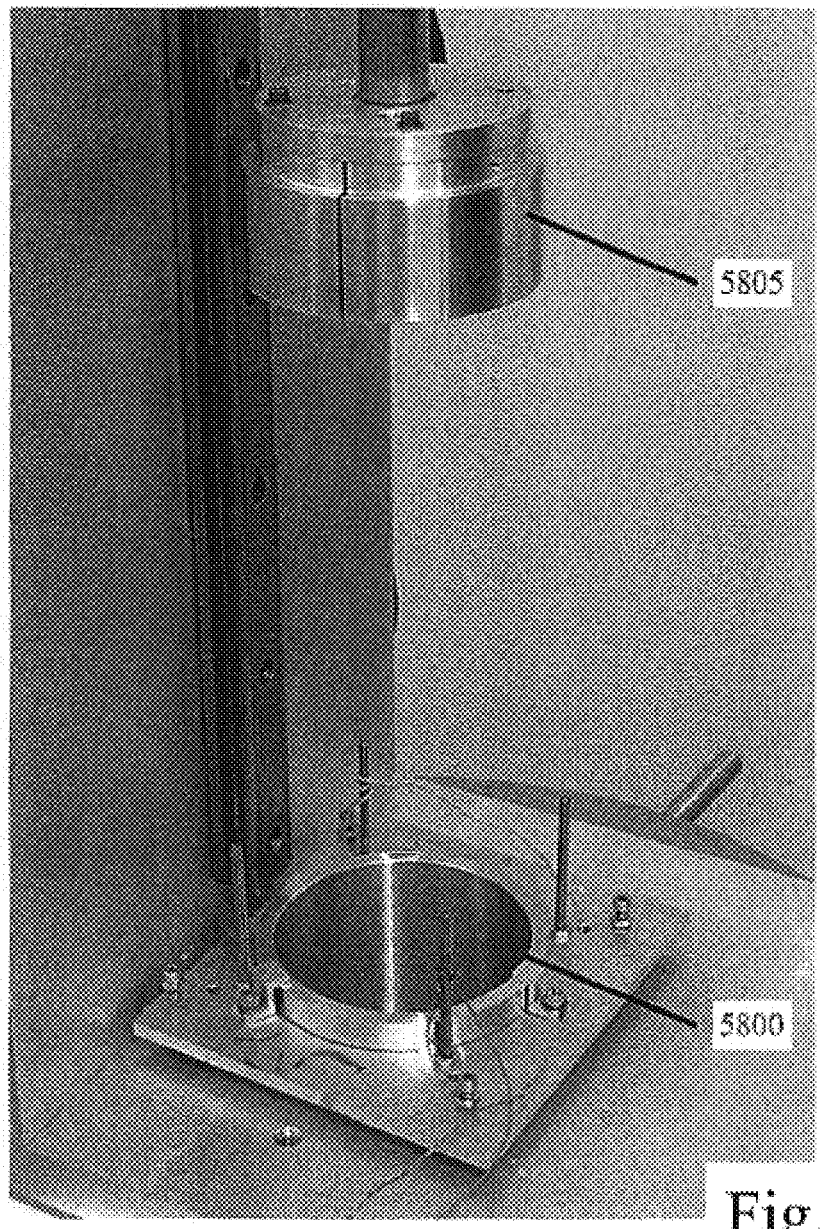
FIGS. 58A–58E are perspective views showing steps in the procedure of FIG. 57.
Figure 58B:
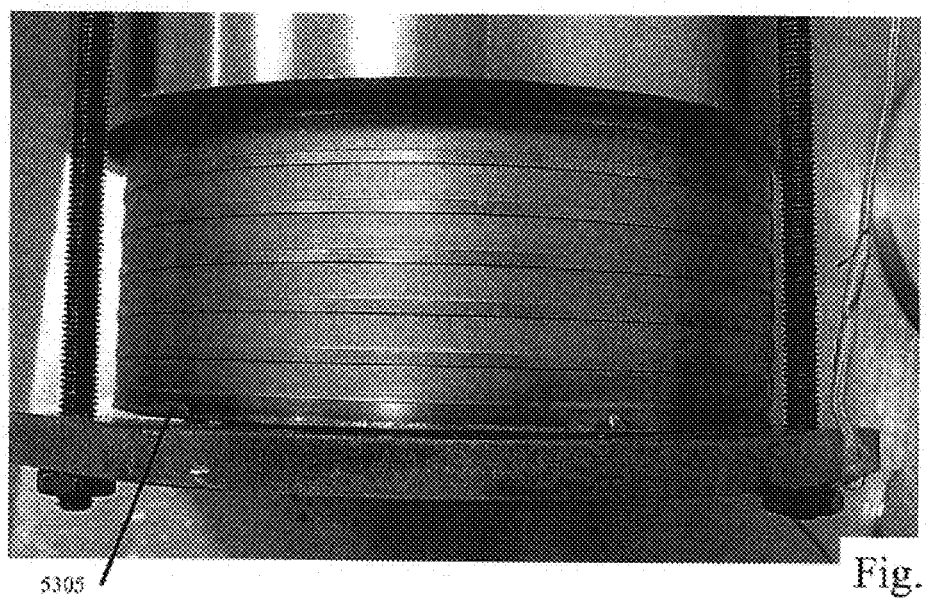
Figure 58C:
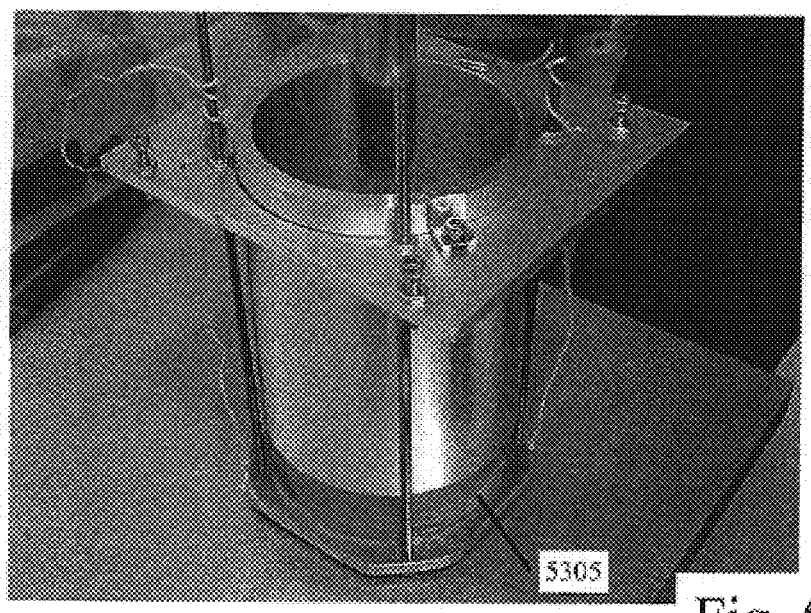
Figure 58D:
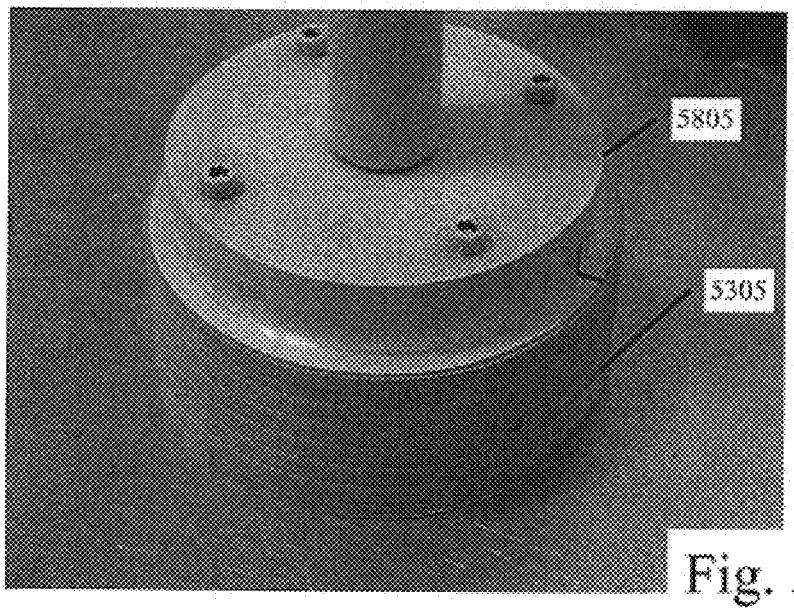
Figure 58E:
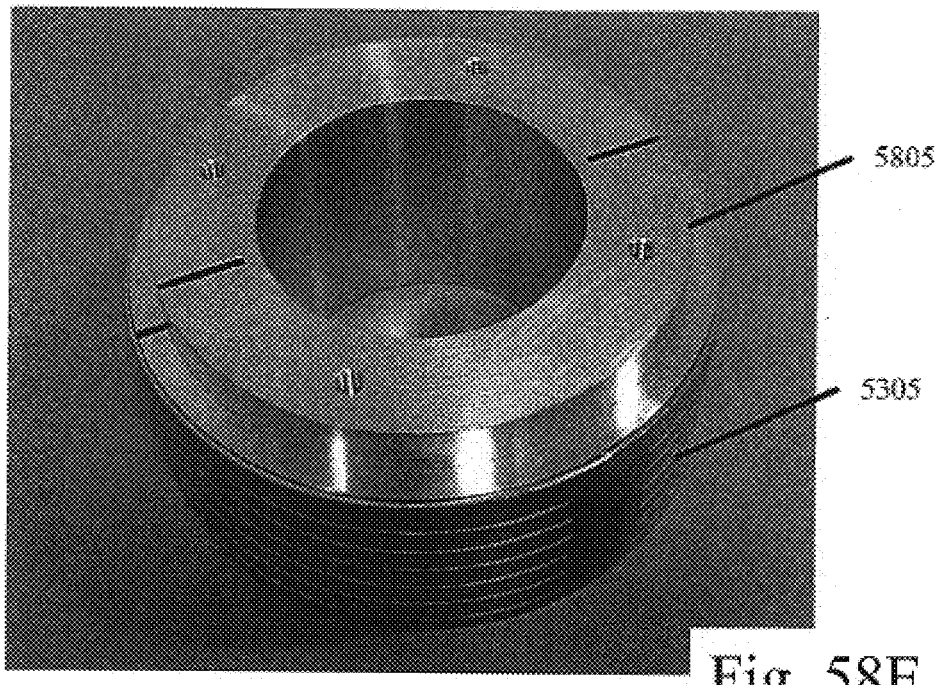

The formed liquid barrier wall 5305 is heat shrunk to ensure that it is as round as needed to properly prepare the outer subassembly at step 5415. Initially during the heat shrink process, the liquid barrier wall 5305 is heated (step 5705). In one implementation, the liquid barrier wall 5305 is placed in a furnace 5800 (shown in FIGS. 58A and B) that heats the wall 5305 to 460° C.±15° C. Next, as also shown in FIG. 58A, a temperature control block 5805 is cooled to a temperature at which its outer diameter is smaller than the inner diameter of the vapor barrier wall 5305 (step 5710). The temperature control block 5805 can be cooled using liquid nitrogen. Referring also to FIGS. 58C and D, the cooled temperature control block 5605 is inserted into the heated liquid barrier wall 5305 (step 5715). Next, as shown in FIG. 58E, upon insertion of the control block 5805, the heat is removed from the liquid barrier wall 5305 and the cooling is removed from the temperature control block 5805, thus permitting the temperature of the liquid barrier wall 5305 to stabilize (step 5720). After the temperature of the liquid barrier wall 5305 has stabilized, the liquid barrier wall 5305 is inspected to ensure that the outer diameter of the wall 5305 is as round as needed (step 5725).

Figure 59:
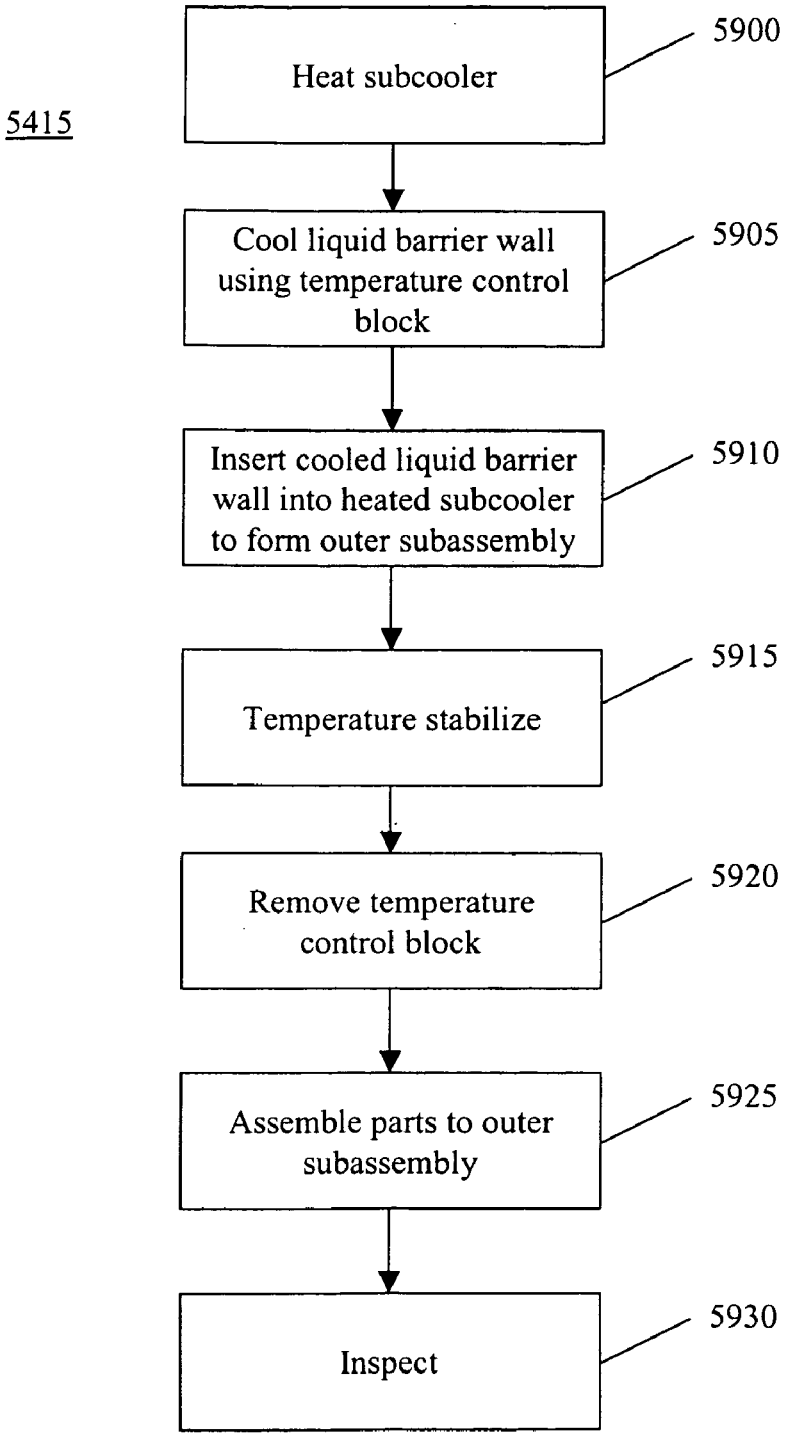
FIG. 59 is a flow chart of a procedure for preparing an outer subassembly of the evaporator of the heat transfer system of FIG. 47.
Figure 60A:
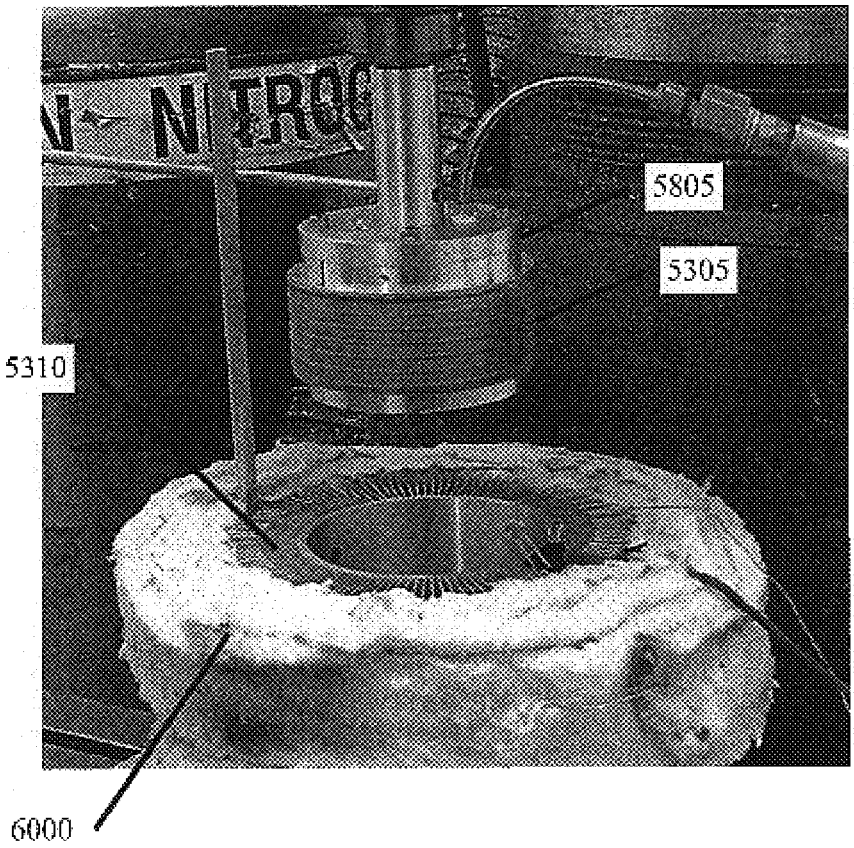
FIGS. 60A–60G are perspective views showing steps in the procedure of FIG. 59.
Figure 60B:
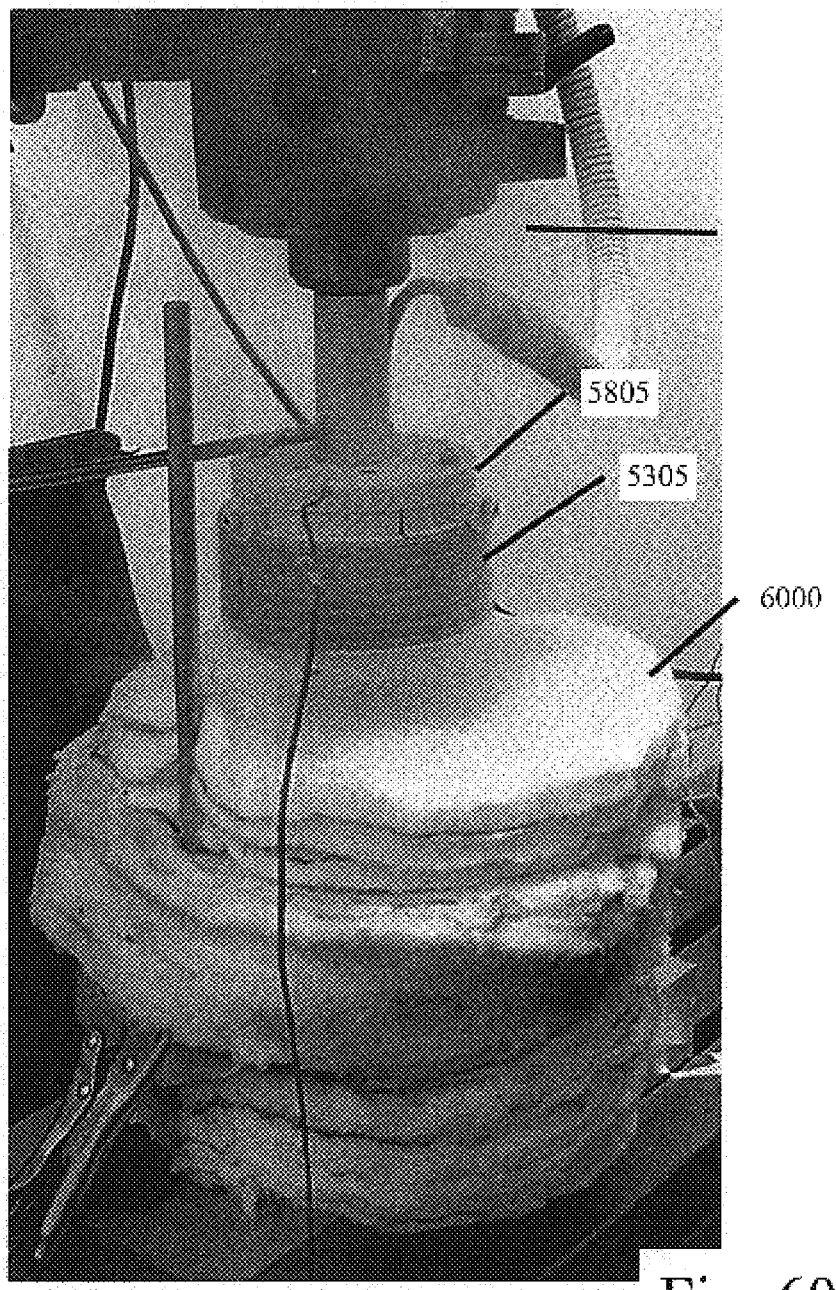
Figure 60C:
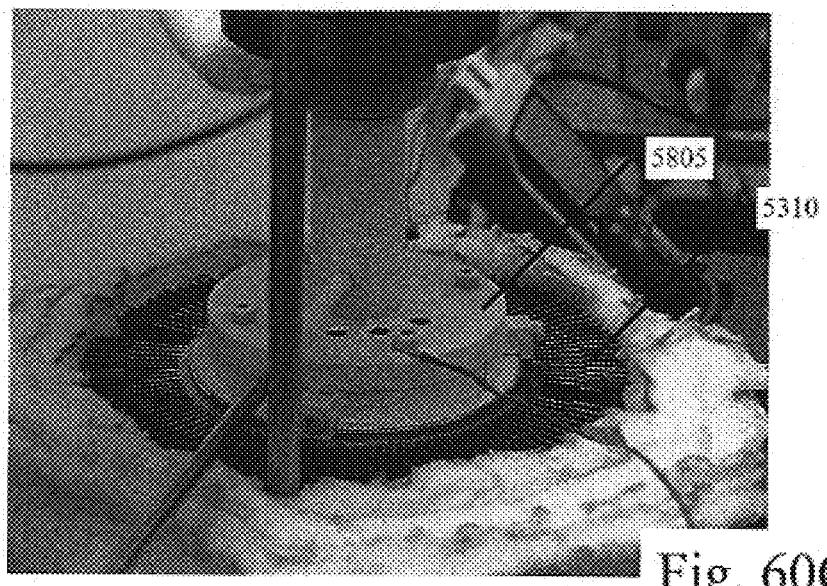
Figure 60D:
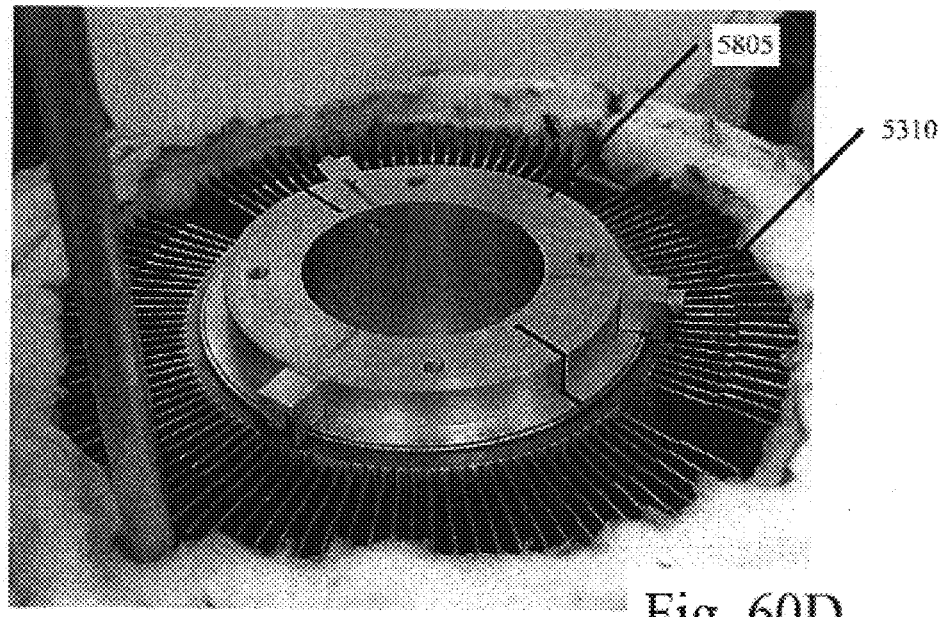
Figure 60E:
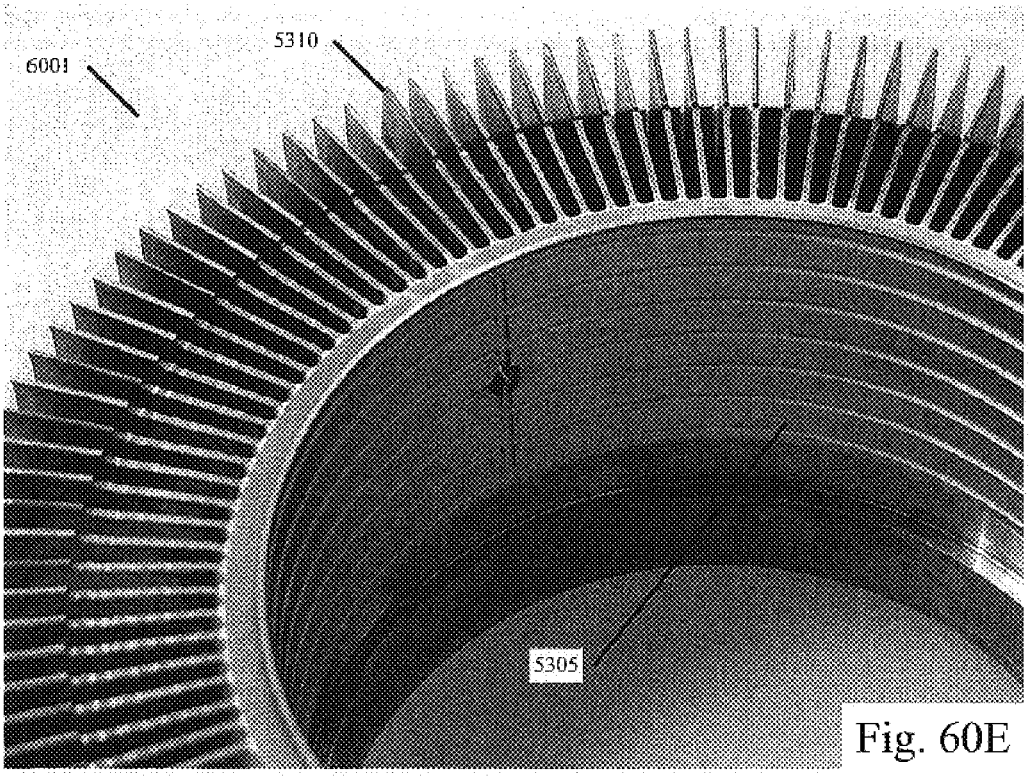

Referring to FIG. 59, a procedure 5415 is performed for preparing the outer subassembly, that is, the liquid barrier wall 5305 and the subcooler 5310. Initially, the subcooler 5310 is heated (step 5900). In one implementation, the subcooler 5310 is placed in a furnace 6000 (shown in FIGS. 60A and B) that heats the subcooler 5310 to 235° C.±15° C. Next, as also shown in FIGS. 60A and B, the temperature control block 5805, and liquid barrier wall 5305, which is thermally coupled to the block 5805, are cooled to a temperature at which the outer diameter of the wall 5305 is smaller than the inner diameter of the subcooler 5310 (step 5905). For example, the liquid barrier wall 5305 can be cooled to below about −120° C. The temperature control block 5805 can be cooled using liquid nitrogen. Referring also to FIG. 60C, the cooled temperature control block 5805 and liquid barrier wall 5305 are inserted into the heated subcooler 5310 to form the outer subassembly 6001 (step 5910). Next, as shown in FIG. 60D, upon insertion of the control block 5805 (step 5910), the heat is removed from the subcooler 5310 and the cooling is removed from the temperature control block 5805, thus permitting the temperature of the outer subassembly 6001 to stabilize (step 5915). After the temperature of the outer subassembly 6001 has stabilized (step 5915), the temperature control block 5805 is removed from the liquid barrier wall 5305 (step 5920), as shown in FIG. 60E.

Figure 60F:
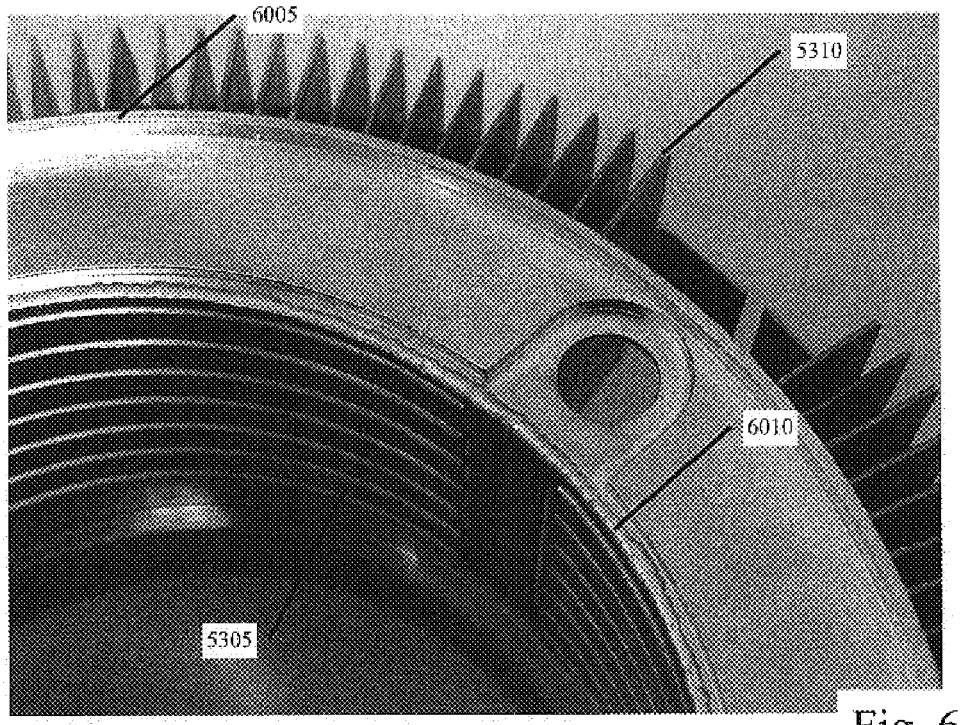
Figure 60G:
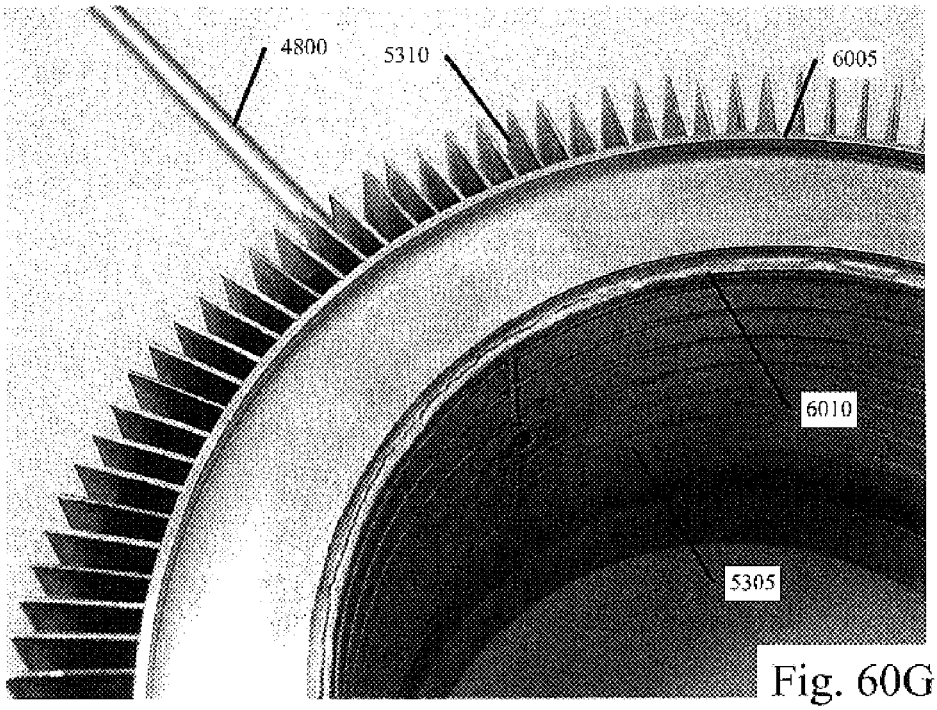

Next, referring also to FIGS. 60F and G, various parts are assembled to the outer subassembly 6001 (step 5925). First, as shown in FIG. 60F, a reservoir plate 6005 is attached to the liquid barrier wall 5305 and is adjacent the subcooler 5310. The plate 6005 can be attached by welding the plate 6005 onto the wall 5305 to form a weld seam 6010. Second, as shown in FIG. 60G, the liquid line 4800 is sealed to the liquid barrier wall 5305 by, for example, welding. After assembly is complete, the outer subassembly and all of the welded joints are inspected to ensure that the seams are sealed and that the inner diameter of the wall 5305 is as round as needed to interfit with the wick subassembly later in the process (step 5930).

Figure 61:
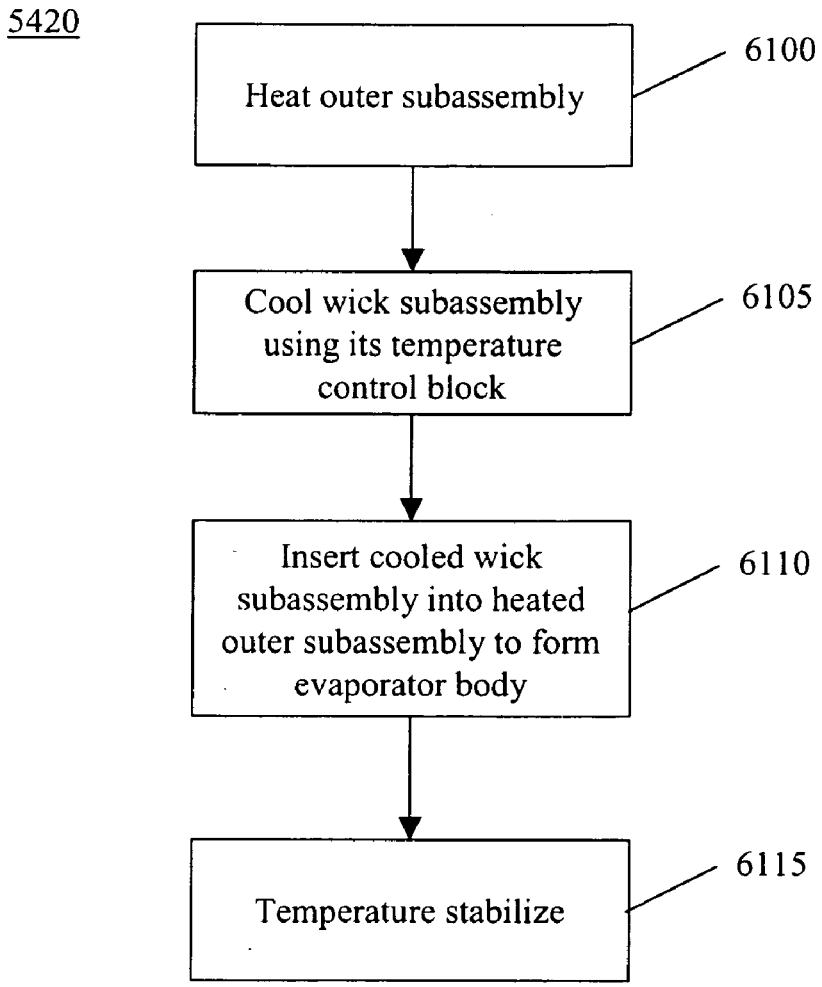
FIG. 61 is a flow chart of a procedure for joining the outer subassembly with the wick subassembly of the evaporator of the heat transfer system of FIG. 47.
Figure 62A:
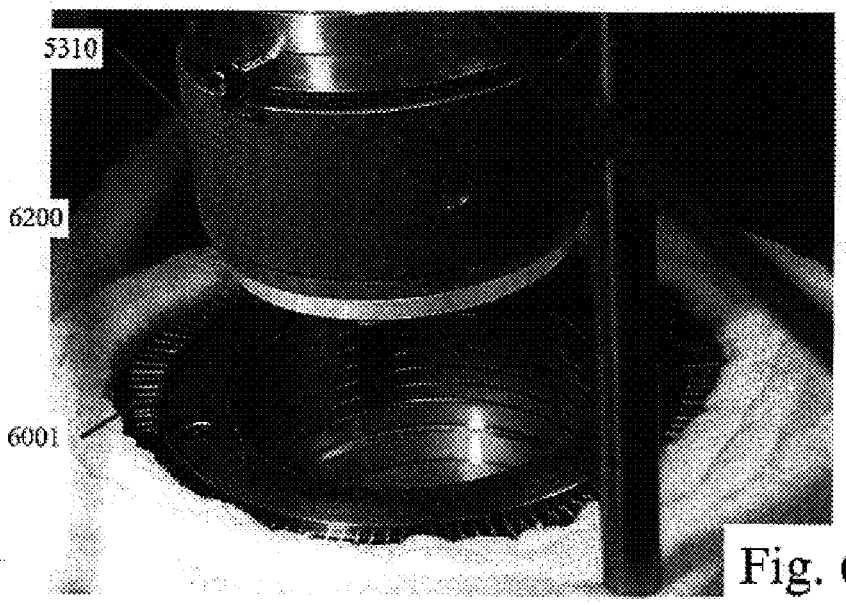
FIGS. 62A–62E are perspective views showing steps in the procedure of FIG. 61.
Figure 62B:
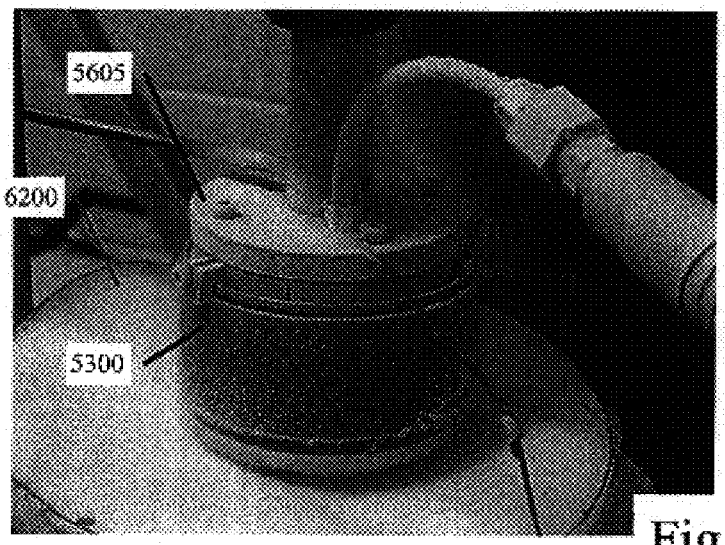
Figure 62C:
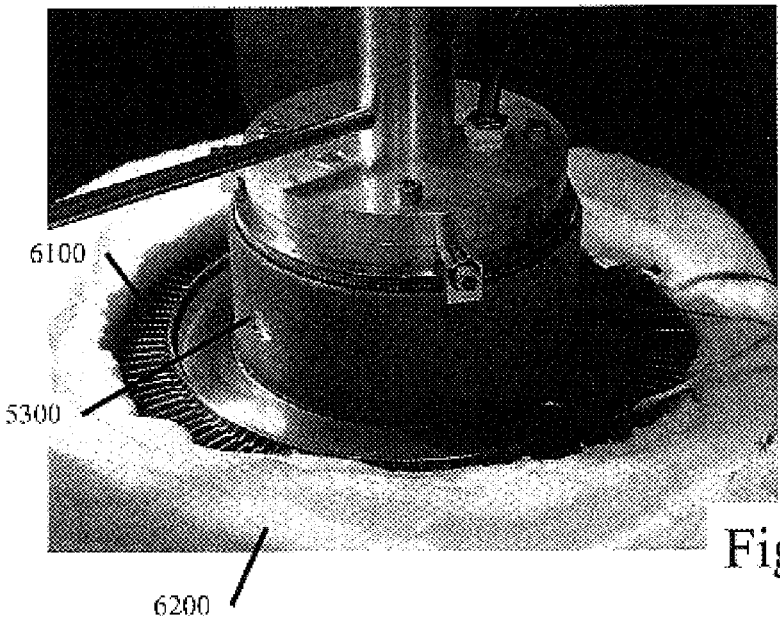
Figure 62D:
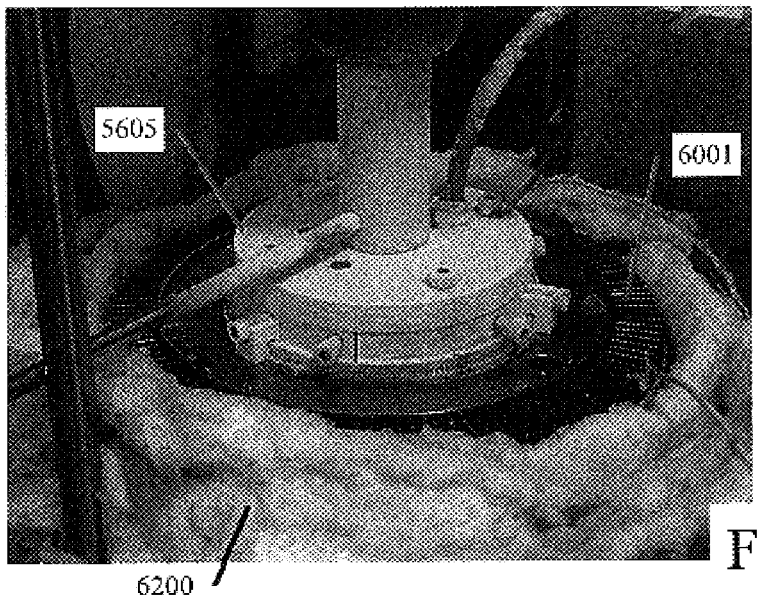
Figure 62E:
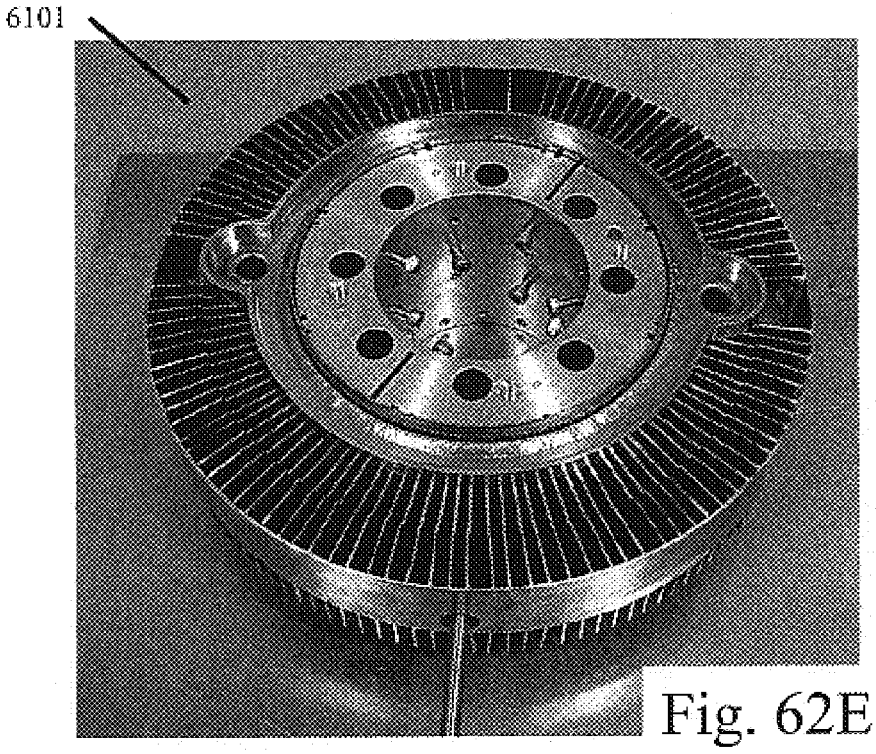

Referring to FIG. 61, a procedure 5420 is performed for joining the outer subassembly 6001 with the wick subassembly to form the evaporator body. In general, during this process, the outer subassembly 6001 is heat shrunk onto the wick subassembly 5300 to ensure that the pieces are properly joined. Initially, the outer subassembly 6001 is heated (step 6100). In one implementation, the outer subassembly 6001 is placed in a furnace 6200 (shown in FIG. 62A) that heats the outer subassembly 6001 to 350° C.±10° C. Next, as also shown in FIG. 62B, the temperature control block 5605 is cooled to a temperature at which the outer diameter of the wick subassembly 5300 is smaller than the inner diameter of the heated outer subassembly 6001 (step 6105). The temperature control block 5605 can be cooled using liquid nitrogen. Referring also to FIGS. 62C and D, the cooled temperature control block 5605 and wick subassembly 5300 is inserted into the heated outer subassembly 6001 to form the evaporator body 6101 (step 6110). Next, as shown in FIG. 62D, upon insertion of the control block 5605 and the wick subassembly 5300, the heat is removed from the outer subassembly 6001 and the cooling is removed from the temperature control block 5605, thus permitting the temperature of the evaporator body 6101 to stabilize (step 6115). Referring also to FIG. 62E, after the temperature of the evaporator body 6101 has stabilized, the evaporator body 6101 may be inspected to ensure that the heat shrink process was successful.

Figure 49:
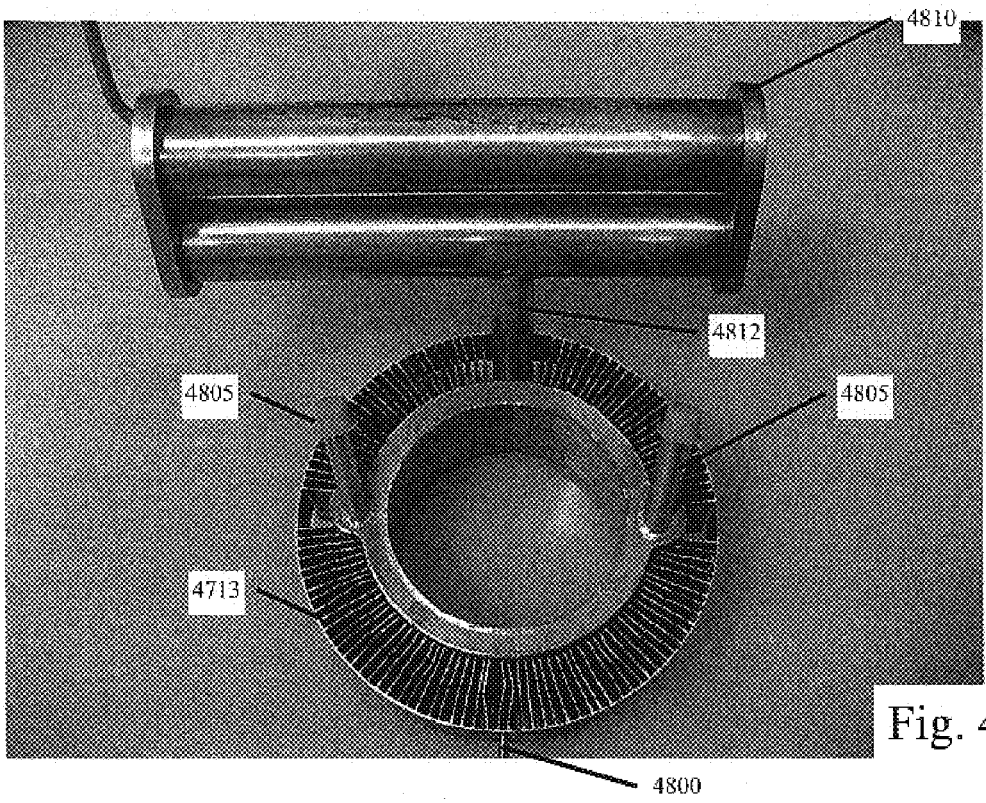
FIG. 49 is a perspective view of a portion of the heat transfer system of FIG. 47.
Figure 63:
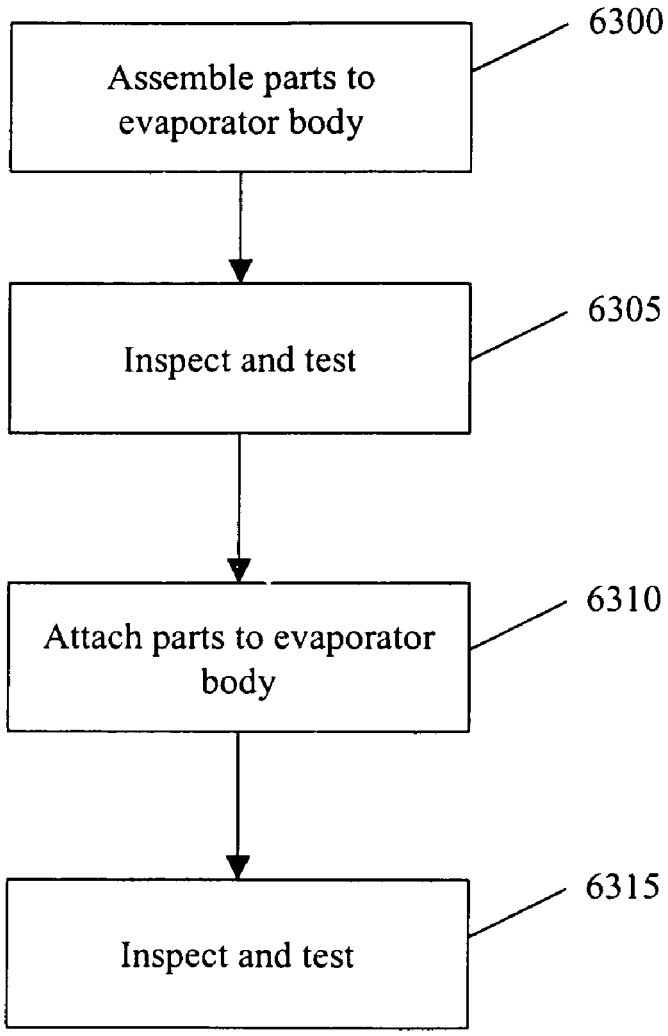
FIG. 63 is a flow chart of a procedure for finalizing an evaporator body formed during the procedure of FIG. 61.
Figure 64A:
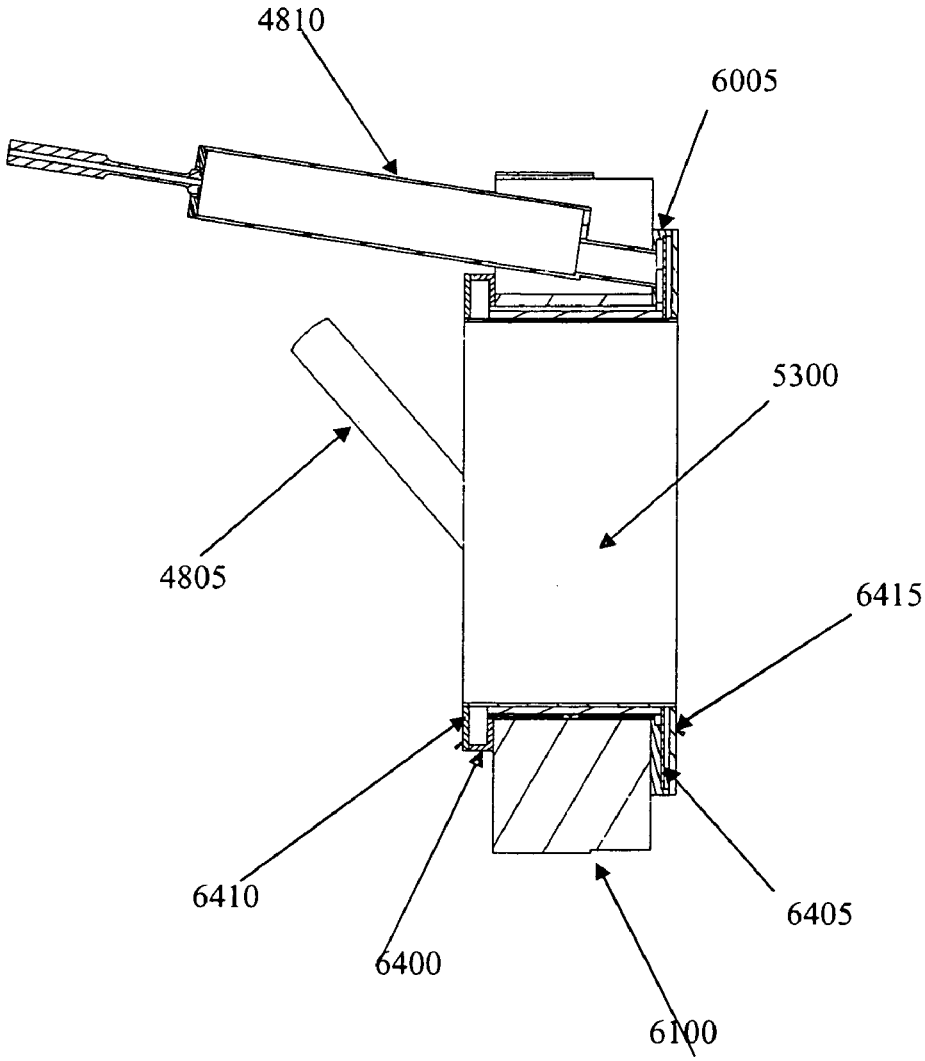
FIG. 64A is a side cross sectional view of the evaporator body showing the steps in the procedure of FIG. 63.

Referring to FIG. 63, a procedure 5425 is performed for finalizing the evaporator body 6101 to form the evaporator 4713. With reference to FIGS. 49 and 64, various parts are now assembled to the evaporator body 6101 (step 6300). For example, a volume plate 6400 is tacked to the liquid barrier wall 5305 and the wick 5320 and tubes are welded to the reservoir plate 6005 and the volume plate 6400. The reservoir 4810 is welded to the reservoir plate 6005 and a vapor barrier plate 6405 is welded to the reservoir plate 6005 and to the wick subassembly 5300. Caps 6410 and 6415 are placed over the volume plate 6400 and the vapor barrier plate 6405, respectively. Next, the evaporator body 6101 is inspected and tested (step 6305) and then additional parts are attached to the evaporator body 6101 (step 6310). For example, the vapor line 4805 is welded to the cap 6410 and the cap 6410 is machined as needed due to possible warpage during welding. The cap 6410 is welded to the volume plate 6400 and to the vapor barrier wall 5315 and the cap 6415 is welded to the reservoir plate 6005 and to the vapor barrier wall 5315. Next, the evaporator body 6101 is inspected for leaks (step 6315).

Figure 65:
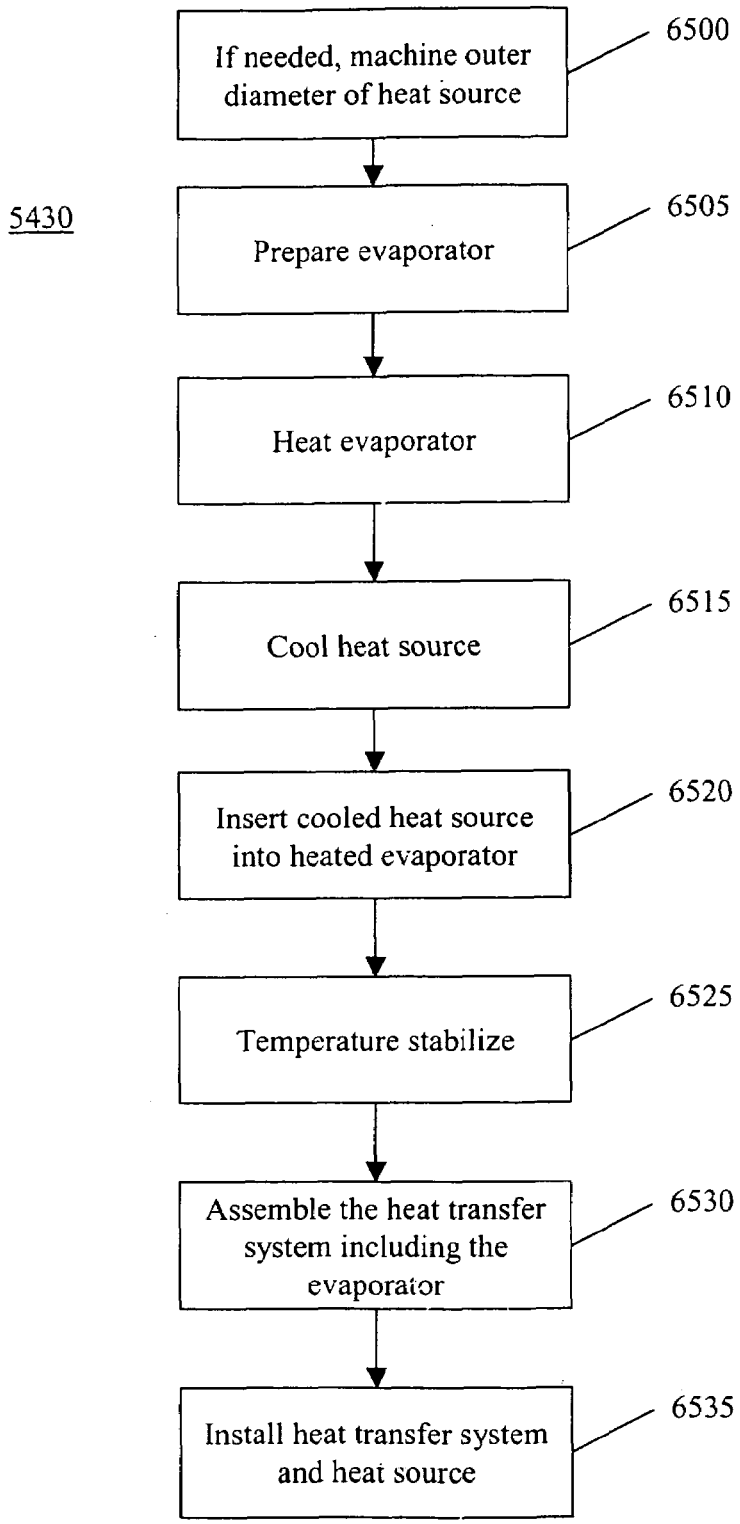
FIG. 65 is a flow chart of a procedure for coupling the evaporator finalized during the procedure of FIG. 63 to the cyclical heat exchange system of FIG. 47.
Figure 66A:
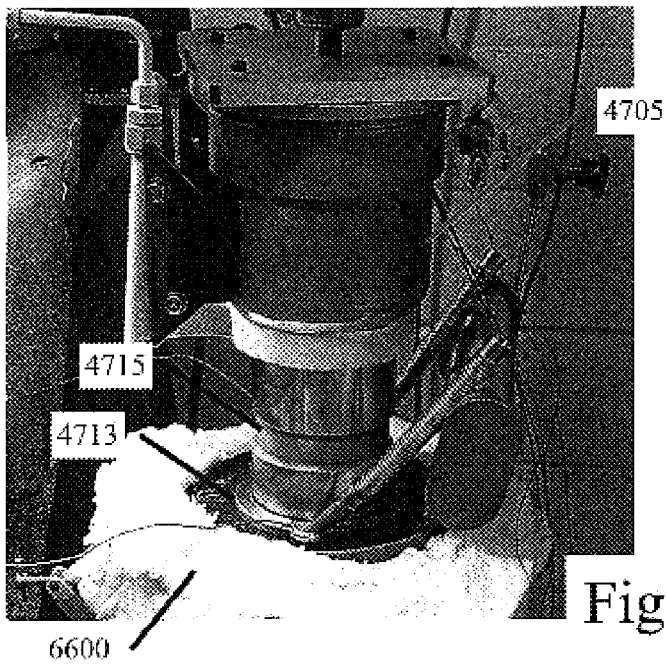
FIGS. 66A and 66B are perspective views showing steps in the procedure of FIG. 65.
Figure 66B:
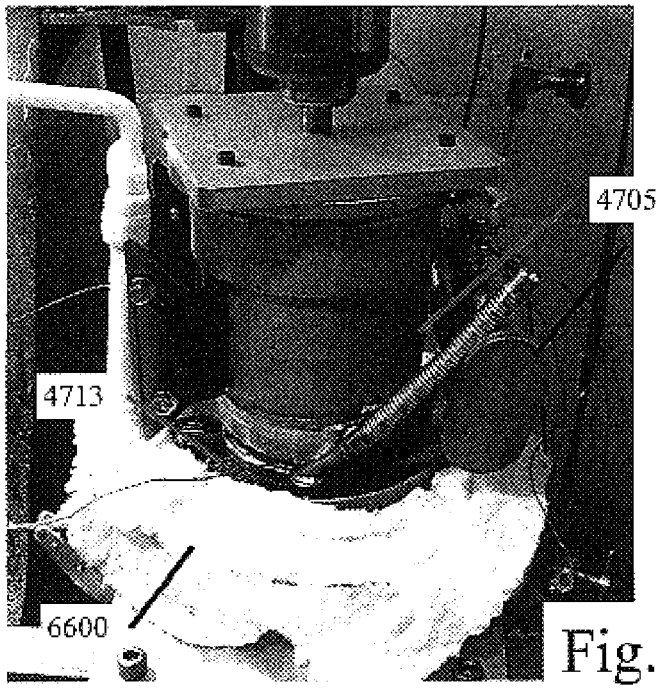
Figure 5B:
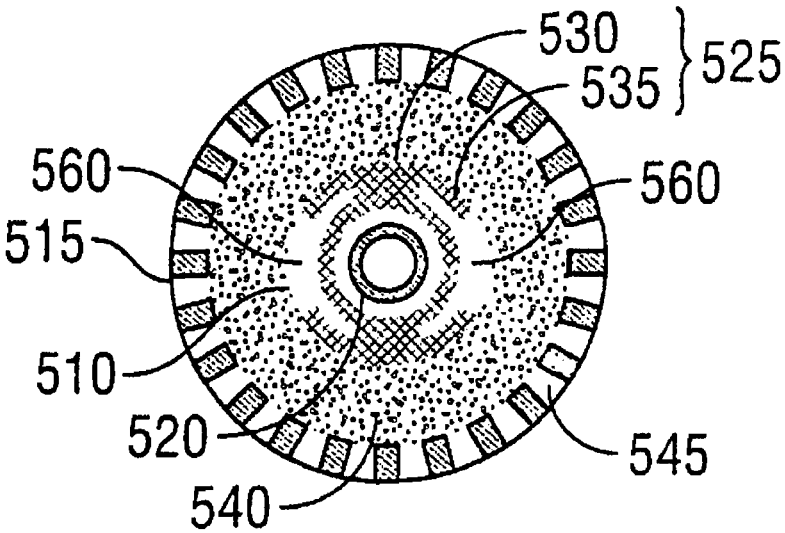
Figure 9C:
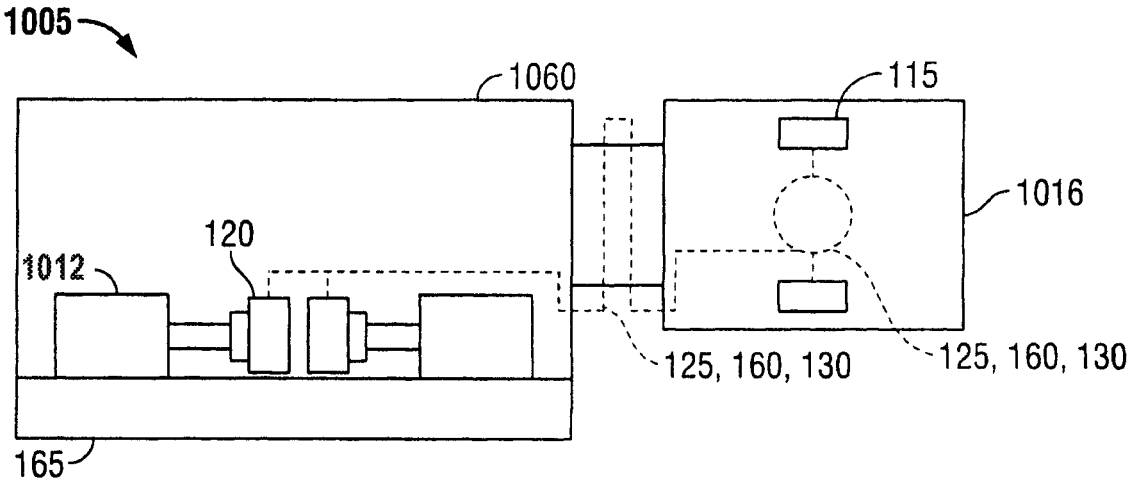
Figure 10:
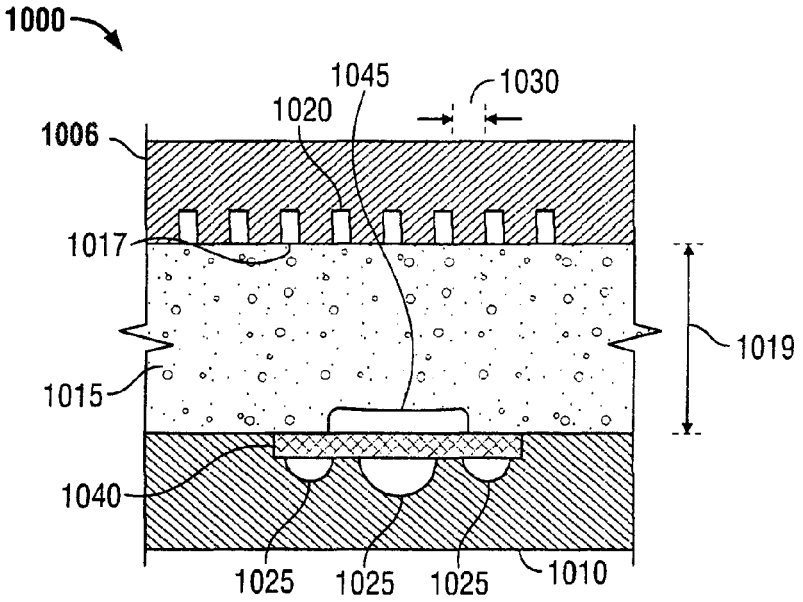
Figure 12:
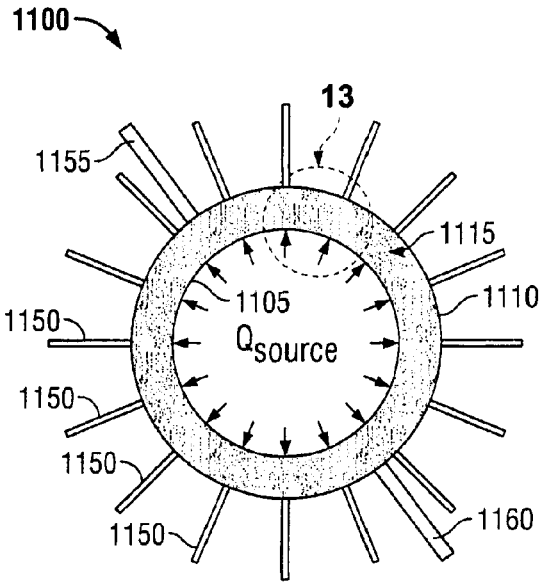
Figure 13:
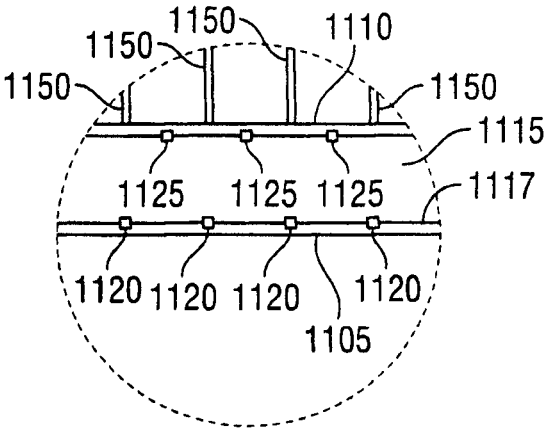
Figure 14B:
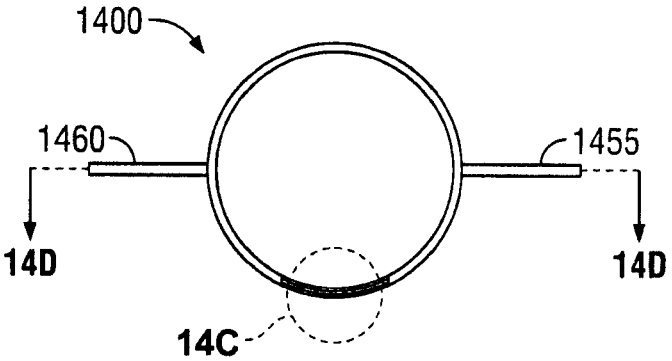
Figure 14C:
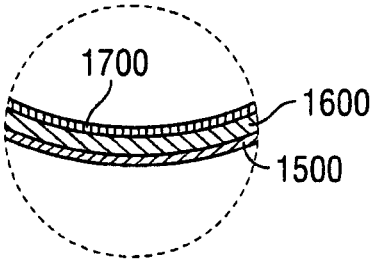
Figure 14D:
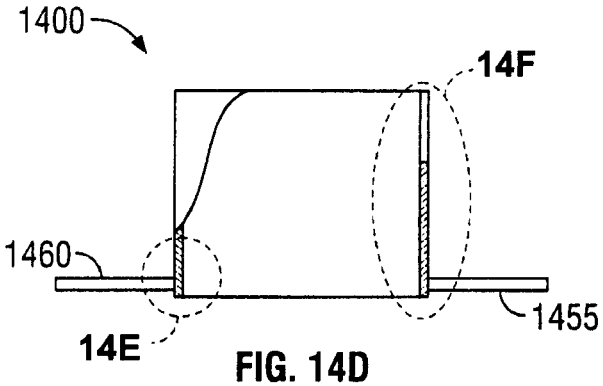
Figure 14E:
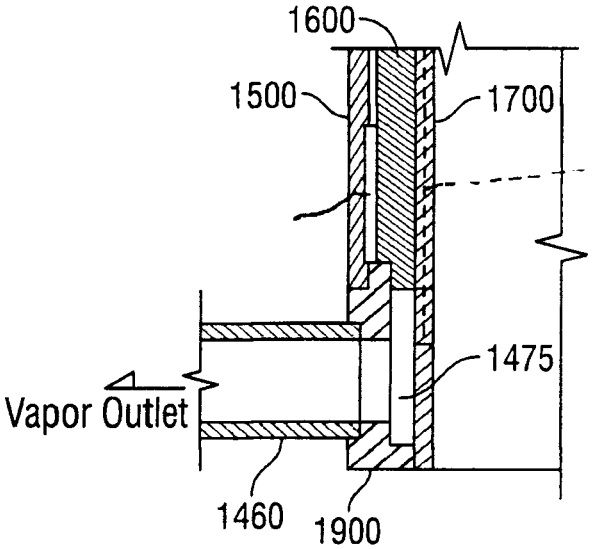
Figure 14F:
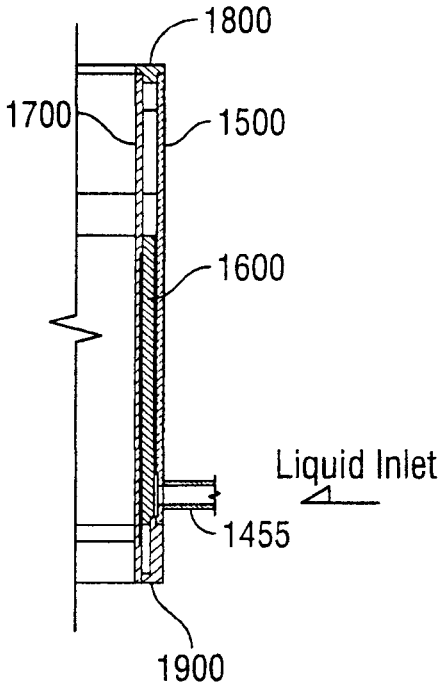
Figure 14G:
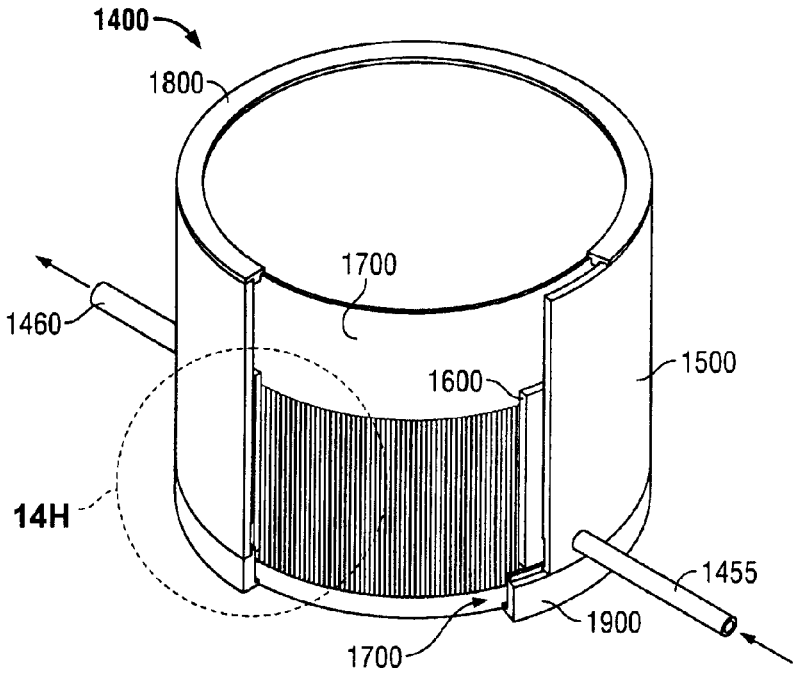
Figure 14H:
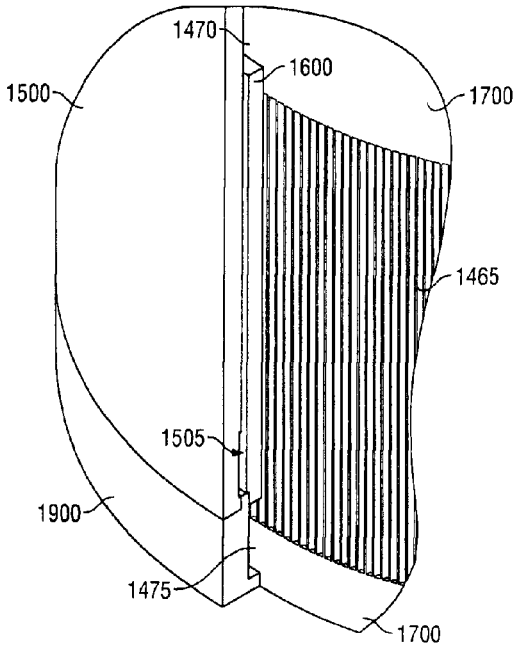
Figure 27:
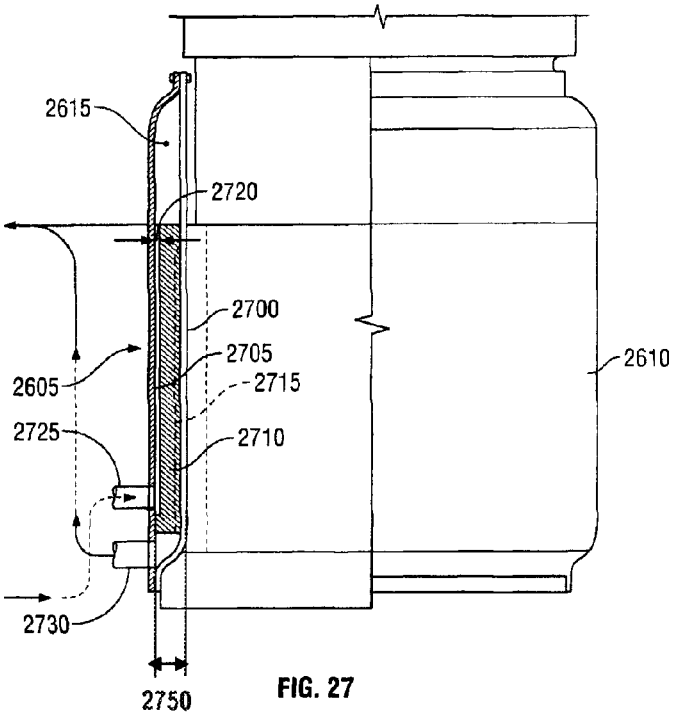
Figure 31:
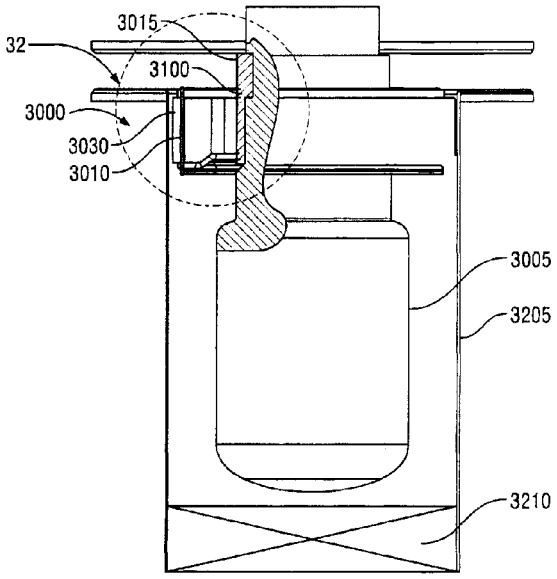
Figure 32:
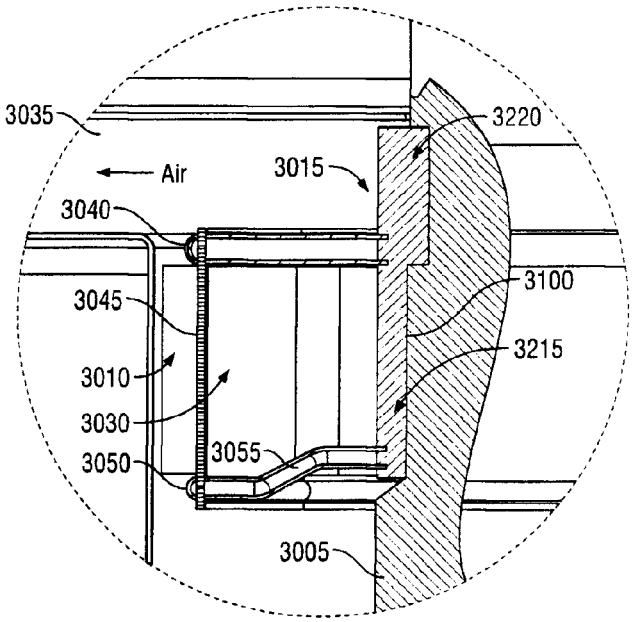
Figure 40:
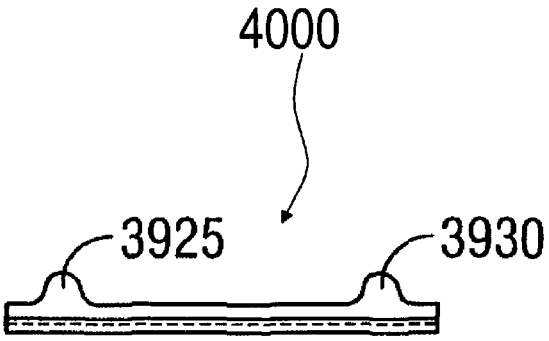

Referring to FIG. 65, a procedure 5430 is performed for coupling the evaporator 4713 to the heat source or cyclical heat exchange system 4705. Initially, an outer diameter of the heat source is machined, as needed (step 6500) to ensure that the evaporator 4713 will fit over the heat source. Next, referring also to FIGS. 66A and B, the evaporator 4713 is prepared (step 6505) by welding the vapor and liquid lines to the evaporator body and then aligning the evaporator 4713 with the system 4705 using a suitable alignment system.

Then, the evaporator 4713 is heat shrunk onto the system 4705 to ensure that the pieces are properly joined. Initially, the evaporator 4713 is heated (step 6510). In one implementation, the evaporator 4713 is placed in a furnace 6600 (shown in FIGS. 66A and B) that heats the evaporator 4713 to about 375° C. Next, the system 4705 and in particular, the hot end 4715, is cooled to a temperature at which the outer diameter of the hot end 4715 is smaller than the inner diameter of the heated evaporator 4713 (step 6515). The system 4705 can be cooled using liquid nitrogen. The cooled system 4705 is inserted into the heated evaporator 4713 (step 6520). Upon insertion of the cooled system 4705, the heat is removed from the evaporator 4713 and the cooling is removed from the system 4705, thus permitting the temperature of the evaporator 4713 and the system 4705 to stabilize (step 6525).

Referring also to FIG. 47, after the temperature has stabilized (step 6525), evaporator 4713 and system 4705 are removed from the alignment and furnace setup and the heat transfer system 4710 is assembled (step 6530). For example, the liquid line 4800 and the vapor line 4805 are connected to the condenser 4712. The heat transfer system 4710 and the cyclical heat exchange system 4705 are then installed in the housing 5090, as shown in FIGS. 50 and 52 (step 6535).

Other implementations are within the scope of the following claims. For example, the wick subassembly 5300 may be assembled at step 5500 by heat shrinking the wick 5320 onto the vapor barrier wall 5315. In this implementation, the wick 5320 is formed from a wick material that is cut to a suitable length, rolled into a cylindrical form and then welded at its mating edges to form a cylinder. The cylindrical wick 5320 is then heated and placed over the vapor barrier wall 5315. After the cylindrical wick 5320 cools, a thermal interface is formed between the wick 5320 and the vapor barrier wall 5315. At this point, sintering can then be used to further improve the thermal transfer between the wick 5320 and the vapor barrier wall 5315.

The parts of the wick subassembly and the outer subassembly can be made of other materials, as long as thermal contact can be achieved with these other materials. For example, the subcooler 5310 can be made of stainless steel or the liquid barrier wall 5305 and the vapor barrier wall 5315 can be made of copper.

The heat may be removed from the wick subassembly 5300 and the cooling may be removed from the control block 5605 prior to insertion of the control block 5605. Likewise, the heat may be removed from the liquid barrier wall 5305 and the cooling may be removed from the control block 5805 prior to insertion of the control block 5805 into the liquid barrier wall 5305. Similarly, the heat may be removed from the outer subassembly 6001 and the cooling may be removed from the temperature control block 5605 prior to insertion of the control block 5605 and the wick subassembly 5300 into the outer subassembly 6001. Lastly, the heat may be removed from the evaporator 4713 and the cooling may be removed from the system 4705 prior to inserting the system 4705 into the heated evaporator 4713.

What is claimed is:

1. A method of making an evaporator, the method comprising:

orienting a vapor barrier wall such that a heat-absorbing surface of the vapor barrier wall defines at least a portion of an exterior surface of the evaporator, the exterior surface being configured to receive heat from a heat source to be cooled by the evaporator;

orienting a liquid barrier wall adjacent the vapor barrier wall, wherein the liquid barrier wall has a surface configured to confine liquid;

positioning a wick between the vapor barrier wall and the liquid barrier wall;

wherein at least one of the orienting a vapor barrier wall, orienting a liquid barrier wall, and positioning the wick includes defining a vapor removal channel at an interface between the wick and the vapor barrier wall; and wherein at least one of the orienting a vapor barrier wall, orienting a liquid barrier wall, and positioning the wick includes defining a liquid flow channel between the liquid barrier wall and the wick.

2. The method of claim 1 further comprising forming the vapor barrier wall and forming the liquid barrier wall.

3. The method of claim 2 wherein forming the vapor barrier wall includes forming the vapor barrier wall into a planar shape and forming the liquid barrier wall includes forming the liquid barrier wall into a planar shape.

4. The method of claim 2 wherein forming the vapor barrier wall includes forming the vapor barrier wall into a cylindrical shape and forming the liquid barrier wall includes forming the liquid barrier wall into a cylindrical shape.

5. The method of claim 4 wherein positioning the wick includes heat shrinking the wick on the vapor barrier wall.

6. The method of claim 4 wherein positioning the wick includes heat shrinking the liquid barrier wall on the wick.

7. The method of claim 1 wherein positioning includes positioning the wick between the vapor barrier wall and the liquid confining surface of the liquid barrier wall.

8. The method of claim 1 further comprising orienting a subcooler adjacent the liquid barrier wall.

9. The method of claim 8 wherein orienting the subcooler includes heat shrinking the subcooler onto the liquid barrier wall.

10. The method of claim 1 further comprising:

forming the vapor barrier wall, and electroetching the vapor removal channel into the vapor barrier wall.

11. The method of claim 1 further comprising:

forming the vapor barrier wall, and machining the vapor removal channel into the vapor barrier wall.

12. The method of claim 1 further comprising embedding the vapor removal channel within the wick.

13. The method of claim 1 further comprising:

forming the vapor barrier wall, and photoetching the vapor removal channel into the vapor barrier wall.

14. The method of claim 1 further comprising forming the vapor barrier wall by rolling a vapor barrier material into a cylindrical shape and sealing mating edges of the vapor barrier material.

15. The method of claim 1 further comprising forming the liquid barrier wall by rolling a liquid barrier material into a cylindrical shape and sealing mating edges of the liquid barrier material.

16. The method of claim 1 wherein orienting the liquid barrier wall includes heat shrinking the liquid barrier wall.

17. The method of claim 1 further comprising:

forming the liquid barrier wall, and photoetching the liquid flow channel into the liquid barrier wall.

18. A method of making an evaporator, the method comprising:

orienting a vapor barrier wall defining a longitudinal axis and having a cylindrical shape inside of a liquid barrier wall having a cylindrical shape and defining a longitudinal axis, such that the longitudinal axis of the liquid barrier wall is parallel with the longitudinal axis of the vapor barrier wall; and positioning a wick between the liquid barrier wall and the vapor barrier wall, the wick defining a longitudinal axis that is parallel with the longitudinal axis of the liquid barrier wall.

19. The method of claim 18 further comprising forming the vapor barrier wall and forming the liquid barrier wall.

20. The method of claim 18 wherein positioning the wick includes heat shrinking the wick on the vapor barrier wall.

21. The method of claim 18 wherein positioning the wick includes heat shrinking the liquid barrier wall on the wick.

22. The method of claim 18 wherein positioning includes positioning the wick between the vapor barrier wall and a liquid confining surface of the liquid barrier wall.

23. The method of claim 18 further comprising orienting a subcooler adjacent the liquid barrier wall.

24. The method of claim 23 wherein orienting the subcooler includes heat shrinking the subcooler onto the liquid barrier wall.

25. The method of claim 18 further comprising:

forming the vapor barrier wall, and electroetching the vapor removal channel into the vapor barrier wall.

26. The method of claim 18 further comprising:

forming the vapor barrier wall, and machining the vapor removal channel into the vapor barrier wall.

27. The method of claim 18 further comprising embedding the vapor removal channel within the wick.

28. The method of claim 18 further comprising:

forming the vapor barrier wall, and photoetching the vapor removal channel into the vapor barrier wall.

29. The method of claim 18 further comprising forming the vapor barrier wall by rolling a vapor barrier material into a cylindrical shape and sealing mating edges of the vapor barrier material.

30. The method of claim 18 further comprising forming the liquid barrier wall by rolling a liquid barrier material into a cylindrical shape and sealing mating edges of the liquid barrier material.

31. The method of claim 18 wherein orienting the liquid barrier wall includes heat shrinking the liquid barrier wall.

32. A method of making an evaporator, the method comprising:

orienting a vapor barrier wall having a cylindrical shape and defining a longitudinal axis with respect to a liquid barrier wall having a cylindrical shape and defining a longitudinal axis, such that the longitudinal axis of the liquid barrier wall is parallel with the longitudinal axis of the vapor barrier wall;

positioning a wick defining a longitudinal axis between the liquid barrier wall and the vapor barrier wall such that the longitudinal axis of the wick is parallel with the longitudinal axis of the liquid barrier wall, wherein the vapor barrier wall is positioned within an interior of the liquid barrier wall and wherein positioning includes heat shrinking at least one of the wick, a combination of the wick and the vapor barrier wall, and the liquid barrier wall.

33. The method of claim 32 wherein positioning the wick between the liquid barrier wall and the vapor barrier wall includes forming the wick around the vapor barrier wall and forming the liquid barrier wall around the wick.

34. The method of claim 32 wherein positioning the wick between the liquid barrier wall and the vapor barrier wall includes mechanically squeezing the wick onto the vapor barrier wall.

35. The method of claim 32 wherein positioning the wick between the liquid barrier wall and the vapor barrier wall includes sintering the wick onto the vapor barrier wall.

36. The method of claim 35 wherein sintering the wick onto the vapor barrier wall includes heating the wick and the vapor barrier wall at a temperature that is below the melting point of the materials used in the wick and the vapor barrier wall.

37. The method of claim 35 wherein sintering the wick onto the vapor barrier wall includes applying pressure to the wick and to the vapor barrier wall.

38. The method of claim 32 wherein heat shrinking at least one of the wick, the combination of the wick and the vapor barrier wall, and the liquid barrier wall includes:

heating the at least one of the wick, the combination of the wick and the vapor barrier wall, and the liquid barrier wall, and after heating, cooling the at least one of the wick, the combination of the wick and the vapor barrier wall, and the liquid barrier wall.

39. The method of claim 32 wherein heat shrinking the at least one of the wick, the combination of the wick and the vapor barrier wall, and the liquid barrier wall includes placing the at least one of the wick, the combination of the wick and the vapor barrier wall, and the liquid barrier wall over another piece.

40. The method of claim 39 wherein:

heat shrinking the wick includes placing the wick over the vapor barrier wall, heat shrinking the combination of the wick and the vapor barrier wall includes placing the combination of the wick and the vapor barrier wall over a control block, and heat shrinking the liquid barrier wall includes placing the liquid barrier wall over a control block.

41. The method of claim 32 further comprising orienting a subcooler adjacent the liquid barrier wall.

42. The method of claim 41 wherein orienting the subcooler includes heat shrinking the subcooler onto the liquid barrier wall.

43. A method of making an evaporator, the method comprising:

forming a wick subassembly, the forming including attaching a cylindrically-shaped wick to a cylindrically-shaped vapor barrier wall;

preparing a cylindrically-shaped liquid barrier wall; and after the cylindrically-shaped liquid barrier wall is prepared and after the cylindrically-shaped wick subassembly is formed, joining the prepared cylindrically-shaped liquid barrier wall with the formed wick subassembly, wherein the vapor barrier wall is positioned within an interior of the liquid barrier wall.

* * * * *

UNITED STATES PATENT AND TRADEMARK OFFICE

CERTIFICATE OF CORRECTION

PATENT NO. : 7,251,889 B2
APPLICATION NO. : 10/974968
DATED : August 7, 2007
INVENTOR(S) : Edward J. Kroliczek et al.

It is certified that error appears in the above-identified patent and that said Letters Patent is hereby corrected as shown below:

The title page should be deleted to appear as per attached title page.

The sheets of drawings should be deleted to appear as per the attached drawings.

(12) United States Patent
Kroliczek et al.

(10) Patent No.: US 7,251,889 B2
(45) Date of Patent: Aug. 7, 2007

(54) MANUFACTURE OF A HEAT TRANSFER SYSTEM

(75) Inventors: Edward J. Kroliczek, Davidsonville, MD (US); James Seokgeun Yun, Silver Spring, MD (US); Michael Nikitkin, Ellicott City, MD (US); David A. Wolf, Sr., Baltimore, MD (US)

(73) Assignee: Swales & Associates, Inc., Beltsville, MA (US)

( * ) Notice: Subject to any disclaimer, the term of this patent is extended or adjusted under 35 U.S.C. 154(b) by 141 days.

(21) Appl. No.: 10/974,968

(22) Filed: Oct. 28, 2004

(65) Prior Publication Data

US 2005/0166399 A1 Aug. 4, 2005

Related U.S. Application Data

(63) Continuation-in-part of application No. 10/676,265, filed on Oct. 2, 2003, and a continuation-in-part of application No. 10/694,387, filed on Oct. 28, 2003, and a continuation-in-part of application No. 10/602,022, filed on Jun. 24, 2003, now Pat. No. 7,004,240, and a continuation-in-part of application No. 09/896,561, filed on Jun. 29, 2003, now Pat. No. 6,889,754.

(60) Provisional application No. 60/514,424, filed on Oct. 28, 2003, provisional application No. 60/421,737, filed on Oct. 28, 2002, provisional application No. 60/415,424, filed on Oct. 2, 2002, provisional application No. 60/391,006, filed on Jun. 24, 2002, provisional application No. 60/215,588, filed on Jun. 30, 2000.

(51) Int. Cl.
*B21D 53/02* (2006.01)
*B23P 15/26* (2006.01)

(52) U.S. Cl. ..... 29/890.07; 29/890.032; 165/104.26; 165/272; 165/DIG. 531

(58) Field of Classification Search ..... 29/890.032, 29/447, 890.07; 165/104.21, 104.26, 272, 165/DIG. 531
See application file for complete search history.

(56) References Cited

U.S. PATENT DOCUMENTS 3,490,718 A 1/1970 Vary (Continued)

FOREIGN PATENT DOCUMENTS

EP 0 210 337 2/1987

(Continued)

OTHER PUBLICATIONS

Jentung Ku, "Operational Characteristics of Loop Heat Pipes", NASA Goddard Space Flight Center; SAE Paper 99-01-2007, 29th International Conference on Environmental Systems, Denver, Colorado, Jul. 12-15, 1999; Society of Automotive Engineers, Inc.

(Continued)

*Primary Examiner*—Eric Compton
(74) *Attorney, Agent, or Firm*—Fish & Richardson P.C.

(57) ABSTRACT

A method of making an evaporator includes orienting a vapor barrier wall, orienting a liquid barrier wall, and positioning a wick between the vapor barrier wall and the liquid barrier wall. The vapor barrier wall is oriented such that a heat-absorbing surface of the vapor barrier wall defines at least a portion of an exterior surface of the evaporator. The exterior surface is configured to receive heat. The liquid barrier wall is oriented adjacent the vapor barrier wall. The liquid barrier wall has a surface configured to confine liquid. A vapor removal channel is defined at an interface between the wick and the vapor barrier wall. A liquid flow channel is defined between the liquid barrier wall and the primary wick.

43 Claims, 70 Drawing Sheets

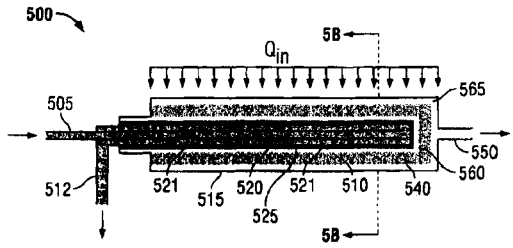

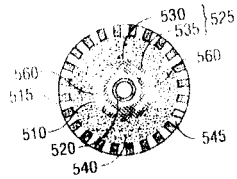

Figure 12:
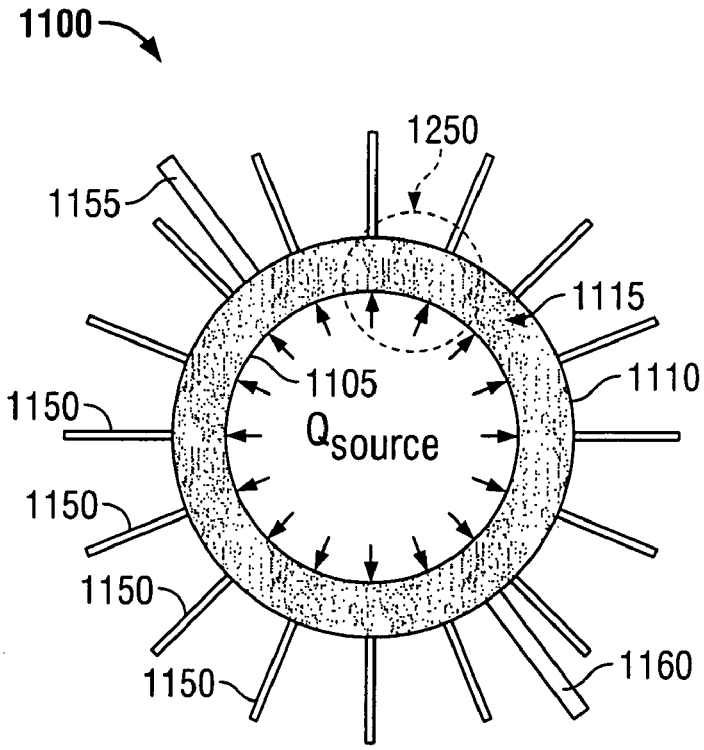
FIG. 12 is a radial cross-sectional view of the annular evaporator of FIG. 11.
Figure 13:
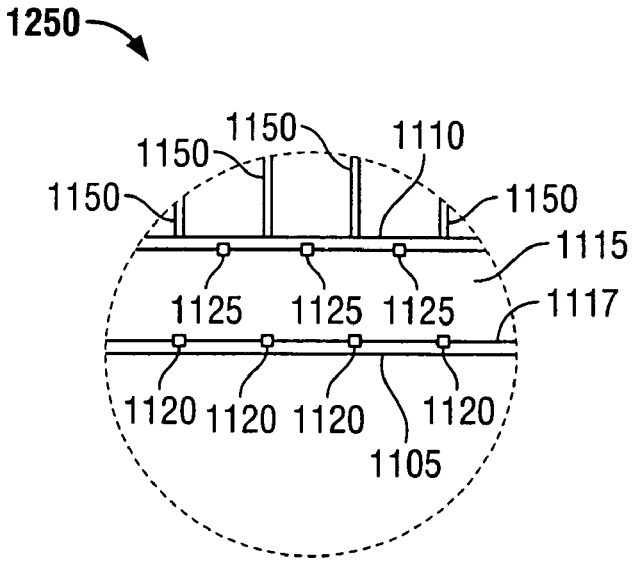
FIG. 13 is an enlarged view of a portion of the radial cross-sectional view of the annular evaporator of FIG. 12.
Figure 40:
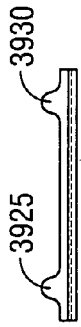
FIG. 40 is a partial cross-sectional view taken along line 40—40 of the condenser of FIG. 39.

Replace FIG. 5B with the following figure:

Replace FIG. 9C with the following figure:

Replace FIG. 10 with the following figure:

Replace FIG. 12 with the following figure:

Replace FIG. 13 with the following figure:

Replace FIG. 14B with the following figure:

Replace FIGS. 14C and 14D with the following figures:

Replace FIGS. 14E and 14F with the following figures:

Replace FIG. 14G with the following figure:

Replace FIG. 14H with the following figure:

Replace FIG. 27 with the following figure:

Replace FIG. 31 with the following figure:

Replace FIG. 32 with the following figure:

Replace FIG. 40 with the following figure:

| | | |
|---|---|---|
| COLUMN 4, | LINE 64, | change "at detail **3200)**" to --along circle **32** of FIG. 31)-- |
| COLUMN 9, | LINE 54, | change "head" to --heat-- |
| COLUMN 9, | LINE 62, | change "outlet port **139**." to --outlet **139**.-- |
| COLUMN 9, | LINE 64, | change "outlet port **139**" to --outlet **139**-- |
| COLUMN 10, | LINE 1, | change "outlet port **139**" to --outlet **139**-- |
| COLUMN 10, | LINE 2, | change "outlet port **139**." to --outlet **139**.-- |
| COLUMN 10, | LINE 24, | change "temperature **410**," to --time **410**,-- |
| COLUMN 13, | LINE 23, | change "axis **1020** within" to --axis within-- |
| COLUMN 13, | LINE 25, | change "axis **1025** within" to --axis within-- |
| COLUMN 13, | LINE 32, | change "**1010**" to --**1012**-- |
| COLUMN 13, | LINE 33, | change "source **1010**" to --source **1012**-- |
| COLUMN 13, | LINE 37, | at the end of the line, change "sensor" to --component-- |
| COLUMN 13, | LINE 38, | change "cryocooler **1010**" to --cryocooler **1012**-- |
| COLUMN 13, | LINE 39, | change "sensor **1016**," to --component **1016**,-- |
| COLUMN 13, | LINE 40, | change "sensor **1016**." to --component **1016**.-- |
| COLUMN 14, | LINE 45, | change "wall **1005**," to --wall **1006**,-- |
| COLUMN 14, | LINE 50, | change "wall **1005**" to --wall **1006**-- |
| COLUMN 14, | LINE 59, | change "wall **1005**." to --wall **1006**.-- |
| COLUMN 14, | LINE 62, | change "wall **1005**" to --wall **1006**-- |
| COLUMN 14, | LINE 63, | change "wall **1005**" to --wall **1006**-- |
| COLUMN 14, | LINE 65, | change "wall **1005**" to --wall **1006**-- |
| COLUMN 15, | LINE 3, | change "wall **1005**" to --wall **1006**-- |
| COLUMN 15, | LINE 8, | change "wall **1005**." to --wall **1006**.-- |
| COLUMN 15, | LINE 23, | change "wall **1005**" to --wall **1006**-- |
| COLUMN 15, | LINE 27, | change "wall **1005**," to --wall **1006**,-- |
| COLUMN 16, | LINE 37, | change "a fluid" to --the fluid-- |
| COLUMN 17, | LINE 6, | change "space" to --spaced-- |
| COLUMN 19, | LINE 39, | change "may of" to --made of-- |
| COLUMN 22, | LINE 9, | change "stock **2640**" to --stock **2640)**-- |
| COLUMN 23, | LINE 25, | change "according one" to --according to one-- |
| COLUMN 23, | LINE 36, | change "system **3050**" to --system **3505**-- |
| COLUMN 23, | LINE 39, | change "system **3050**" to --system **3505**-- |
| COLUMN 25, | LINE 13, | change "provides on" to --provides an-- |

Signed and Sealed this

Twenty-third Day of February, 2010

David J. Kappos

David J. Kappos
*Director of the United States Patent and Trademark Office*